US006016413A

United States Patent [19]

Yokoyama et al.

[11] Patent Number: 6,016,413

[45] **Date of Patent: *Jan. 18, 2000**

[54] ASSEMBLING METHOD OF PROCESS CARTRIDGE, ASSEMBLING METHOD AND PROCESS CARTRIDGE

[75] Inventors: Katsunori Yokoyama, Susono; Kazushi Watanabe; Atsushi Numagami, both of Mishima, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/887,457

[22] Filed: Jul. 2, 1997

[30] Foreign Application Priority Data

Jul. 4, 1996 [JP] Japan ..... 8-195727

[51] Int. Cl.[7] ..... G03G 15/00

[52] U.S. Cl. ..... 399/113; 399/111; 29/469

[58] Field of Search ..... 399/111–114; 29/469

[56] References Cited

U.S. PATENT DOCUMENTS

| | | | |
|---|---|---|---|
| 4,829,335 | 5/1989 | Kanemitsu et al. . | |
| 5,023,660 | 6/1991 | Ebata et al. . | |
| 5,095,335 | 3/1992 | Watanabe et al. . | |
| 5,450,166 | 9/1995 | Yashiro . | |
| 5,488,459 | 1/1996 | Tsuda et al. . | |
| 5,623,328 | 4/1997 | Tsuda et al. . | |
| 5,659,847 | 8/1997 | Tsuda et al. . | |
| 5,749,027 | 5/1998 | Ikemoto et al. | 399/113 |
| 5,774,766 | 6/1998 | Kurakama et al. | 399/111 |

FOREIGN PATENT DOCUMENTS

| | | |
|---|---|---|
| 0 501 497 A2 | 9/1992 | European Pat. Off. . |
| 0 708 387 A2 | 4/1996 | European Pat. Off. . |
| 0 740 227 A1 | 10/1996 | European Pat. Off. . |
| 1-244472 | of 0000 | Japan . |

*Primary Examiner*—Joan Pendegrass
*Attorney, Agent, or Firm*—Fitzpatrick, Cella, Harper & Scinto

[57] ABSTRACT

An assembling method of a process cartridge detachably mountable to an image forming apparatus includes providing a drum frame, supporting an photosensitive drum and having first and second engaging portions above the electrophotographic photosensitive drum, one adjacent each longitudinal end of the electrophotographic photosensitive drum; and providing a developing device frame supporting a developer, and having first and second compression springs above the developer, one adjacent each longitudinal end of the developer, and first and second projected portions projected in a direction crossing with a longitudinal direction of the developer, one adjacent each longitudinal end of the developer. The first and second projected portions are engaged with the first and second engaging portions, respectively. A first penetrating member is penetrated through a first opening formed in the first projected portion and a third opening formed in the first engaging portion, and a second penetrating member is penetrated through a second opening formed in the second projected portion and a fourth opening formed in the second engaging portion, while the projected portions and the engaging portions are engaged with each other.

16 Claims, 34 Drawing Sheets

ASSEMBLING METHOD OF PROCESS CARTRIDGE, ASSEMBLING METHOD AND PROCESS CARTRIDGE

FIELD OF THE INVENTION AND RELATED ART

The present invention relates to an assembling method of a process cartridge, a process cartridge and an electrophotographic image forming apparatus.

Here, the electrophotographic image forming apparatus forms an image on a recording material using an electrophotographic image formation process. Examples of the electrophotographic image forming apparatus include an electrophotographic copying machine, an electrophotographic printer (laser beam printer, LED printer or the like), a facsimile machine, a word processor or the like.

The process cartridge integrally contains an electrophotographic photosensitive member and charging means, developing means or cleaning means, and is detachably mountable relative to a main assembly of the image forming apparatus. It may integral contain the electrophotographic photosensitive member and at least one of the charging means, the developing means and the cleaning means. As another example, it may contain the electrophotographic photosensitive member and at least the developing means.

In an electrophotographic image forming apparatus using an electrophotographic image forming process, the process cartridge is used, which contains the electrophotographic photosensitive member and process means actable on said electrophotographic photosensitive member, and which is detachably mountable as a unit to a main assembly of the image forming apparatus (process cartridge type). With this process cartridge type, the maintenance of the apparatus can be carried out in effect by the user without depending on a serviceman. Therefore, the process cartridge type is now widely used in electrophotographic image forming apparatuses.

The process cartridge comprises a developing device frame containing developing means and a drum frame containing at least an electrophotographic photosensitive drum. The photosensitive drum and the developing roller of the developing means are urged toward each other by a spring member.

Such a process cartridge is known as disclosed in U.S. Pat. No. 5,450,166 and Japanese Laid-open Patent Application No. 244472/19890

SUMMARY OF THE INVENTION

It is a principal object of the present invention to provide an assembling method of a process cartridge, a process cartridge and an electrophotographic image forming apparatus, wherein assembling operativity is improved.

It is another object of the present invention to provide an assembling method of a process cartridge, a process cartridge and an electrophotographic image forming apparatus to which a process cartridge is detachably mountable, wherein the process cartridge is assembled with correct positioning by coupling the developing device frame and the drum frame so that assembling is easy.

According to an aspect of the present invention, there is provided an assembling method of a process cartridge detachably mountable to a main assembly of an electrophotographic image forming apparatus, comprising: (a) providing a drum frame supporting an electrophotographic photosensitive drum and having a first engaging portion above the electrophotographic photosensitive drum adjacent one longitudinal end of the electrophotographic photosensitive drum, and a second engaging portion above the electrophotographic photosensitive drum adjacent the other longitudinal end of the electrophotographic photosensitive drum; (b) providing a developing device frame supporting a developing means for developing a latent image formed on the electrophotographic photosensitive drum, and having a first compression spring and a second compression spring above the developing means adjacent one and the other longitudinal ends of the developing means, and a first projected portion and a second projected portion projected in a direction crossing with a longitudinal direction of the developing means adjacent one and the other longitudinal ends of the developing means; (c) a first engaging step of engaging the first projected portion and the first engaging portion; (d) a second engaging step engaging the second projected portion and the second engaging portion; (e) a first penetration step of penetrating a first penetrating member through a first opening formed in the first projected portion and a third opening formed in the first engaging portion, while the first projected portion and the first engaging portion are engaged; (f) a second penetration step of penetrating second penetrating member through a second opening formed in the second projected portion and a fourth opening formed in the second engaging portion, while the second projected portion and the second engaging portion are engaged with each other, so as to couple the drum frame and developing device frame.

According to another aspect of the present invention, there is provided a process cartridge detachably mountable to a main assembly of an electrophotographic image forming apparatus, comprising: an electrophotographic photosensitive drum; developing means for developing a latent image formed on the electrophotographic photosensitive drum; a developing device frame for supporting the developing means; a drum frame for supporting the electrophotographic photosensitive drum; a toner frame having the toner accommodating portion; a compression spring having an end mounted to a portion of the developing device frame above the developing means adjacent one and the other longitudinal ends of the developing means, and having the other end contacted to the drum frame; a first projected portion and a second projected portion projected, in a direction crossing with a longitudinal direction of the developing means, from a portion of the developing device frame adjacent each of one and the other longitudinal ends of the developing means; a first opening formed in the first projected portion; a second opening formed in the second projected portion; a first engaging portion, provided at a drum frame above the electrophotographic photosensitive drum adjacent one longitudinal end of the drum frame, for engaging with the first projected portion; a second engaging portion, provided at a drum frame above the electrophotographic photosensitive drum adjacent the other longitudinal end of the drum frame, for engaging with the second projected portion; a third opening formed in the first engaging portion; a fourth opening formed in the second engaging portion; a first penetrating member penetrating through the first opening and third opening while the first projected portion and the first engaging portion are engaged with each other, to couple the drum frame and developing device frame; a second penetrating member penetrating through the second opening and fourth opening while the second projected portion and the second engaging portion are engaged with each other, to couple the drum frame and developing device frame.

According to a further aspect of the present invention, there is provided an electrophotographic image forming apparatus for forming an image on a recording material, to which a process cartridge is detachably mountable, the apparatus comprising: a mounting means for mounting a process cartridge, the process cartridge comprising: electrophotographic photosensitive drum; mounting means for detachably mounting the process cartridge, the process cartridge including: developing means for developing a latent image formed on the electrophotographic photosensitive drum; a developing device frame for supporting the developing means; a drum frame for supporting the electrophotographic photosensitive drum; a toner frame having the toner accommodating portion; a compression spring having an end mounted to a portion of the developing device frame above the developing means adjacent one and the other longitudinal ends of the developing means, and having the other end contacted to the drum frame; a first projected portion and a second projected portion projected, in a direction crossing with a longitudinal direction of the developing means, from a portion of the developing device frame adjacent each of one and the other longitudinal ends of the developing means; a first opening formed in the first projected portion; a second opening formed in the second projected portion; a first engaging portion, provided at a drum frame above the electrophotographic photosensitive drum adjacent one longitudinal end of the drum frame, for engaging with the first projected portion; a second engaging portion, provided at a drum frame above the electrophotographic photosensitive drum adjacent the other longitudinal end of the drum frame, for engaging with the second projected portion; a third opening formed in the first engaging portion; a fourth opening formed in the second engaging portion; a first penetrating member penetrating through the first opening and third opening while the first projected portion and the first engaging portion are engaged with each other, to couple the drum frame and developing device frame; a second penetrating member penetrating through the second opening and fourth opening while the second projected portion and the second engaging portion are engaged with each other, to couple the drum frame and developing device frame; the apparatus further comprising: b. feeding means for feeding the recording material.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described with reference to the drawings.

Next, desirable embodiments of the present invention will be described. In the following description, the "widthwise" direction of a process cartridge B means the direction in which the process cartridge B is installed into, or removed from, the main assembly of an image forming apparatus, and coincides with the direction in which a recording medium is conveyed. The "lengthwise" direction of the process cartridge B means a direction which is intersectional with (substantially perpendicular to) the direction in which the process cartridge B is installed into, or removed from, a main assembly 14. This direction is parallel to the surface of the recording medium, and intersectional with (substantially perpendicular to) the direction in which the recording medium is conveyed. Further, the "left" or "right" means the left or right relative to the direction in which the recording medium is conveyed, as seen from above.

Figure 1:
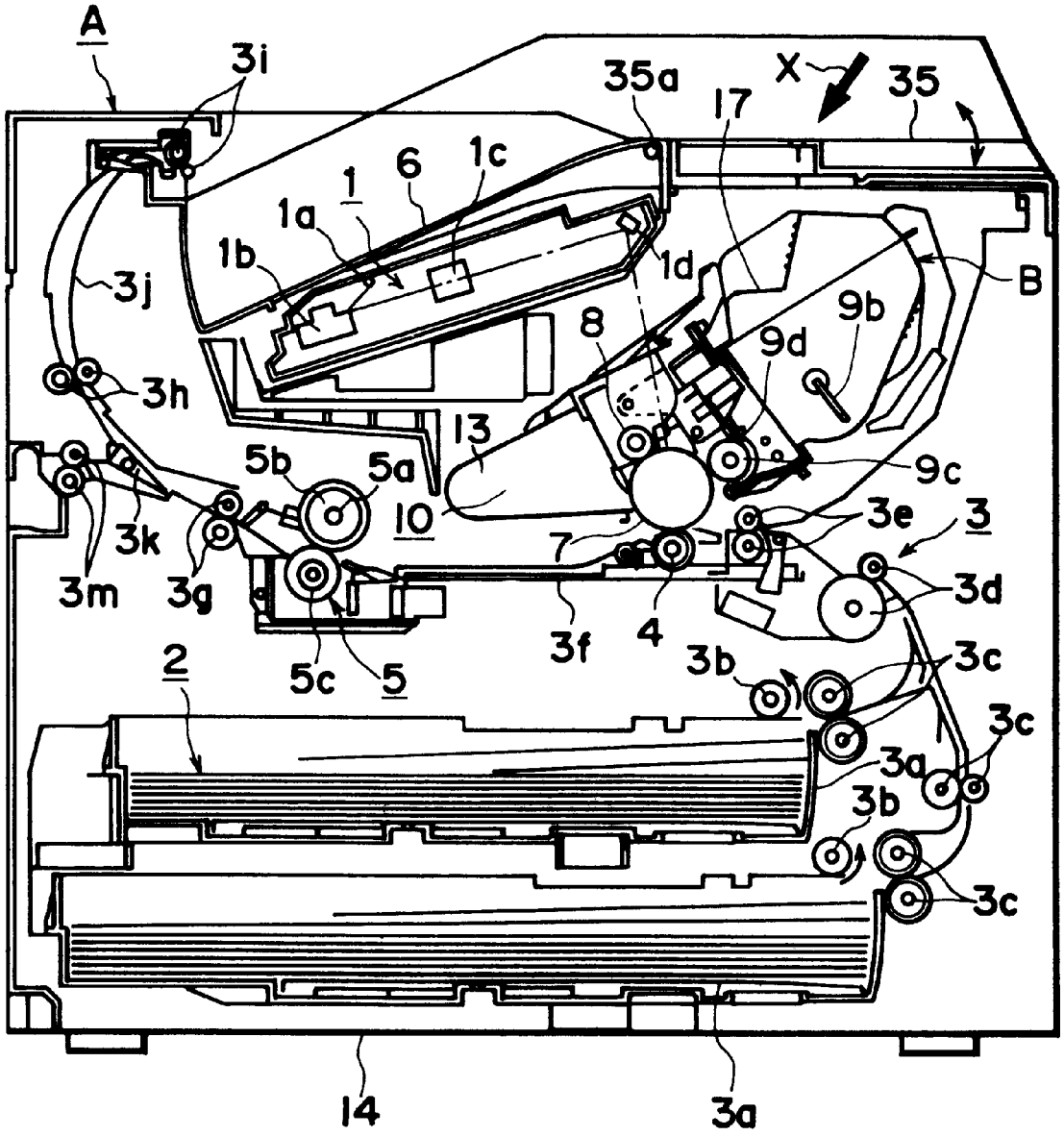
FIG. 1 is a vertical section of an electrophotographic image forming apparatus.
Figure 2:
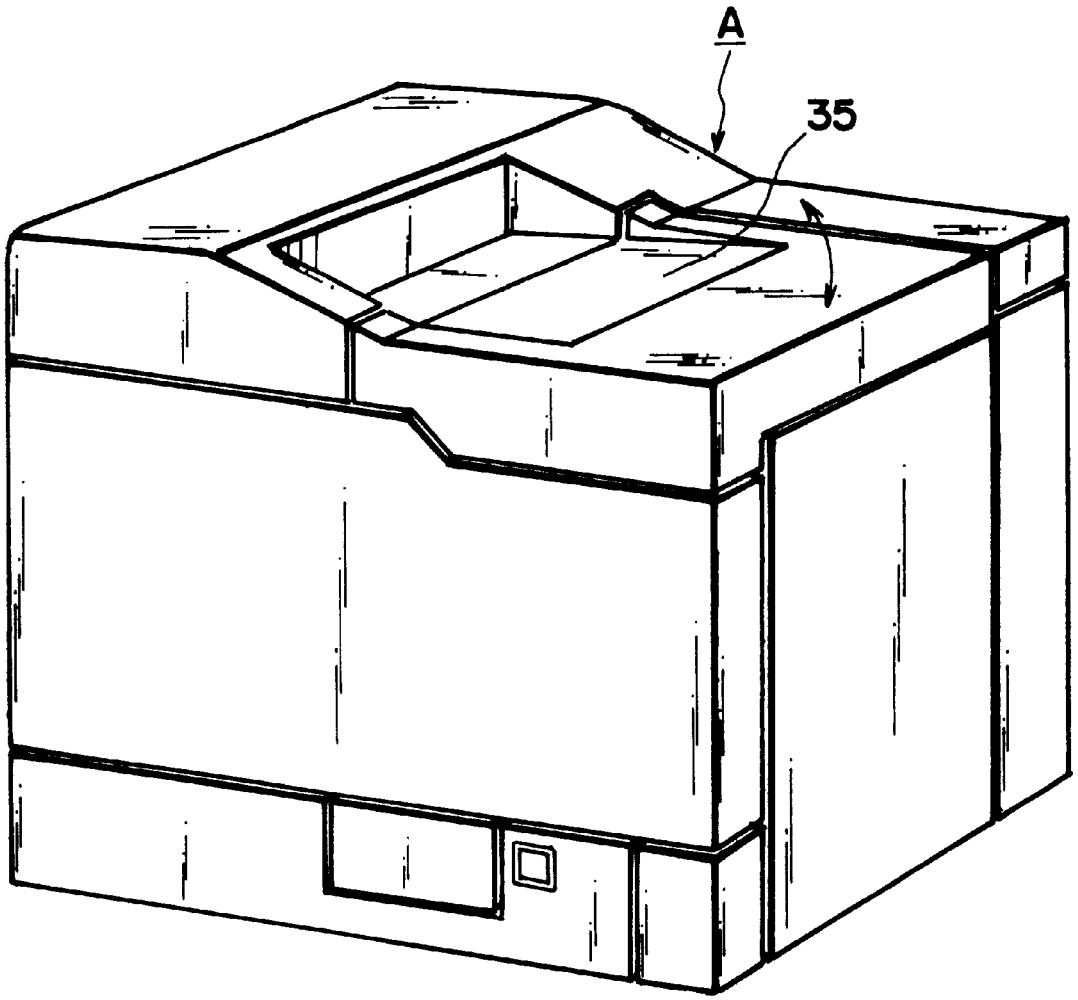
FIG. 2 is an external perspective view of the apparatus illustrated in FIG. 1.
Figure 3:
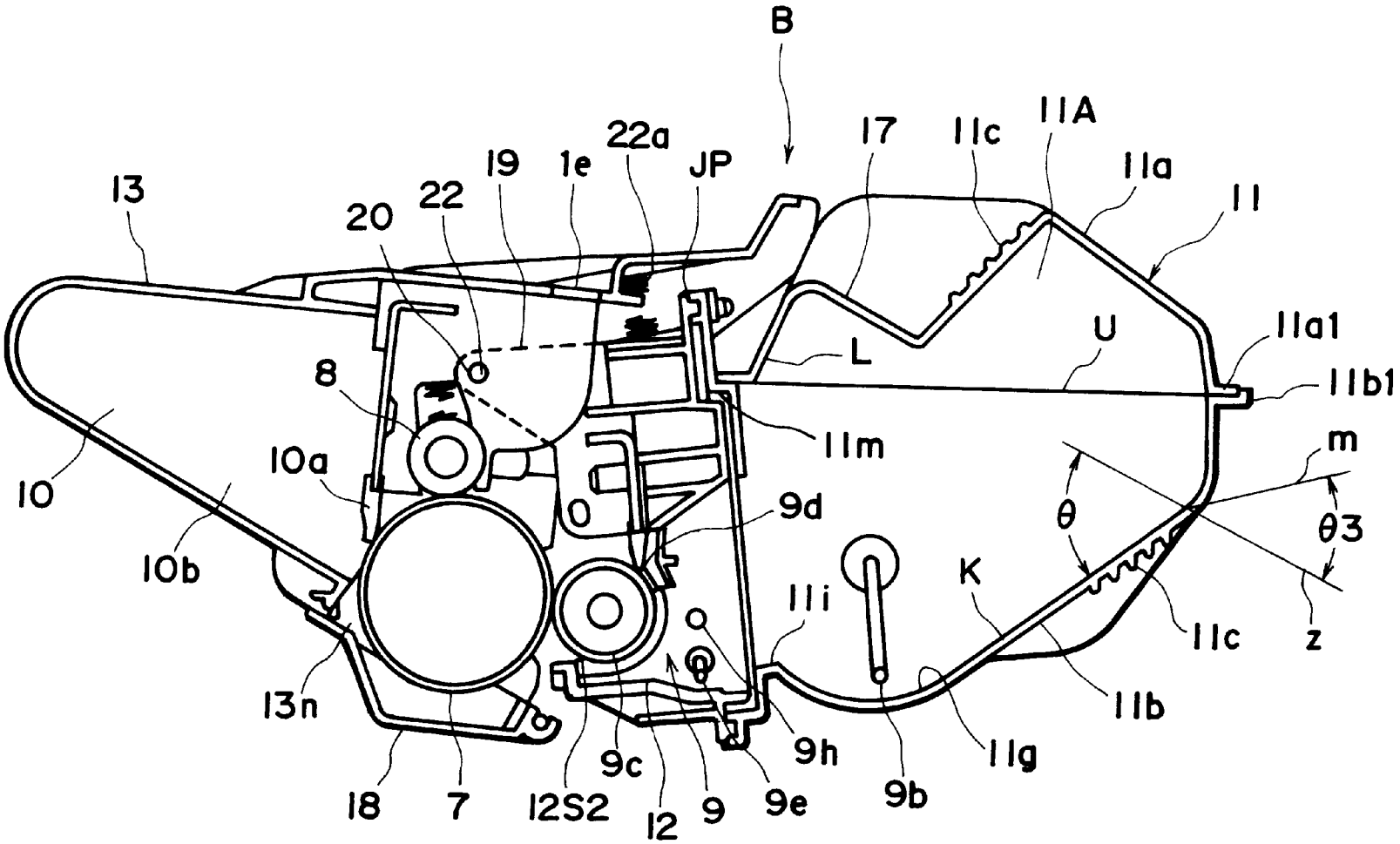
FIG. 3 is a crosssection of a process cartridge.
Figure 4:
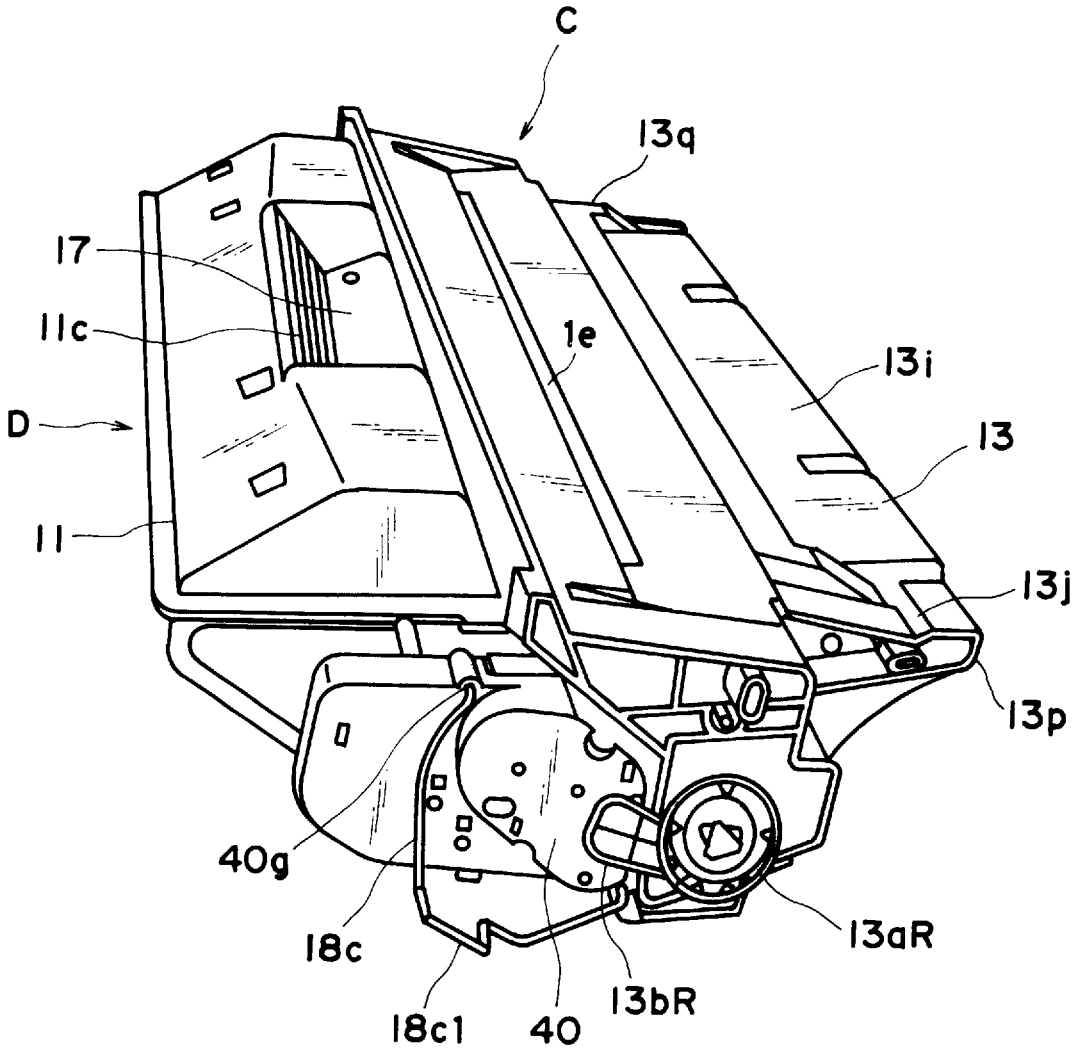
FIG. 4 is an external perspective view of the process cartridge illustrated in FIG. 3, as seen from the top right direction.
Figure 5:
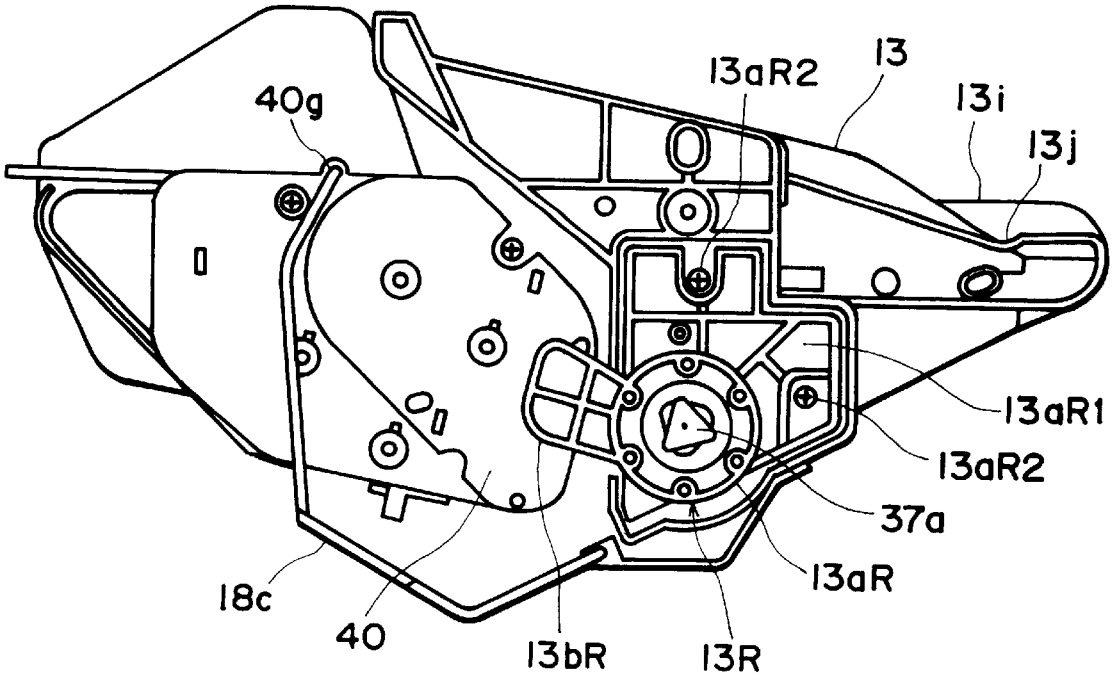
FIG. 5 is the right-hand side view of the process cartridge illustrated in FIG. 3.
Figure 6:
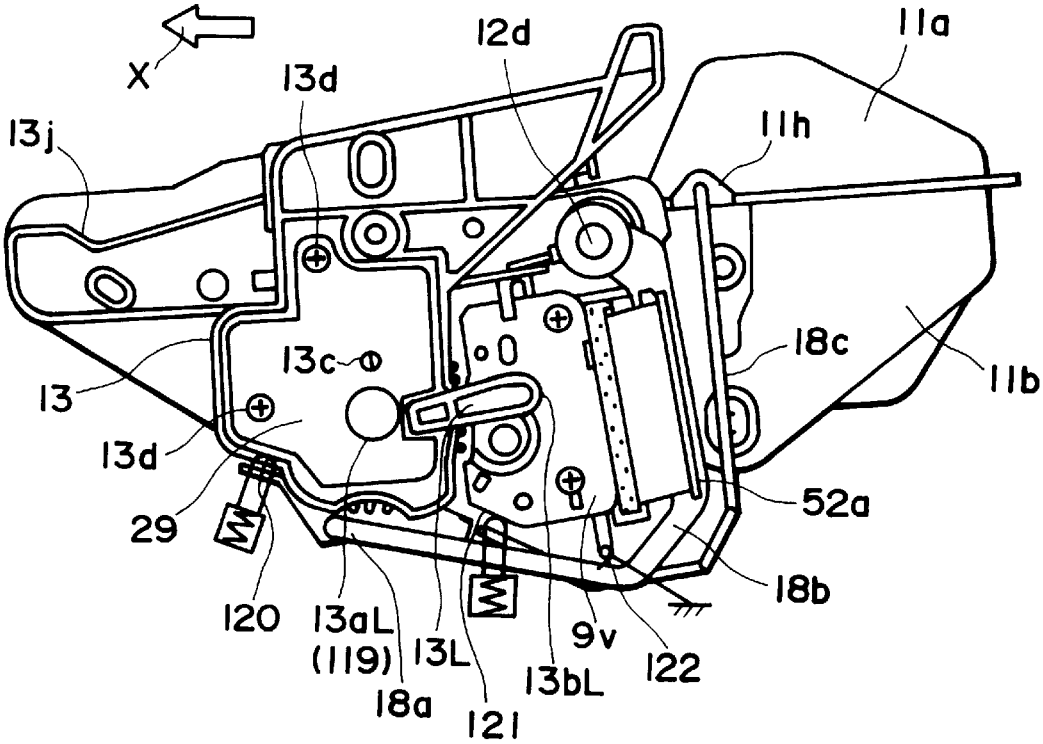
FIG. 6 is the left-hand side view of the process cartridge illustrated in FIG. 3.
Figure 7:
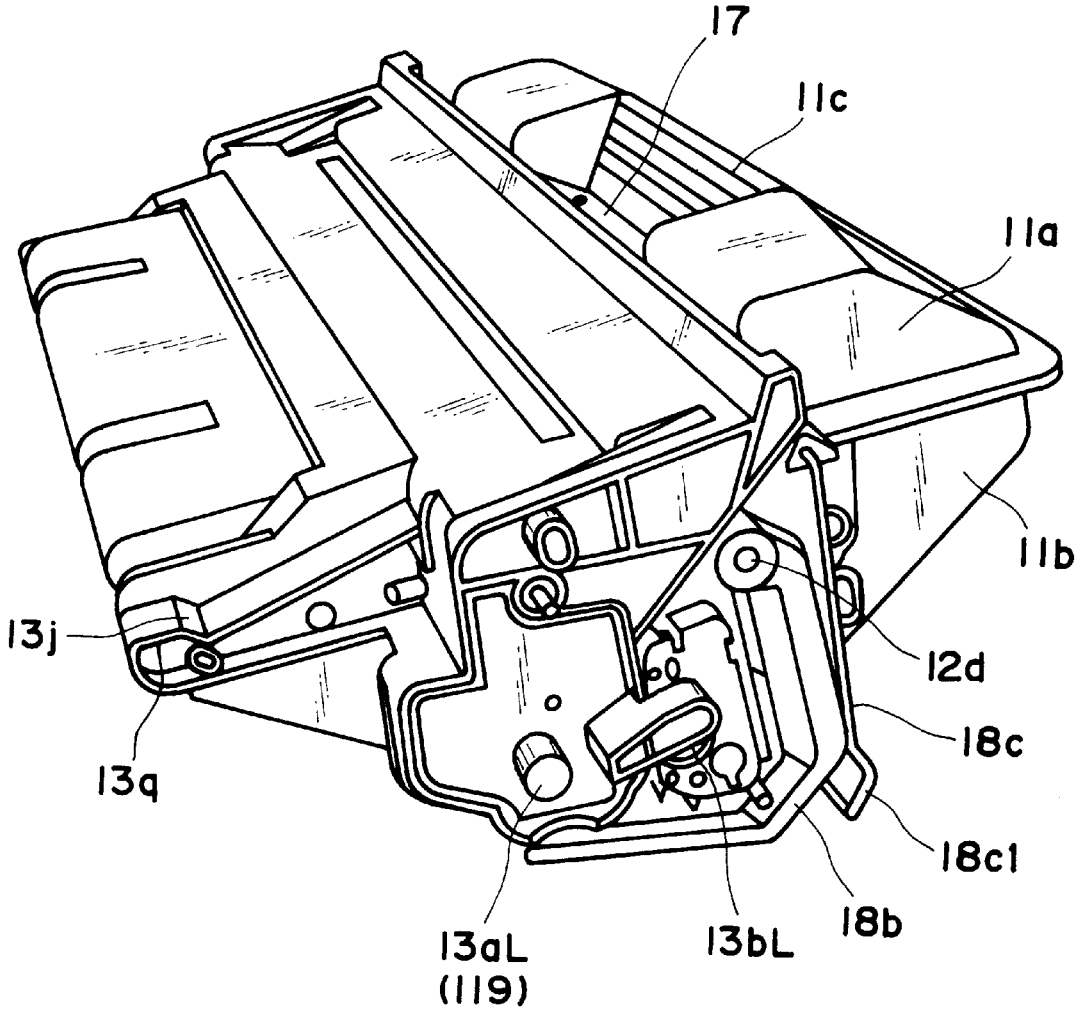
FIG. 7 is an external perspective view of the process cartridge illustrated in FIG. 3, as seen from the top left direction.
Figure 8:
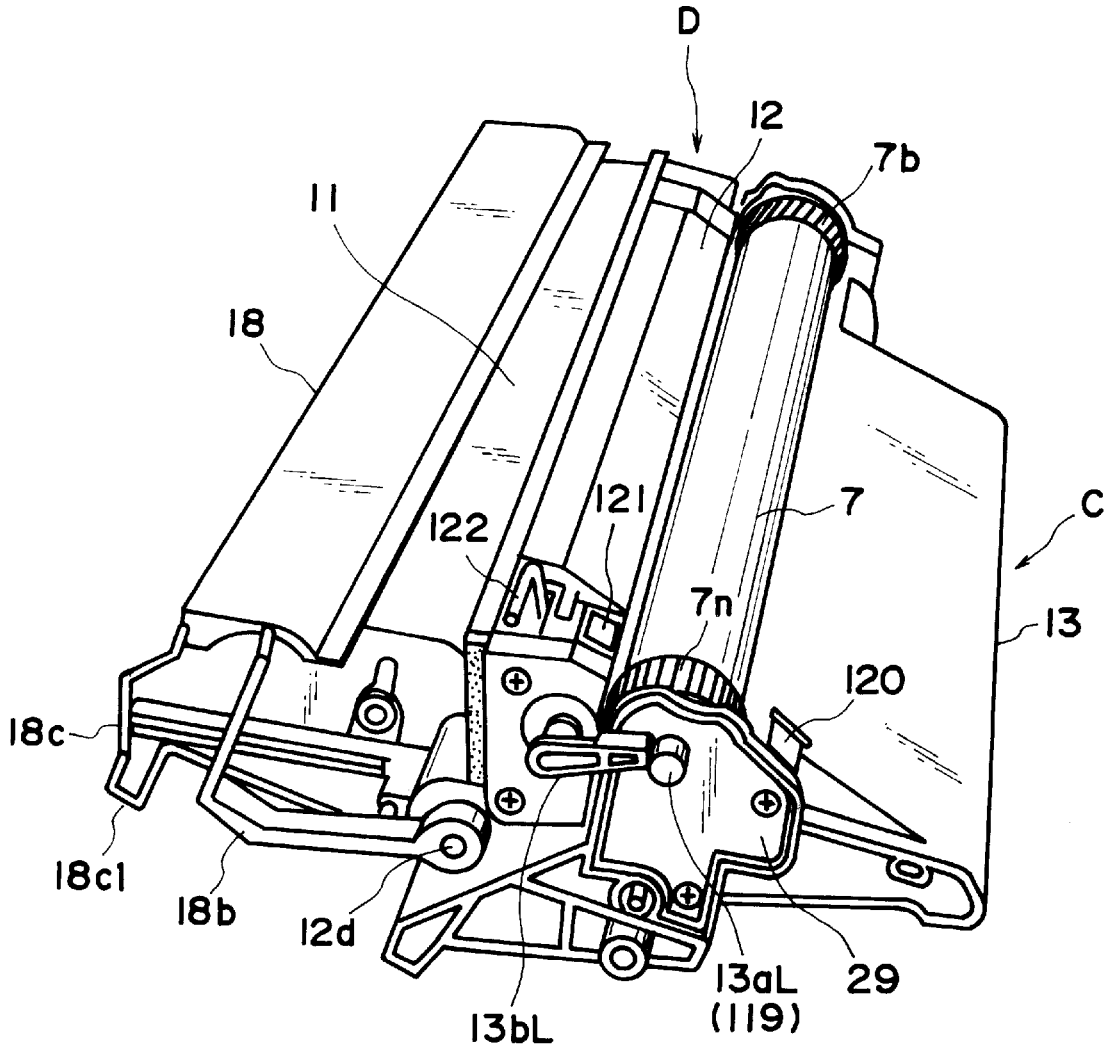
FIG. 8 is an external perspective view of the bottom left side of the process cartridge illustrated in FIG. 3.

FIG. 1 shows an electrophotographic image forming apparatus (laser beam printer) which embodies the present invention, depicting the general structure thereof; FIG. 2, an external perspective view thereof; and FIGS. 3–8 are drawings of process cartridges which embody the present invention. More specifically, FIG. 3 is a crosssection of a process cartridge; FIG. 4, an external perspective view of the process cartridge; FIG. 5, a right-hand side view of the process cartridge; FIG. 6, a left-hand side view of the process cartridge; FIG. 7, a perspective view of the process cartridge as seen from the top left direction; and FIG. 8 is a perspective view of the process cartridge as seen from the bottom left direction. In the following description, the "top" surface of the process cartridge B means the surface which faces upward when the process cartridge B is in the main assembly 14 of the image forming apparatus, and the "bottom" surface means the surface which faces downward.

(Electrophotographic Image Forming Apparatus A and Process Cartridge B)

First, referring to FIGS. 1 and 2, a laser beam printer A as an electrophotographic image forming apparatus which embodies the present invention will be described. FIG. 3 is a crosssection of a process cartridge which also embodies the present invention.

Referring to FIG. 1, the laser beam printer A is an apparatus which forms an image on a recording medium (for example, a recording sheet, an OHP sheet, or fabric) through an electrophotographic image forming process. It forms a toner image on an electrophotographic photosensitive drum (hereinafter, photosensitive drum). More specifically, the photosensitive drum is charged by a charging means, and a laser beam modulated with image data of a target image is projected from an optical means onto the charged peripheral surface of the photosensitive drum, forming thereon a latent image in accordance with the image data. This latent image is developed into a toner image by a developing means. Meanwhile, a recording medium 2 placed in a sheet feeding cassette 3*a* is reversed and conveyed by pickup roller 3*b*, a conveyer roller pairs 3*c* and 3*d*, and register roller pair 3*e*, in synchronism with the toner formation. Then, a voltage is applied to an image transferring roller 4 as a means for transferring the toner image formed on the photosensitive drum 7 of the process cartridge B, whereby the toner image is transferred onto the recording medium 2. Thereafter, the recording medium 2, onto which the toner image has been transferred, is conveyed to a fixing means 5 by a guiding conveyer 3*f*. The fixing means 5 has a driving roller 5*c*, and a fixing roller 5*b* containing a heater 5*a*, and applies heat and pressure to the recording medium 2 as the recording medium 2 is passed through the fixing means 5, so that the image having been transferred onto the recording medium 2 is fixed to the recording medium 2. Then, the recording medium 2 is conveyed farther, and is discharged into a delivery tray 6 through a reversing path 3*j*, by discharging roller pairs 3*g*, 3*h* and 3*i*. The delivery tray 6 is located at the top of the main assembly 14 of the image forming apparatus A. It should be noted here that a pivotable flapper 3*k* may be operated in coordination with a discharge roller pair 3*m* to discharge the recording medium 2 without passing it through the reversing path 3*j*. The pickup roller 3*b*, conveyer roller pairs 3*c* and 3*d*, register roller pair 3*e*, guiding conveyer 3*f*, discharge roller pairs 3*g*, 3*h* and 3*i*, and discharge roller pair 3*m* constitute a conveying means 3.

Referring to FIGS. 3–8, in the process cartridge B, on the other hand, the photosensitive drum 7 with a photosensitive layer 7*e* (FIG. 11) is rotated to uniformly charge its surface by applying a voltage to the charging roller 8 as a photosensitive drum charging means. Then, a laser beam modulated with the image data is projected onto the photosensitive drum 7 from the optical system 1 through an exposure opening 1*e*, forming a latent image on the photosensitive drum 7. The optical system 1 comprises a laser diode 1*a*, a polygon mirror 1*b*, a lens 1*c*, and a deflective mirror 1*d*. The thus formed latent image is developed with the use of toner and the developing means 9. More specifically, the charging roller 8 is disposed in contact with the photosensitive drum 7 to charge the photosensitive drum 7. It is rotated by the rotation of the photosensitive drum 7. The developing means 9 provides the peripheral surface area (area to be developed) of the photosensitive drum 7 with toner so that the latent image formed on the photosensitive drum 7 is developed.

In the developing means 9, the toner contained in a toner container 11A is delivered to a developing roller 9*c* by the rotation of a toner feeding member 9*b*. The developing roller 9*c* contains a stationary magnet. It is also rotated so that a layer of toner with a triboelectric charge is formed on the peripheral surface of the developing roller 9*c*. The image developing area of the photosensitive drum 7 is provided with the toner from this toner layer, the toner being transferred onto the peripheral surface of the photosensitive drum 7 in a manner to reflect the latent image, visualizing the latent image as a toner image. A developing blade 9*d* is a blade which regulates the amount of the toner adhered to the peripheral surface of the developing roller 9*c* and also triboelectrically charges the toner. Adjacent to the developing roller 9*c,* a toner stirring member 9*e* is rotatively disposed to circulatively stir the toner within the image developing chamber.

After the toner image formed on the photosensitive drum 7 is transferred onto the recording medium 2 by applying a voltage with a polarity opposite to that of the toner image to the image transferring roller 4, the residual toner on the photosensitive drum 7 is removed by the cleaning means 10. The cleaning means 10 comprises an elastic cleaning blade 10*a* disposed in contact with the photosensitive drum 7, and the toner remaining on the photosensitive drum 7 is scraped off by the elastic cleaning blade 10*a,* and collected into a waste toner collector 10*b*.

The process cartridge B is formed in the following manner. First, a toner chamber frame 11, which comprises a toner container (toner storing portion) 11A for storing toner, is joined with an image developing chamber frame 12 which houses the image developing means 9 such as an image developing roller 9*c,* and then, a cleaning chamber frame 13, in which the photosensitive drum 7, the cleaning means 10 such as the cleaning blade 10*a,* and the charging roller 8 are mounted, is joined with the preceding two frames 11 and 12 to complete the process cartridge B. The thus formed process cartridge B is removably installable into the main assembly 14 of the image forming apparatus A.

The process cartridge B is provided with an exposure opening through which a light beam modulated with image data is projected onto the photosensitive drum 7, and a transfer opening 13*n,* through which the photosensitive drum 7 opposes the recording medium 2. The exposure opening 1*e* is a part of the cleaning chamber frame 11, and the transfer opening 13*n* is located between the image developing chamber frame 12 and the cleaning chamber frame 13.

Next, the structure of the housing of the process cartridge B in this embodiment will be described.

The process cartridge in this embodiment is formed in the following manner. First, the toner chamber frame 11 and the image developing chamber frame 12 are joined, and then, the cleaning chamber frame 13 is rotatively joined with the preceding two frames 11 and 12 to complete the housing. In this housing, the aforementioned photosensitive drum 7, charging roller 8, developing means 9, cleaning means 10, and the like, are mounted to complete the process cartridge B. The thus formed process cartridge B is removably installable into the cartridge accommodating means provided in the main assembly 14 of an image forming apparatus.

(Housing Structure of Process Cartridge B)

As described above, the housing of the process cartridge B in this embodiment is formed by joining the toner chamber frame 11, the image developing chamber frame 12, and the cleaning chamber frame 13. Next, the structure of the thus formed housing will be described.

Figure 13:
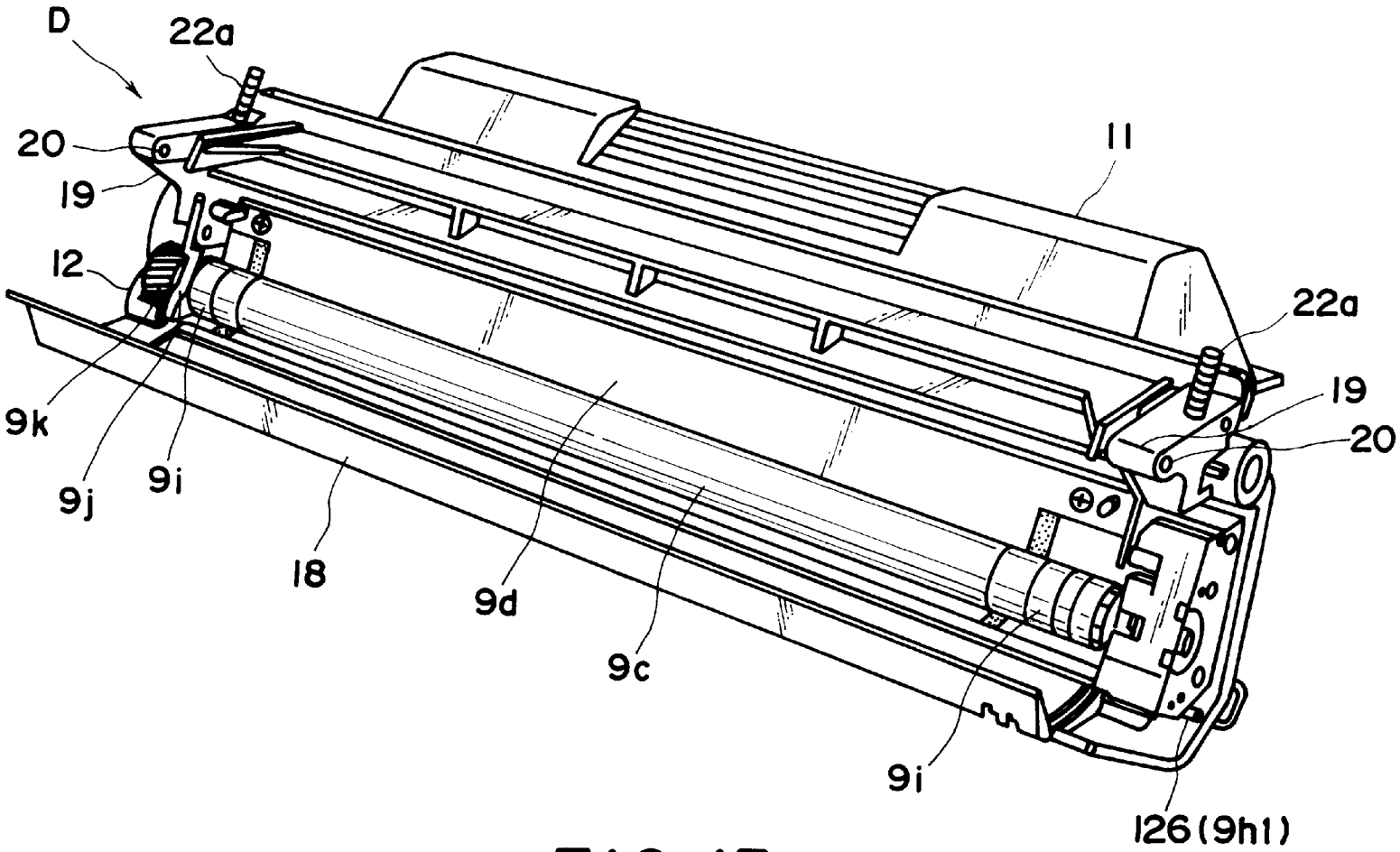
FIG. 13 is a perspective view of an image developing unit.
Figure 19:
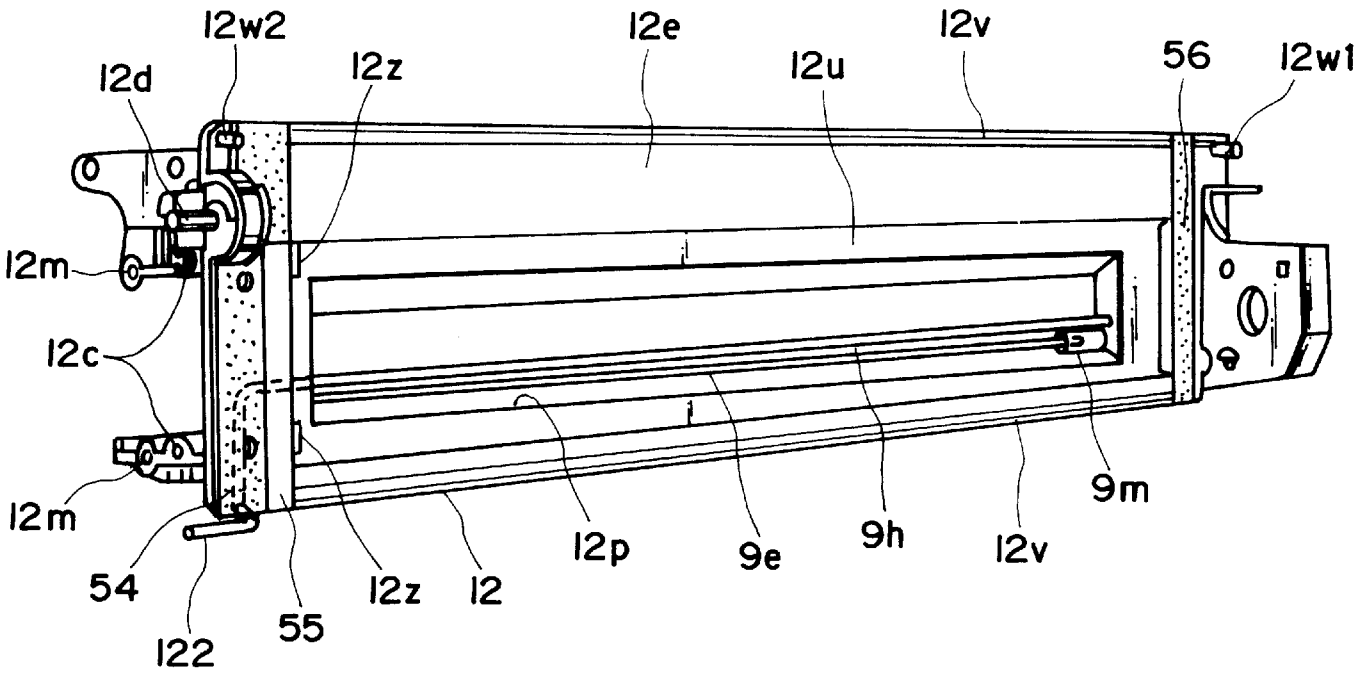
FIG. 19 is a perspective view of the image developing chamber frame.
Figure 20:
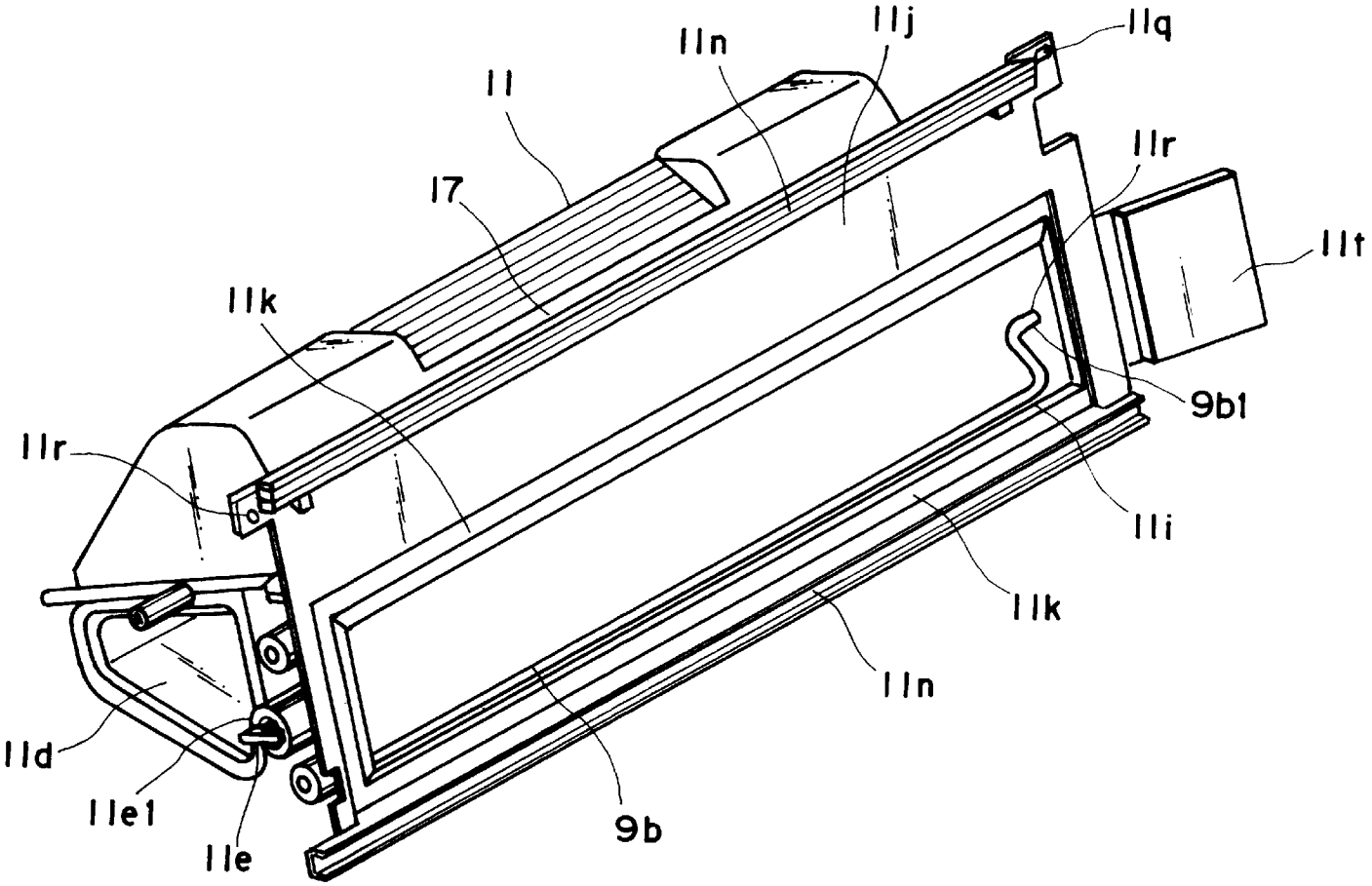
FIG. 20 is a perspective view of the toner chamber frame.

Referring to FIGS. 3 and 20, in the toner chamber frame 11, the toner feeding member 9*b* is rotatively mounted. In the image developing chamber frame 12, the image developing roller 9*c* and the developing blade 9*d* are mounted, and adjacent to the developing roller 9*c,* the stirring member 9*e* is rotatively mounted to circulatively stir the toner within the image developing chamber. Referring to FIGS. 3 and 19, in the image developing chamber frame 12, a rod antenna 9*h* is mounted, extending in the lengthwise direction of the developing roller 9*c* substantially parallel to the developing roller 9*c*. The toner chamber frame 11 and the development chamber frame 12, which are equipped in the above-described manner, are welded together (in this embodiment, by ultrasonic waves) to form a second frame which constitutes an image developing unit D (FIG. 13).

The image developing unit of the process cartridge B is provided with a drum shutter assembly 18, which covers the photosensitive drum 7 to prevent it from being exposed to light for an extend period of time or from coming in contact with foreign objects when or after the process cartridge B is removed from the main assembly 14 of an image forming apparatus.

Referring to FIG. 6, the drum shutter assembly 18 has a shutter cover 18*a* which covers or exposes the transfer opening 13*n* illustrated in FIG. 3, and linking members 18*b* and 18*c* which support the shutter cover 18*a*. On the upstream side relative to the direction in which the recording medium 2 is conveyed, one end of the right-hand side linking member 18*c* is fitted in a hole 40*g* of a developing means gear holder 40, as shown in FIGS. 4 and 5, and one end of the left-hand side linking member 18*c* is fitted in a boss 11*h* of the bottom portion 11*b* of the toner chamber frame 11. The other ends of the left- and right-hand linking members 18*c* are attached to the corresponding lengthwise ends of the shutter cover 18*a,* on the upstream side relative to the recording medium conveying direction. The linking member 18*c* is made of a metallic rod. Actually, the left- and right-hand linking members 18*c* are connected through the shutter cover 18*a;* in other words, the left- and right-hand linking members 18*c* are the left- and right-hand ends of a single piece linking member 18*c*. The linking member 18*b* is provided only on one lengthwise end of the shutter cover 18*a*. One end of the linking member 18*b* is attached to the shutter cover 18*a,* on the downstream side, relative to the recording medium conveying direction, of the position at which the linking member 18*c* is attached to the shutter cover 18*a,* and the other end of the linking member 18*b* is fitted around a dowel 12*d* of the image development chamber frame 12. The linking member 18*b* is formed of a synthetic resin.

The linking members 18*b* and 18*c,* which are different in length, form a four piece linkage structure in conjunction with the shutter cover 18*a* and the toner chamber frame 11. As the process cartridge B is inserted into an image forming apparatus, a portion 18*c*1 of the linking member 18*c,* which projects away from the process cartridge B, comes in contact with a stationary contact member (unillustrated) provided on the lateral wall of the cartridge accommodating space S of the mains assembly 14 of the image forming apparatus, and activates the drum shutter assembly 18 to open the shutter cover 18*a*.

The drum shutter assembly 18, constituted of the shutter cover 18*a* and the linking members 18*b* and 18*c,* is loaded with the pressure from an unillustrated torsional coil spring fitted around a dowel 12*d*. One end of the spring is anchored to the linking member 18*b,* and the other end is anchored to the image developing chamber frame 12, so that the pressure is generated in the direction to cause the shutter cover 18*a* to cover the transfer opening 13*n*.

Referring again to FIGS. 3 and 12, the cleaning means frame 13 is fitted with the photosensitive drum 7, the charging roller 8, and the various components of the cleaning means 10, to form a first frame as a cleaning unit C (FIG. 12).

Figure 12:
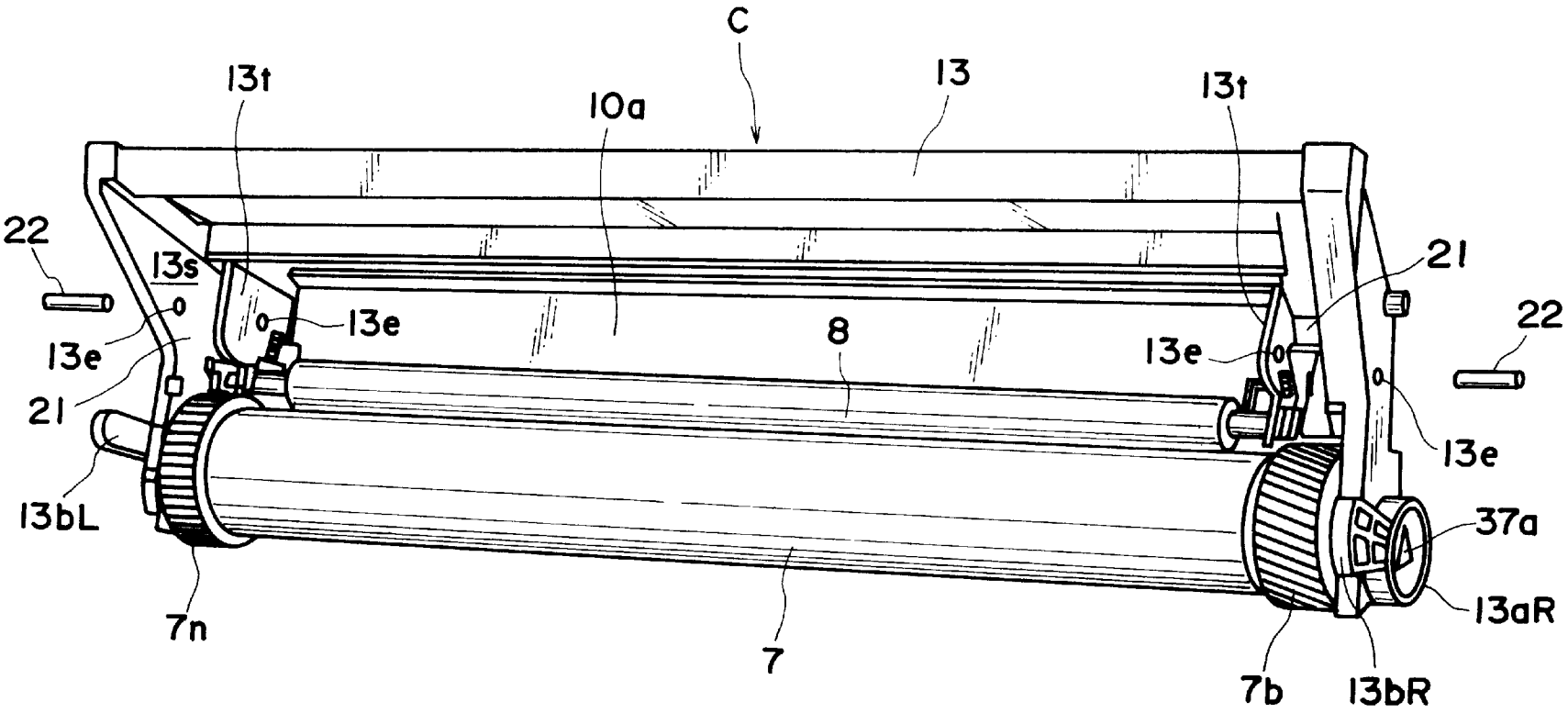
FIG. 12 is a perspective view of a cleaning unit.

Then, the aforementioned image developing unit D and cleaning unit C are joined by a joining member 22, in a mutually pivotable manner, to complete the process cartridge B. More specifically, referring to FIG. 13, both lengthwise (axial direction of the developing roller 9*c*) ends of the image developing chamber frame 12 are provided with an arm portion 19, which is provided with a round hole 20 which is parallel to the developing roller 9*c*. On the other hand, a recessed portion 21 for accommodating the arm portion 19 is provided at each lengthwise end of the cleaning chamber frame (FIG. 12). The arm portion 19 is inserted in this recessed portion 21, and the joining member 22 is pressed into the mounting hole 13*e* of the cleaning chamber frame 13, put through the hole 20 of the end portion of the arm portion 19, and pressed, farther, into the hole 13*e* of a partitioning wall 13*t*, so that the image developing unit D and the cleaning unit C are joined to be pivotable relative to each other about the joining member 22. In joining the image developing unit D and the cleaning unit C, a comrpression type coil spring 22*a* is placed between the two units, with one end of the coil spring 22*a* being fitted around an unillustrated dowel erected from the base portion of the arm portion 19, and the other end being pressed against the top wall of the recessed portion 21 of the cleaning chamber frame 13. As a result, the image developing chamber frame 12 is pressed downward to reliably keep the developing roller 9*c* pressed downward toward the photosensitive drum 7. More specifically, referring to FIG. 13, a roller 9*i* having a diameter larger than that of the developing roller 9*c* is attached to each lengthwise end of the developing roller 9*c*, and this roller 9*i* is pressed on the photosensitive drum 7 to maintain a predetermined gap (approximately 300 μm) between the photosensitive drum 7 and the developing roller 9*c*. The top surface of the recessed portion 21 of the cleaning chamber frame 13 is slanted so that the compression type coil spring 22*a* is gradually compressed when the image developing unit D and the cleaning unit C are united. That is, the image developing unit D and the cleaning unit C are pivotable toward each other about the joining member 22, wherein the positional relationship (gap) between the peripheral surface of the photosensitive drum 7 and the peripheral surface of the developing roller 9*c* is precisely maintained by the elastic force of the compression type coil spring 22*a*.

Since the compression type coil spring 22*a* is attached to the base portion of the arm portion 19 of the image developing chamber frame 12, the elastic force of the compression type coil spring 22*a* affects nowhere but the base portion of the arm portion 19. In a case in which the image developing chamber frame 12 is provided with a dedicated spring mount for the compression type coil spring 22*a*, the adjacencies of the spring seat must be reinforced to precisely maintain the predetermined gap between the photosensitive drum 7 and the developing roller 9*c*. However, with the placement of the compression type coil spring 22*a* in the above described manner, it is unnecessary to reinforce the adjacencies of the spring seat, that is, the adjacencies of the base portion of the arm portion 19 in the case of this embodiment, because the base portion of the arm portion 19 is inherently greater in strength and rigidity.

The above described structure which holds together the cleaning chamber frame 13 and the image developing chamber frame 12 will be described later in more detail.

(Structure of Process Cartridge B Guiding Means)

Figure 9:
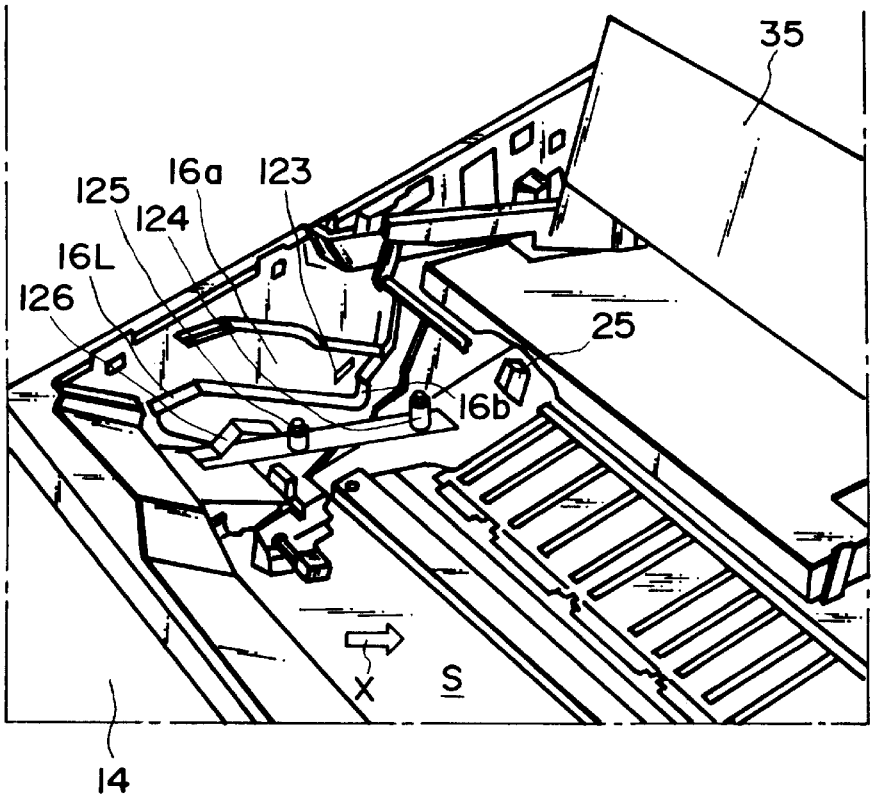
FIG. 9 is an external perspective view of the process cartridge accommodating portion of the main assembly of the apparatus illustrated in FIG. 1.
Figure 10:
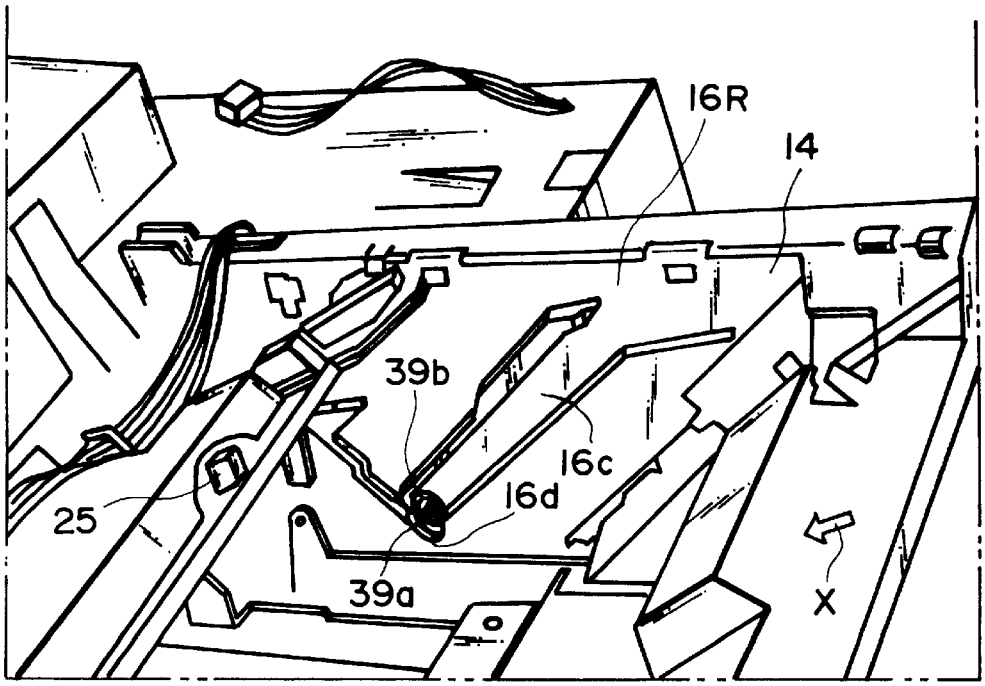
FIG. 10 is an external perspective view of the process cartridge accommodating portion of the main assembly of the apparatus illustrated in FIG. 1.

Next, the means for guiding the process cartridge B when the process cartridge B is installed into, or removed from, the main assembly 14 of an image forming apparatus is illustrated in FIGS. 9 and 10. FIG. 9 is a perspective view of the left-hand side of the guiding means, as seen (in the direction of arrow X) from the side from which the process cartridge B is installed into the main assembly 14 of the image forming apparatus A (as seen from the side of the image developing unit D). FIG. 10 is a perspective view of the right-hand side of the same, as seen from the same side.

Referring to FIGS. 4, 5, 6 and 7, each lengthwise end of the cleaning frame portion 13 is provided with means which serves as a guide when the process cartridge B is installed into, or removed from, the apparatus main assembly 14. This guiding means is constituted of cylindrical guides 13*a*R and 13*a*L as a cartridge positioning guiding member, and rotation controlling guides 13*b*R and 13*b*L as means for controlling the attitude of the process cartridge B when the process cartridge B is installed or removed.

As illustrated in FIG. 5, the cylindrical guide 13*a*R is a hollow cylindrical member. The rotation controlling guide 13*b*R is integrally formed together with the cylindrical guide 13*a*R, and radially protrudes from the peripheral surface of the cylindrical guide 13*a*R. The cylindrical guide 13*a*R is provided with a mounting flange 13*a*R1 which is also integral with the cylindrical guide 13*a*R. Thus, the cylindrical guide 13*a*R, the rotation controlling guide 13*b*R, and the mounting flange 13*a*R1 constitute the right-hand side guiding member 13R, which is fixed to the cleaning chamber frame 13 with small screws 13*a*R2 put through the screw holes of the mounting flange 13*a*R1. With the right-hand side guiding member 13R being fixed to the cleaning chamber frame 13, the rotation controlling guide 13*b*R extends over the lateral wall of the developing means gear holder 40 fixed to the image developing chamber frame 12.

Figure 11:
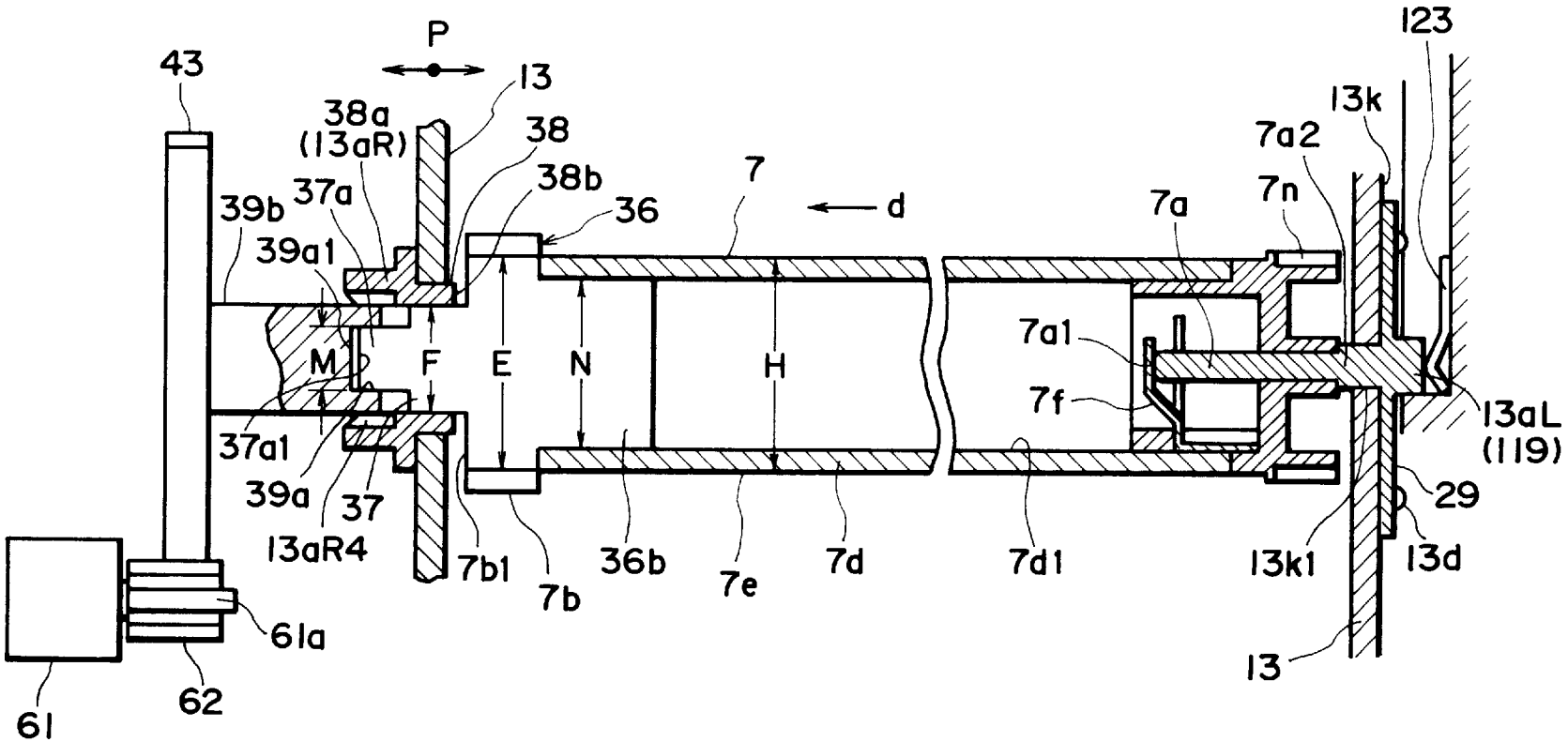
FIG. 11 is a vertical section of a photosensitive drum and a driving mechanism for driving the photosensitive drum.

Referring to FIG. 11, a drum shaft member of photosensitive drum 7 is constituted of a drum shaft portion 7*a* inclusive of a larger diameter portion 7*a*2, a disk-shaped flange portion 29 and a cylindrical guide portion 13*a*L. The larger diameter portion 7*a*2 is fitted in the hole 13*k*1 of the cleaning frame portion 13. The flange portion 29 is engaged with a positioning pin 13*c* projecting from the side wall of the lengthwise and wall of the cleaning frame portion 13, being prevented from rotating, and is fixed to the cleaning frame portion 13 with the use of small screws 13*d*. The cylindrical guide 13*a*L projects outward (toward the front, that is, the direction perpendicular to the page of FIG. 6). The aforementioned stationary drum shaft 7*a* which rotatively supports a spur gear 7*n* fitted around the photosensitive drum 7 projects inwardly from the flange 29 (FIG. 11). The cylindrical guide 13*a*L and the drum shaft 7*a* are coaxial. The flange 29, the cylindrical guide 13*a*L, and the drum shaft 7*a*, are integrally formed of a metallic material such as steel.

Referring to FIG. 6, there is a rotation controlling guide 13*b*L slightly away from the cylindrical guide 13*a*L. It is long and narrow, extending substantially in the radial direction of the cylindrical guide 13*a*L and also projecting outward from the cleaning chamber frame 13. It is integrally formed with the cleaning chamber frame 13. In order to accommodate this rotation controlling guide 13*b*L, the flange 29 is provided with a cutaway portion. The distance the rotation controlling guide 13*b*L projects outward is such that its end surface is substantially even with the end surface of the cylindrical guide 13*a*L. The rotation controlling guide 13*b*L extends over the side wall of the developing roller bearing box 9*v* fixed to the image developing chamber frame 12. As is evident from the above description, the left-hand side guiding member 13L is constituted of two separate pieces: the metallic cylindrical guide 13*a*L and the rotation controlling guide 13*b*L of synthetic resin.

Next, a regulatory contact portion 13*j*, which is a part of the top surface of the cleaning chamber frame 13, will be described. In the following description of the regulatory contact portion 13*j*, the "top surface" means the surface which faces upward when the process cartridge B is in the main assembly 14 of an image forming apparatus.

Referring to FIGS. 4–7, two portions 13*j* of the top surface 13*i* of the cleaning unit C, which are the portions right next to the right and left front corners 13*p* and 13*q*, relative to the direction perpendicular to the direction in which the process cartridge B is inserted, constitute the regulatory contact portions 13*j*, which regulate the position and attitude of the process cartridge B when the cartridge B is installed into the main assembly 14. In other words, when the process cartridge B is installed into the main assembly 14, the regulatory contact portion 13*j* comes in contact with the fixed contact member 25 provided in the main assembly 14 of an image forming apparatus (FIGS. 9, 10 and 30), and regulates the rotation of the process cartridge B about the cylindrical guides 13*a*R and 13*a*L.

Next, the guiding means on the main assembly side 14 will be described. Referring to FIG. 1, as the lid 35 of the main assembly 14 of an image forming apparatus is pivotally opened about a supporting point 35*a* in the counterclockwise direction, the top portion of the main assembly 14 is exposed, and the process cartridge accommodating portion appears as illustrated in FIGS. 9 and 10. The left and right internal walls of the image forming apparatus main assembly 14, relative to the direction in which the process cartridge B is inserted, are provided with guide members 16L (FIG. 9) and 16R (FIG. 10), respectively, which extend diagonally downward from the side opposite to the supporting point 35*a*.

As shown in the drawings, the guide members 16L and 16R comprise guide portions 16*a* and 16*c*, and positioning grooves 16*b* and 16*d* connected to the guide portions 16*a* and 16*c*, respectively. The guide portions 16*a* and 16*c* extend diagonally downward, as seen from the direction indicated by an arrow mark X, that is, the direction in which the process cartridge B is inserted. The positioning grooves 16*b* and 16*d* have a semicircular crosssection which perfectly matches the crosssection of the cylindrical guides 13*a*L or 13*a*R of the process cartridge B. After the process cartridge B is completely installed in the apparatus main assembly 14, the centers of the semicircular crosssections of the positioning groove 16*b* and 16*d* coincide with the axial lines of the cylindrical guides 13*a*L and 13*a*R, respectively, of the process cartridge B, and hence, with the axial line of the photosensitive drum 7.

The width of the guide portions 16*a* and 16*c* as seen from the direction in which the process cartridge B is installed or removed is wide enough to allow the cylindrical guides 13*a*L and 13*a*R to ride on them with a reasonable amount of play. Therefore, the rotation controlling guides 13*b*L and 13*b*R which are narrower than the diameter of the cylindrical guides 13*a*L and 13*a*R naturally fit more loosely in the guide portions 16*a* and 16*c* than the cylindrical guides 13*a*L and 13*a*R, respectively, yet their rotation is controlled by the guide portions 16*a* and 16*c*. In other words, when the process cartridge B is installed, the angle of the process cartridge B is kept within a predetermined range. After the process cartridge B is installed in the image forming apparatus main assembly 14, the cylindrical guides 13*a*L and 13*a*R of the process cartridge B are in engagement with the positioning grooves 16*b* and 16*d* of the guiding members 13L and 13R, and the left and right regulatory contact portions 13*j* located at the front portion, relative to the cartridge inserting direction, of the cleaning chamber frame 13 of the process cartridge B, are in contact with the fixed positioning members 25, respectively.

The weight distribution of the process cartridge B is such that when the line which coincides with the axial lines of the cylindrical guide 13*a*L and 13*a*R is level, the image developing unit D side of the process cartridge B generates a larger moment about this line than the cleaning unit C side.

The process cartridge B is installed into the image forming apparatus main assembly 14 in the following manner. First, the cylindrical guides 13*a*L and 13*a*R of the process cartridge B are inserted into the guide portions 16*a* and 16*c*, respectively, of the cartridge accommodating portion in the image forming apparatus main assembly 14 by grasping the recessed portion 17 and ribbed portion 11*c* of the process cartridge B with one hand, and the rotation controlling guides 13*b*L and 13*b*R are also inserted into the guide portions 16*a* and 16*c*, tilting downward the front portion, relative to the inserting direction, of the process cartridge B. Then, the process cartridge B is inserted farther with the cylindrical guides 13*a*L and 13*a*R and the rotation controlling guides 13*b*L and 13*b*R of the process cartridge B following the guide portions 16*a* and 16*c*, respectively, until the cylindrical guides 13*a*L and 13*a*R reach the positioning grooves 16*b* and 16*d* of the image forming apparatus main assembly 14. Then, the cylindrical guides 13*a*L and 13*a*R become seated in the positioning grooves 16*b* and 16*d*, respectively, due to the weight of the process cartridge B itself; the cylindrical guides 13*a*L and 13*a*R of the process cartridge B are accurately positioned relative to the positioning grooves 16*b* and 16*d*. In this condition, the line which coincides with the axial lines of the cylindrical guides 13*a*L and 13*a*R also coincides with the axial line of the photosensitive drum 7, and therefore, the photosensitive drum 7 is reasonably accurately positioned relative to the image forming apparatus main assembly 14. It should be noted here that the final positioning of the photosensitive drum 7 relative to the image forming apparatus main assembly 14 occurs at the same time as the coupling between the two is completed.

Also, in this condition, there is a slight gap between the stationary positioning member 25 of the image forming apparatus main assembly 14 and the regulatory contact portion 13*j* of the process cartridge B. At this point of time, the process cartridge B is released from the hand. Then, the process cartridge B rotates about the cylindrical guides 13*a*L and 13*a*R in the direction to lower the image developing unit D side and raise the cleaning unit C side until the regulatory contact portions 13*j* of the process cartridge B come in contact with the corresponding stationary positioning members 25. As a result, the process cartridge B is accurately positioned relative to the image forming apparatus main assembly 14. Thereafter, the lid 35 is closed by rotating it clockwise about the supporting point 35*a*.

In order to remove the process cartridge B from the apparatus main assembly 14, the above described steps are carried out in reverse. More specifically, first, the lid 35 of the apparatus main assembly 14 is opened, and the process cartridge B is pulled upward by grasping the aforementioned top and bottom ribbed portions 11*c*, that is, the handhold portions, of the process cartridge by hand. Then, the cylindrical guides 13*a*L and 13*a*R of the process cartridge B rotate in the positioning grooves 16*b* and 16*d* of the apparatus main assembly 14. As a result, the regulatory contact portions 13*j* of the process cartridge B separate from the corresponding stationary positioning member 25. Next, the process cartridge B is pulled more. Then, the cylindrical guides 13*a*L and 13*a*R come out of the positioning grooves 16*b* and 16*d*, and move into the guide portions 16*a* and 16*c* of the guiding members 16L and 16R, respectively, fixed to the apparatus main assembly 14. In this condition, the process cartridge B is pulled more. Then, the cylindrical guides 13*a*L and 13*a*R and the rotation controlling guides 13*b*L and 13*b*R of the process cartridge B slide diagonally upward through the guide portions 16*a* and 16*c* of the apparatus main assembly 14, with the angle of the process cartridge B being controlled so that the process cartridge B can be completely moved out of the apparatus main assembly 14 without making contact with the portions other than the guide portions 16*a* and 16*c*.

Referring to FIG. 12, the spur gear 7*n* is fitted around one of the lengthwise ends of the photosensitive drum 7, which is the end opposite to where the helical drum gear 7*b* is fitted. As the process cartridge B is inserted into the apparatus main assembly 14, the spur gear 7*n* meshes with a gear (unillustrated) coaxial with the image transferring roller 4 located in the apparatus main assembly, and transmits from the process cartridge B to the transferring roller 4 the driving force which rotates the transferring roller 4.

(Toner Chamber Frame)

Figure 21:
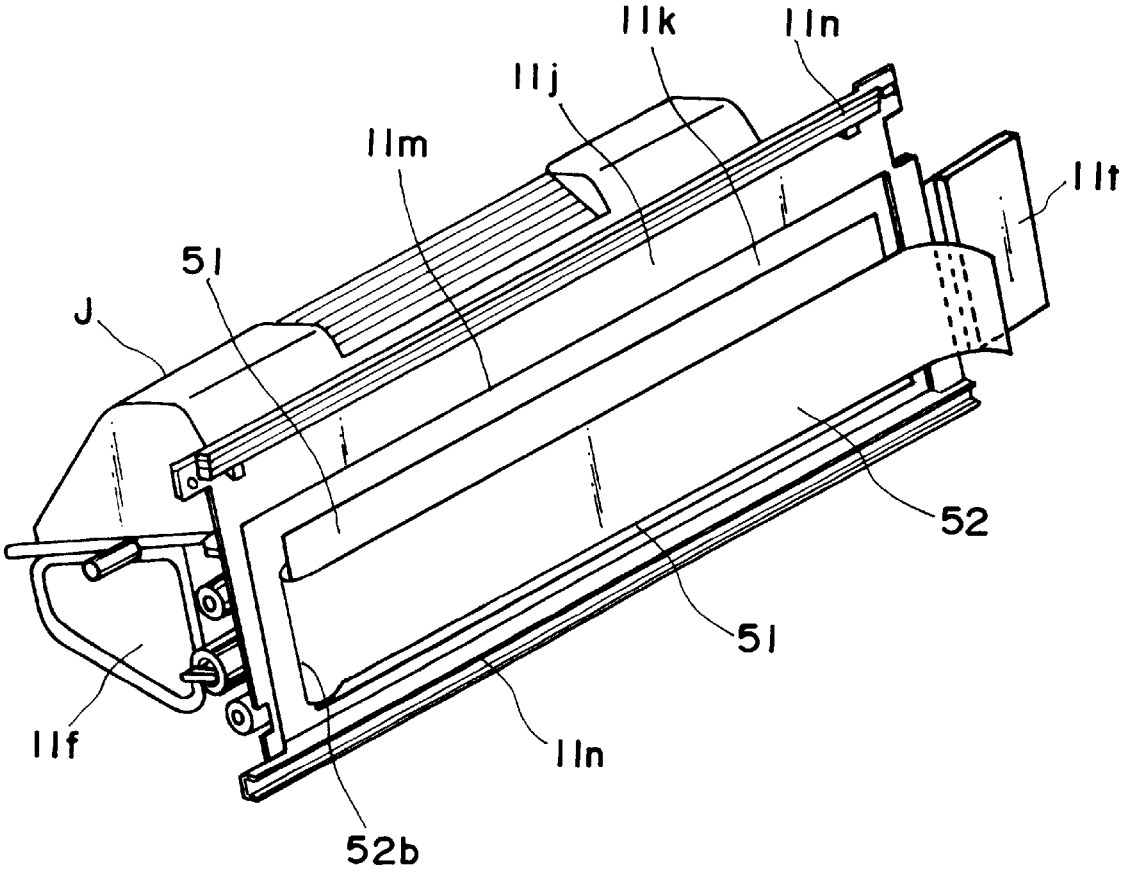
FIG. 21 is a perspective view of the toner chamber frame.

Referring to FIGS. 3, 5, 7, 16, 20 and 21, the toner chamber frame will be described in detail. FIG. 20 is a perspective view of the toner chamber frame as seen before a toner seal is welded on, and FIG. 21 is a perspective view of the toner chamber frame after toner is fitted in.

Referring to FIG. 3, the toner chamber frame 11 is constituted of two portions: the top and bottom portions 11*a* and 11*b*. Referring to FIG. 1, the top portion 11*a* bulges upward, occupying the space on the left-hand side of the optical system 1 in the image forming apparatus main assembly 14, so that the toner capacity of the process cartridge B can be increased without increasing the size of the image forming apparatus A. Referring to FIGS. 3, 4 and 7, the top portion 11*a* of the toner chamber frame 11 has a recessed portion 17, which is located at the lengthwise center portion of the top portion 11*a*, and serves as a handhold. An operator of the image forming apparatus can handle the process cartridge B by grasping it by the recessed portion 17 of the top portion 11*a* and the downward facing side of the bottom portion 11*b*. The ribs 11*c* extending on the downward facing surface of the bottom portion 11*b* in the lengthwise direction of the bottom portion 11*b* serve to prevent the process cartridge B from slipping out of the operator's hand. Referring again to FIG. 3, the flange 11*a*1 of the top portion 11*a* is aligned with the raised-edge flange 11*b*1 of the bottom portion 11*b*, the flange 11*a*1 being fitted within the raised edge of the flange 11*b*1 of the bottom portion 11*b*1, so that the walls of the top and bottom portions of the toner chamber frame 11 perfectly meet at the welding surface U, and then, the top and bottom portions 11*a* and 11*b* of the toner chamber frame 11 are welded together by melting the welding ribs with the application of ultrasonic waves. The method for uniting the top and bottom portions 11*a* and 11*b* of the toner chamber frame 11 does not need to be limited to ultrasonic welding. They may be welded by heat or forced vibration, or may be glued together. Further, the bottom portion 11*b* of the toner chamber frame 11 is provided with a stepped portion 11*m*, in addition to the flange 11*b*1 which keeps the top and bottom portions 11*a* and 11*b* aligned when they are welded together by ultrasonic welding. The stepped portion 11*m* is located above an opening 11*i* and is substantially in the same plane as the flange 11*b*1. The structures of stepped portion 11*m* and its adjacencies will be described later.

Figure 16:
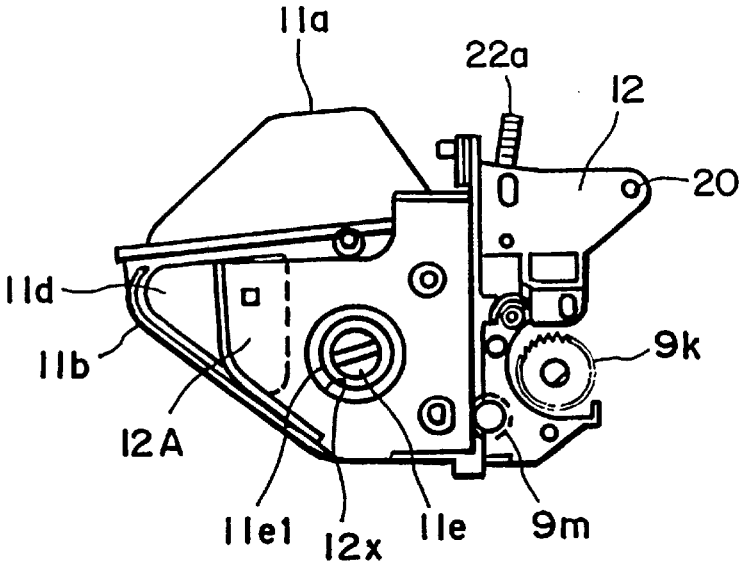
FIG. 16 is a side view of the image developing unit inclusive of the toner chamber frame and the image developing chamber frame.

Before the top and bottom portions 11*a* and 11*b* of the toner chamber frame 11 are united, a toner feeding member 9*b* is assembled into the bottom portion 11, and a coupling member 11*e* is attached to the end of the toner feeding member 9*b* through the hole 11*e*1 of the side wall of the toner chamber frame 11 as shown in FIG. 16. The hole 11*e*1 is located on one of the lengthwise ends of the bottom portion 11*b*, and the side plate which has the hole 11*e*1 is also provided with a toner filling opening 11*d* substantially shaped like a right triangle. The triangular rim of the toner filling opening 11*d* is constituted of a first edge which is one of two edges that are substantially perpendicular to each other, and extends along the joint between the top and bottom portion 11*a* and 11*b* of the toner chamber frame 11, a second edge which vertically extends in the direction substantially perpendicular to the first edge, and a third edge, that is, a diagonal edge, which extends along the slanted edge of the bottom portion 11*b*. In other words, the toner filling opening 11*d* is rendered as large as possible, while being located next to the hole 11*e*1. Next, referring to FIG. 20, the toner chamber frame 11 is provided with an opening 11*i* through which toner is fed from the toner chamber frame 11 into the image developing chamber frame 12, and a seal (which will be described later) is welded to seal this opening 11*i*. Thereafter, toner is filled into the toner chamber frame 11 through the toner filling opening 11*d*, and then, the toner filling opening 11*d* is sealed with a toner sealing cap 11*f* to finish a toner unit J. The toner sealing cap 11*f* is formed of polyethylene, polypropylene, or the like, and is pressed into, or glued to, the toner filling opening 11*d* of the toner chamber frame 11 so that it does not come off. Next, the toner unit J is welded to the image developing chamber frame 12, which will be described later, by ultrasonic welding, to form the image developing unit D. The means for uniting the toner unit J and the image developing unit D is not limited to ultrasonic welding; it may be gluing or snap-fitting which utilizes the elasticity of the materials of the two units.

Referring to FIG. 3, the slanted surface K of the bottom portion 11*b* of the toner chamber frame 11 is given an angle of θ so that the toner in the top portion of the toner chamber frame 11 naturally slides down as the toner at the bottom is consumed. More specifically, it is desirable that the angle θ formed between the slanted surface K of the process cartridge B in the apparatus main assembly 14 and the horizontal line z is approximately 65 deg. when the apparatus main assembly 14 is horizontally placed. The bottom portion 11*b* is given an outwardly bulging portion 11*g* so that it does not interfere with the rotation of the toner feeding member 9*b*. The diameter of the sweeping range of the toner feeding member 9*b* is approximately 37 mm. The height of the bulging portion 11*g* has only to be approximately 0–10 mm from the imaginary extension of the slanted surface K. This is due to the following reason; if the bottom surface of the bulging portion 11*g* is above the imaginary extension of the slanted surface K, the toner which, otherwise, naturally slides down from the top portion of the slanted surface K and is fed into the image developing chamber frame 12, partially fails to be fed into the image developing chamber frame 12, collecting in the area where the slanted surface K and the outwardly bulging portion 11*g* meet. Contrarily, in the case of the toner chamber frame 11 in this embodiment, the toner is reliably fed into the image developing chamber frame 12 from the toner chamber frame 11.

The toner feeding member 9*b* is formed of a steel rod having a diameter of approximately 2 mm, and is in the form of a crank shaft. Referring to FIG. 20 which illustrates one end of the toner feeding member 9*b*, one (9*b*1) of the journals of the toner feeding member 9*b* is fitted in a hole 11*r* which is located in the toner chamber frame 11, adjacent to the opening 11*i* of the toner chamber frame 11. The other of the journals is fixed to the coupling member 11*e* (where the journal is fixed to the coupling member 11*e* is not visible in FIG. 20).

As described above, providing the bottom wall of the toner chamber frame section 11 with the outwardly bulging portion 11*g* as the sweeping space for the toner feeding member 9*b* makes it possible to provide the process cartridge B with stable toner feeding performance without a cost increase.

Figure 22:
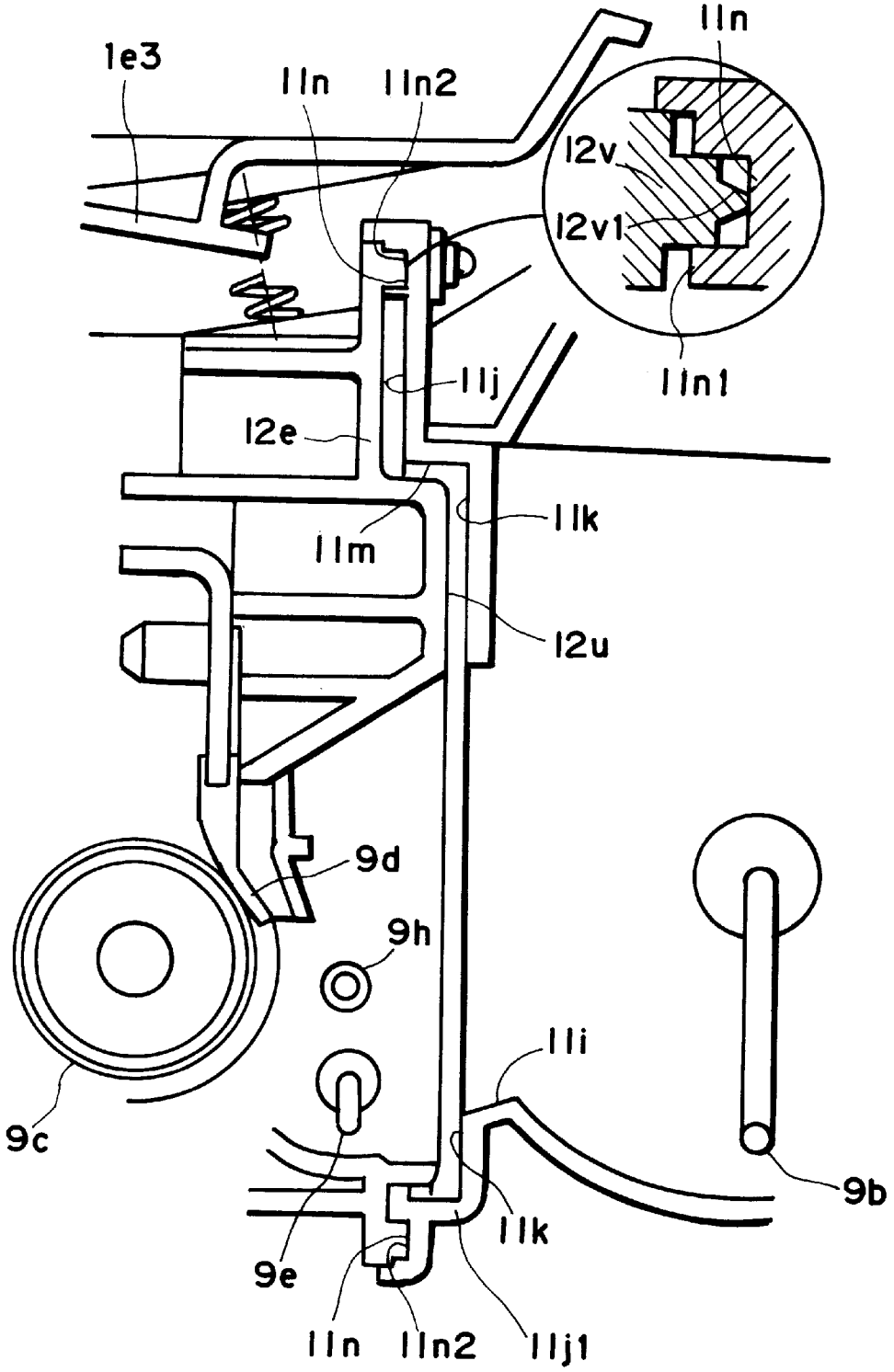
FIG. 22 is a vertical section of the toner sealing portion illustrated in FIG. 21.
Figure 39:
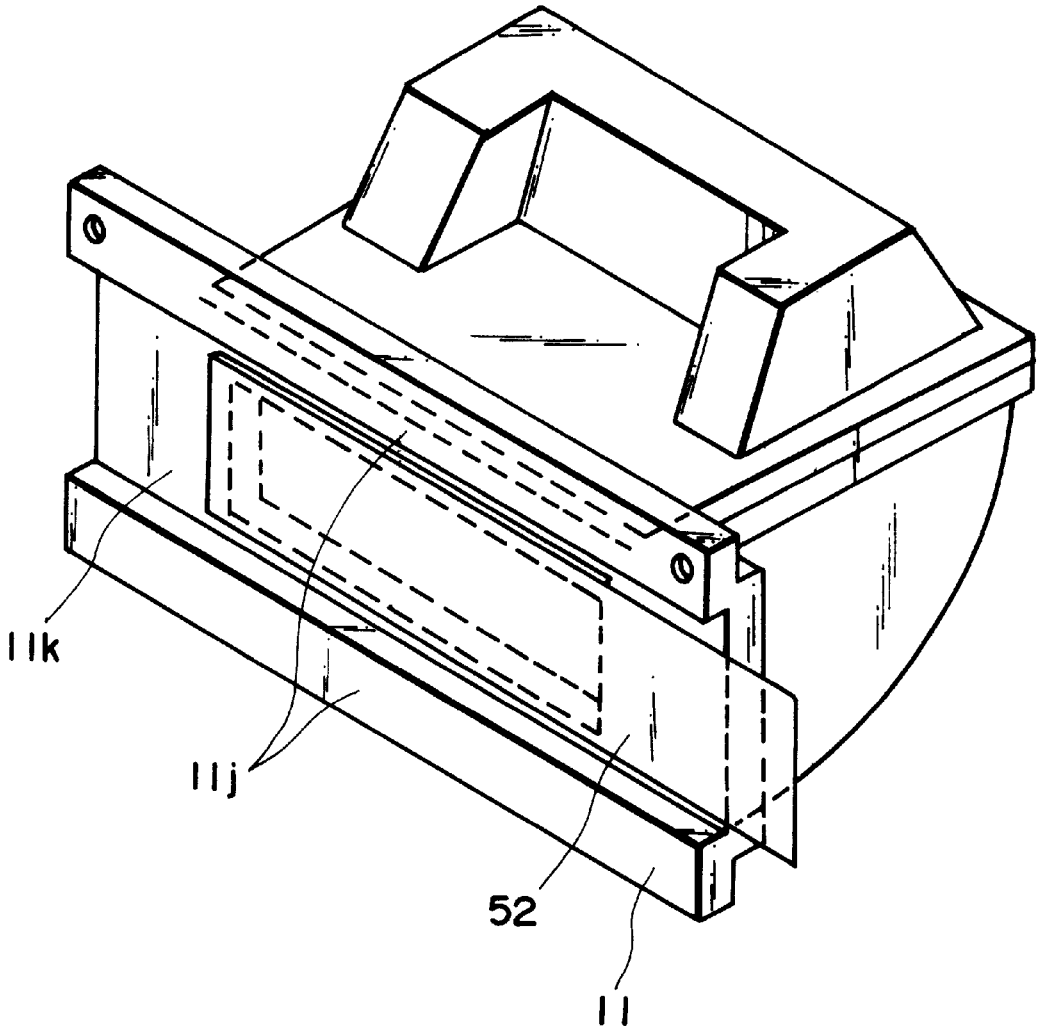
FIG. 39 is a perspective view of the opening and its adjacencies of the toner chamber frame, in one of the embodiments of the present invention.

Referring to FIGS. 3, 20 and 22, the opening 11*i* through which toner is fed from the toner chamber frame section 11 into the development chamber frame section is located at the joint between the toner chamber frame section 11 and the development chamber frame section 12. The opening 11*i* is surrounded by a recessed surface 11*k* which in turn is surrounded by the top and bottom portions 11*j* and 11*j*1 of the flange of the toner chamber frame 11. The lengthwise outer (top) edge of the top portion 11*j* and the lengthwise outer (bottom) edge of the bottom portion 11*j*1 are provided with grooves 11*n*, respectively, which are parallel to each other. The top portion 11*j* of the flange above the recessed surface 11*k* is in the form of a gate, and the surface of the bottom portion 11*j*1 of the flange is perpendicular to the surface of the recessed surface 11*k*. Referring to FIG. 22, the plane of the bottom surface 11*n*2 of the groove 11*n* is on the outward side (toward the image developing chamber frame 12) of the surface of the recessed surface 11*k*. However, the flange of the toner chamber frame 11 may be structured like the flange illustrated in FIG. 39 in which the top and bottom portion 11*j* of the flanges are in the same plane and surround the opening 11*i* like the top and bottom pieces of a picture frame.

Referring to FIG. 19, an alphanumeric reference 12*u* designates one of the flat surfaces of the image developing chamber frame 12, which faces the toner chamber frame 11. The flange 12*e* which is parallel to the flat surface 12*u* and surrounds all four edges of this flat surface 12*u* like a picture frame is provided at a level slightly recessed from the flat surface 12*u*. The lengthwise edges of the flange 12*e* are provided with a tongue 12*v* which fit into the groove 11*n* of the toner chamber frame 11. The top surface of the tongue 12*v* is provided with an angular ridge 12*v*1 (FIG. 22) for ultrasonic welding. After the various components are assembled into the toner chamber frame 11 and image developing chamber frame 12, the tongue of the image developing chamber frame 12 is fitted into the groove 11*n* of the toner chamber frame 11, and the two frames 11 and 12 are welded together along the tongue 12*v* and groove 11*n* (details will be given later).

Referring to FIG. 21, a cover film 51, which can be easily torn in the lengthwise direction of the process cartridge B, is pasted to the recessed surface 11*k* to seal the opening 11*i* of the toner chamber frame 11; it is pasted to the toner chamber frame 11, on the recessed surface 11*k*, alongside the four edges of the opening 11*i*. In order to unseal the opening 11*i* by tearing the cover film 51, the process cartridge B is provided with a tear tape 52, which is welded to the cover film 51. The cover tape 52 is doubled back from the lengthwise end 52*b* of the opening 11*i*, is put through between an elastic sealing member 54 such as a piece of felt (FIG. 19) and the opposing surface of the toner chamber frame 11, at the end opposite to the end 52*b*, and is slightly extended from the process cartridge B. The end portion 52*a* of the slightly sticking out tear tape 52 is adhered to a pull-tab 11*t* which is to be grasped by hand (FIGS. 6, 20 and 21). The pull-tab 11*t* is integrally formed with the toner chamber frame 11, wherein the joint portion between the pull-tab 11*t* and the toner chamber frame 11 is substantially thin so that the pull-tab 11*t* can be easily torn away from the toner chamber frame 11. The surface of the sealing member 54, except for the peripheral areas, is covered with a synthetic resin film tape 55 having a small friction coefficient. The tape 55 is pasted to the sealing member 54. Further, the flat surface 12*e* located at the other of the lengthwise end portions of the toner chamber frame 11, that is, the end portion opposite to the position where the elastic sealing member 54 is located, is covered with the elastic sealing member 56, which is pasted to the flat surface 12*e* (FIG. 19).

The elastic sealing members 54 and 56 are pasted on the flange 12*e*, at the corresponding lengthwise ends, across the entire width of the flange 12*e*. As the toner chamber frame 11 and the image developing chamber frame 12 are joined, the elastic sealing members 54 and 56 exactly cover the corresponding lengthwise end portions of the flange 11*j* surrounding the recessed surface 11*k*, across the entire width of the flange 11*j*, overlapping with the tongue 12*v*.

Further, in order to precisely position the toner chamber frame 11 and the image developing chamber frame 12 relative to each other when they are joined, the flange 11*j* of the toner chamber frame 11 is provided with a round hole 11*r* and a square hole 11*q* which engage with the cylindrical dowel 12*w*1 and square dowel 12*w*2, respectively, of the image developing chamber frame 12. The round hole 11*r* tightly fits with the dowel 12*w*1, whereas the square hole 11*q* loosely fits with the dowel 12*w*2 in terms of the lengthwise direction while tightly fitting therewith in terms of the lengthwise direction.

The toner chamber frame 11 and the image developing chamber frame 12 are independently assembled as a compound component prior to a process in which they are united. Then, they are united in the following manner. First, the cylindrical positioning dowel 12*w*1 and square positioning dowel 12*w*2 of the image developing chamber frame 12 are fitted into the positioning round hole 11*r* and positioning square hole 11*q* of the toner chamber frame 11, and the tongue 12*v* of the image developing chamber frame 12 is placed in the groove 11*n* of the toner chamber frame 11. Then, the toner chamber frame 11 and the image developing chamber frame 12 are pressed toward each other. As a result, the sealing members 54 and 56 come in contact with, being thereby compressed by, the corresponding lengthwise end portions of the flange 11*j*, and at the same time, rib-like projections 12*z*, which are located, as a spacer, at each lengthwise end of the flat surface 12*u* of the image developing chamber frame 12, are positioned close to the flange 11*j* of the toner chamber frame 11. The rib-like projection 12*z* is integrally formed with the image developing chamber frame 12, and is located at both sides, relative to the lengthwise direction, of the tear tape 52, so that the tear tape can be passed between the opposing projections 12*z*.

With the toner chamber frame 11 and the image developing chamber frame 12 being pressed toward each other as described above, ultrasonic vibration is applied between the tongue-like portion 12*v* and the groove 11*n*. As a result, the angular ridge 12*v*1 is melt by frictional heat and fuses with the bottom of the groove 11*n*. Consequently, the rim portion 11*n*1 of the groove 11*n* of the toner chamber frame 11 and the rib-like projections 12*z* of the image developing chamber frame 12 remain airtightly in contact with each other, leaving a space between the recessed surface 11*k* of the toner chamber frame 11 and the flat surface 12*u* of the image developing chamber frame 12. The aforementioned cover film 51 and tear tape 52 fit in this space.

In order to feed the toner stored in the toner chamber frame 11 into the image developing chamber frame 12, the opening 11*i* of the toner chamber frame 11 must be unsealed. This is accomplished in the following manner. First, the pull-tab 11*t* attached to the end portion 52*a* (FIG. 6) of the tear tape 52 extending from the process cartridge B is cut loose, or torn loose, from the toner chamber frame 11, and then, is pulled by the hand of an operator. This will tear the cover film 51 to unseal the opening 11*i,* enabling the toner to be fed from the toner chamber frame 11 into the image developing chamber frame 12. After the cover film 52 is pulled out of the process cartridge B, the lengthwise ends of the cartridge B are kept sealed by the elastic seals 54 and 56 which are located at the corresponding lengthwise ends of the flange 11*j* of the toner chamber frame 11. Since the elastic sealing members 54 and 56 are deformed (compressed) only in the direction of their thickness while maintaining their hexahedral shapes, they can keep the process cartridge sealed very effectively.

Since the side of the toner chamber frame 11, which faces the image developing chamber frame 12, and the side of the image developing chamber frame 12, which faces the toner chamber frame 11, are structured as described above, the tear tape 52 can be smoothly pulled out from between the two frames 11 and 12 by simply applying to the tear tape 52 a force strong enough to tear the cover film 51.

As described above, when the toner chamber frame 11 and the image developing chamber frame 12 are united, a welding method employing ultrasonic waves is employed to generate frictional heat which melts the angular ridge 12*v*1. This frictional heat is liable to cause thermal stress in the toner chamber frame 11 and the image developing chamber frame 12, and these frames may become deformed due to the stress. However, according to this embodiment, the groove 11*n* of the toner chamber frame 11 and the tongue 12*v* of the image developing chamber frame 12 engage with each other across almost the entire length of theirs. In other words, as the two frames 11 and 12 are united, the welded portion and its adjacencies are reinforced, and therefore, the two frames are not likely to be deformed by the thermal stress.

As for the material for the toner chamber frame 11 and the image developing chamber frame 12, plastic material is used; for example, polystyrene, ABS resin (acrylonitrile-butadiene-styrene), polycarbonate, polyethylene, polypropylene, and the like.

Referring to FIG. 3, this drawing is a substantially vertical crosssection of the toner chamber frame 11 of the process cartridge B in this embodiment, and illustrates the interface between the toner chamber frame 11 and the image developing chamber frame 12, and its adjacencies.

At this time, the toner chamber frame 11 of the process cartridge B in this embodiment will be described in more detail with reference to FIG. 3. The toner held in a toner container 11A is a single component toner. In order to allow this toner to efficiently free fall toward the opening 11*i,* the toner chamber frame 11 is provided with slanted surfaces K and L, which extend across the entire length of the toner chamber frame 11. The slanted surface L is above the opening 11*i,* and the slanted surface K is in the rear of the toner chamber frame 11 as seen from the opening 11*i* (in the widthwise direction of the toner chamber frame 11). The slanted surfaces L and K are parts of the top and bottom pieces 11*a* and 11*b,* respectively, of the toner chamber frame 11. After the process cartridge B is installed in the apparatus main assembly 14, the slanted surface L faces diagonally downward, and the slanted surface K faces diagonally upward, an angle θ3 between the slanted surface K and the line m perpendicular to the interface between the toner chamber frame 11 and the image developing chamber frame 12 being approximately 20 deg.–40 deg. In other words, in this embodiment, the configuration of the top portion 11*a* of the toner chamber frame 11 is designed so that the slanted surfaces K and L hold the aforementioned angles, respectively, after the top and bottom portions 11*a* and 11*b* of the toner chamber frame 11 are united. Thus, according to this embodiment, the toner container 11A holding the toner is enabled to efficiently feed the toner toward the opening 11*i.*

Next, the image developing chamber frame will be described in detail.

(Image Developing Chamber Frame)

Figure 14:
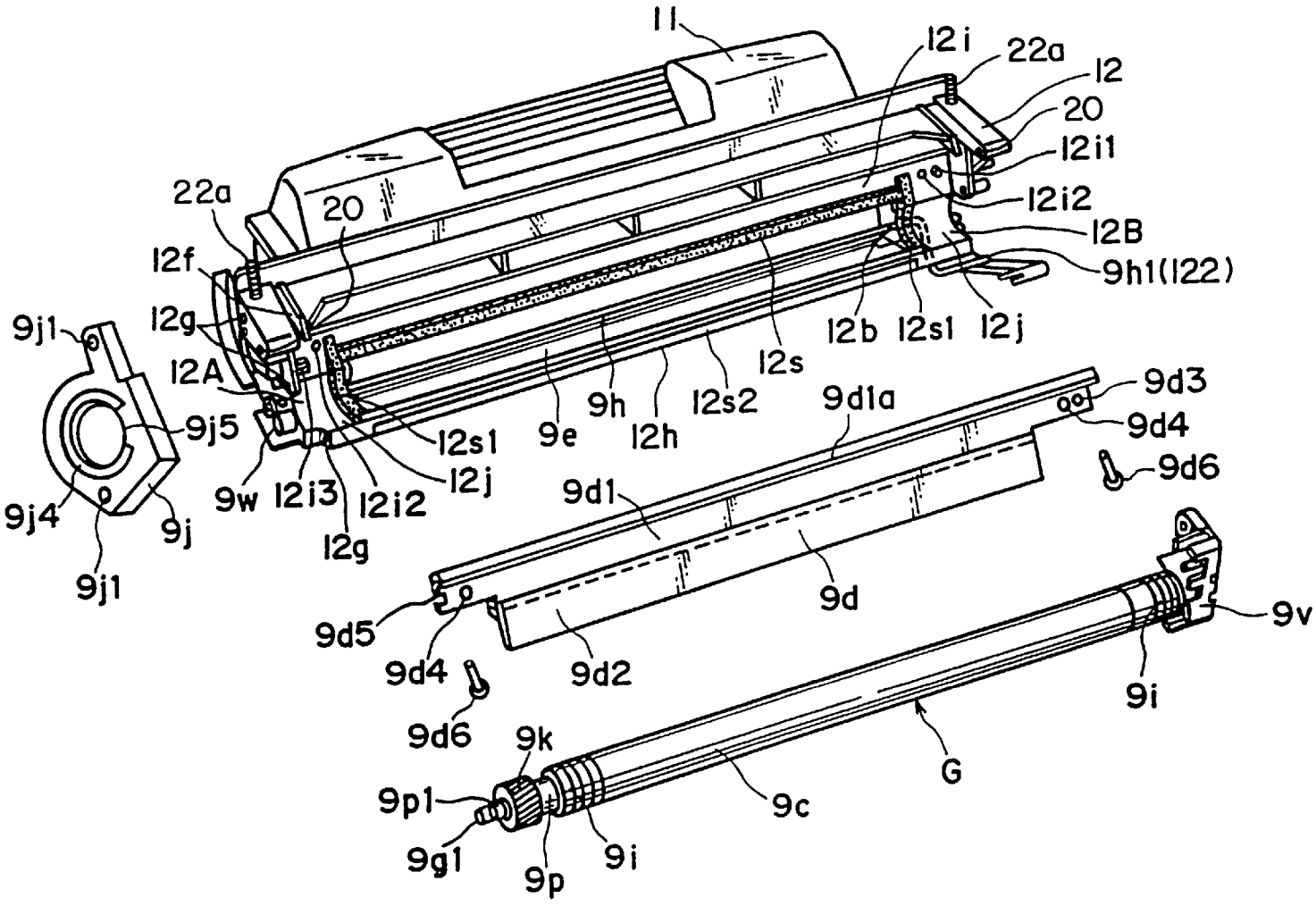
FIG. 14 is a partially exploded perspective view of an image developing unit.
Figure 15:
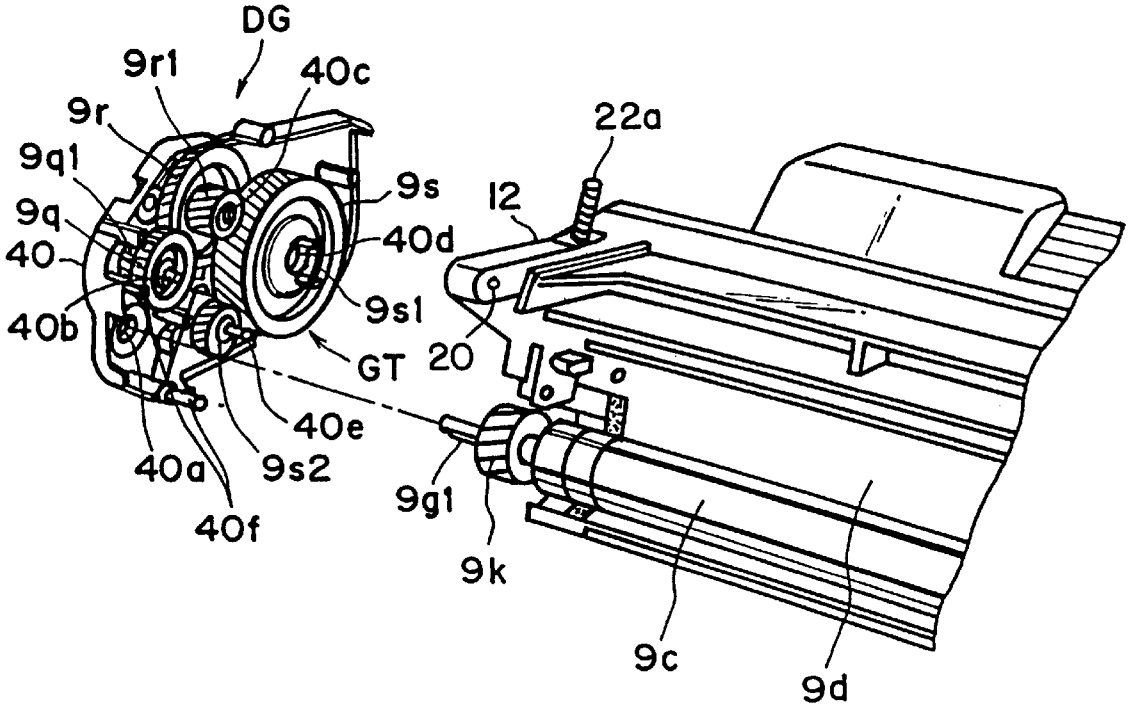
FIG. 15 is a partially exploded perspective view of a gear holding frame portion of the image developing chamber frame, and the gears which drive the image developing unit, depicting the back side of thereof.
Figure 17:
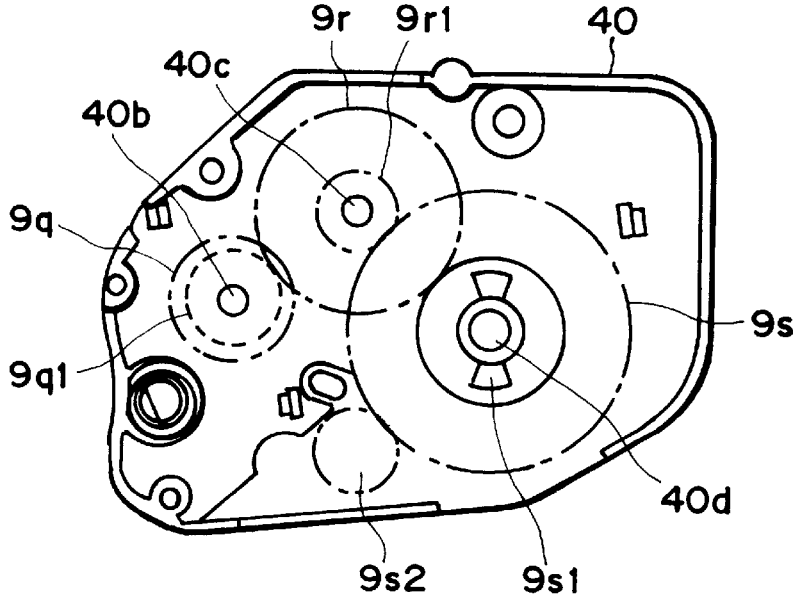
FIG. 17 is a plan view of the gear holding frame portion illustrated in FIG. 15, as seen from the inside of the image developing unit.
Figure 18:
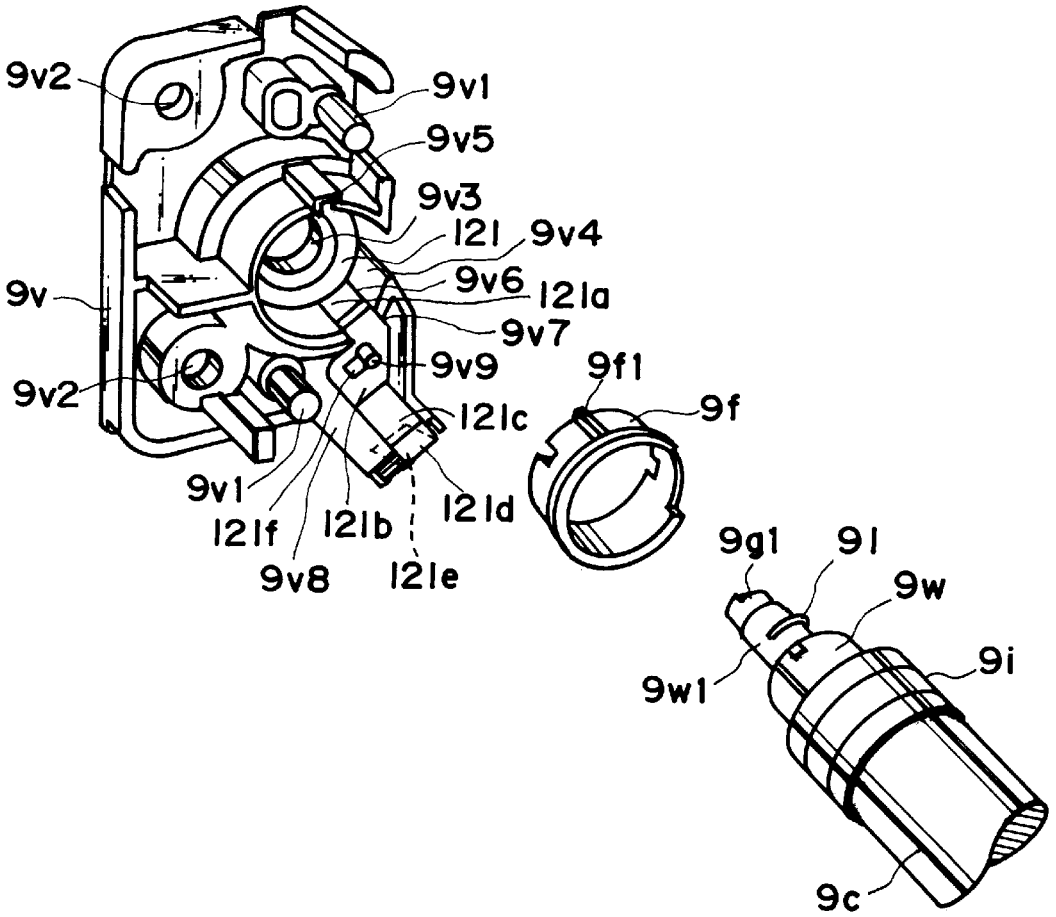
FIG. 18 is a perspective view of an image developing roller bearing box.

The image developing chamber frame 12 of the process cartridge B will be described with reference to FIGS. 3, 14, 15, 16, 17, and 18. FIG. 14 is a perspective view depicting the way various components are assembled into the image developing chamber frame 12; FIG. 15, a perspective view depicting the way a developing station driving force transmitting unit DG is assembled into the image developing chamber frame 12; FIG. 16, a side view of the development unit before the driving force transmitting unit DG is attached; FIG. 17, a side view of the developing station driving force transmitting unit DG as seen from inside the image developing chamber frame 12; and FIG. 18 is a perspective view of the bearing box as seen from inside.

As described before, the developing roller 9*c,* the developing blade 9*d,* the toner stirring member 9*e,* and the rod antenna 9*h* for detecting the toner remainder are assembled into the image developing chamber frame 12.

Referring to FIG. 14, the developing blade 9*d* comprises an approximately 1–2 mm thick metallic plate 9*d*1, and a urethane rubber 9*d*2 glued to the metallic plate 9*d*1 with the use of hot melt glue, double-side adhesive tape, or the like. It regulates the amount of the toner to be carried on the peripheral surface of the developing roller 9*c* as the urethane rubber member 9*d*2 is placed in contact with the generatrix of the developing roller 9*c*. Both of the lengthwise ends of the blade mounting reference flat surface 12*i,* as a blade mount, of the image developing chamber frame 12, are provided with a dowel 12*i*1, a square projection 12*i*3, and a screw hole 12*i*2. The dowel 12*i*1 and the projection 12*i*3 are fitted in a hole 9*d*3 and a notch 9*d*5, respectively, of the metallic plate 9*d*1 Then, a small screw 9*d*6 is put through a screw hole 9*d*4 of the metallic plate 9*d*1, and is screwed into the aforementioned screw hole 12*i*2 with female threads, to fix the metallic plate 9*d*1 to the flat surface 12*i.* In order to prevent toner from leaking out, an elastic sealing member 12*s* formed of MOLTPLANE, or the like, is pasted to the image developing chamber frame 12, along the lengthwise top edge of the metallic plate 9*d*1. Also, an elastic sealing member 12*s*1 is pasted to the toner chamber frame 11, along the edge 12*j* of the curved bottom wall portion which accommodates the developing roller 9*c,* starting from each lengthwise end of the elastic sealing member 12*s*. Further, a thin elastic sealing member 12*s*2 is pasted to the image developing chamber frame 12, along a mandible-like portion 12*h,* in contact with the generatrix of the developing roller 9*c*.

The metallic plate 9*d*1 of the developing blade 9*d* is bent 90 deg. on the side opposite to the urethane rubber member 9*d*2, forming a bent portion 9*d*1*a*.

Next, referring to FIGS. 14 and 18, the image developing roller unit G will be described. The image developing roller unit G comprises: (1) image developing roller 9*c;* (2) spacer roller 9*i* for keeping constant the distance between the peripheral surfaces of the developing roller 9*c* and the photosensitive drum 7, being formed of electrically insulative synthetic resin and doubling as a sleeve cap which covers the developing roller 9*c* at each lengthwise end to prevent electrical leakage between the aluminum cylinder portions of the photosensitive drum 7 and the developing roller 9*c;* (3) developing roller bearing 9*j* (illustrated as an enlargement in FIG. 14); (4) developing roller gear 9*k* (helical gear) which receives a driving force from a helical drum gear 7*b* attached to the photosensitive drum 7 and rotates the developing roller 9*c;* (5) a coil spring type contact 91, one end of which is in contact with one end of the developing roller 9*c* (FIG. 18); and (6) a magnet 9*g* which is contained in the developing roller 9*c* to adhere the toner onto the peripheral surface of the developing roller 9*c*. In FIG. 14, the bearing box 9*v* has been already attached to the developing roller unit G. However, in some cases, the developing roller unit G is first disposed between the side plates 12A and 12B of the image developing chamber frame 12, and then is united with the bearing box 9*v* when the bearing box 9*v* is attached to the image developing chamber frame 12.

Figure 38:
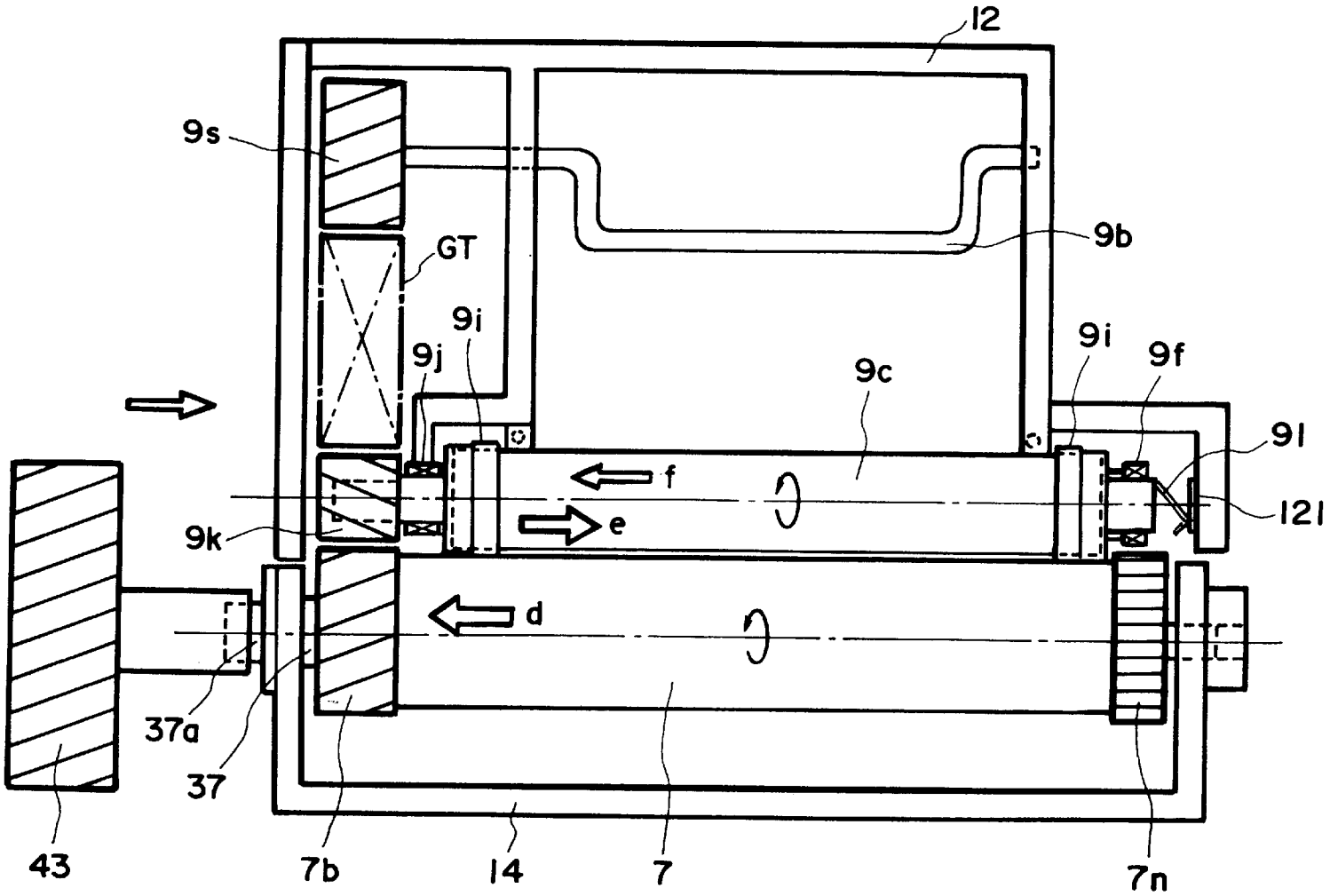
FIG. 38 is a plan view of the process cartridge, depicting the relationship among the various thrusts generated in the cartridge, in terms of direction and magnitude.

Referring again to FIG. 14, in the developing roller unit G, the developing roller 9*c* is rigidly fitted with a metallic flange 9*p* at one lengthwise end. This flange 9*p* has a developing roller gear shaft portion 9*p*1 which extends outward in the lengthwise direction of the developing roller 9*c*. The developing roller gear shaft portion 9*p*1 has a flattened portion, with which the developing roller gear 9*k* mounted on the developing gear shaft portion 9*p*1 is engaged, being prevented from rotating on the developing roller gear shaft portion 9*p*1. The developing roller gear 9*k* is a helical gear, and its teeth are angled so that the thrust generated by the rotation of the helical gear is directed toward the center of the developing roller 9*c* (FIG. 38). One end of the shaft of the magnet 9*g,* which is shaped to give it a D-shaped crosssection, projects outward through the flange 9*p,* and engages with the developing means gear holder 40 to be nonrotatively supported. The aforementioned developing roller bearing 9*j* is provided with a round hole having a rotation preventing projection 9*j*5 which projects into the hole, and in this round hole, the C-shaped bearing 9*j*4 perfectly fits. The flange 9*p* rotatively fits in the bearing 9*j*4. The developing rolller bearing 9*j* is fitted into a slit 12*f* of the image developing chamber frame 12, and is supported there as the developing means gear holder 40 is fixed to the image developing chamber frame 12 by putting the projections 40*g* of the developing means gear holder 40 through the corresponding holes 9*j*1 of the developing roller gear bearing 9*j,* and then inserting them in the corresponding holes 12*g* of the image developing chamber frame 12. The bearing 9*j*4 in this embodiment has a C-shaped flange. However, there will be no problem even if the crosssection of the actual bearing portion of the bearing 9*j*4 is C-shaped. The aforementioned hole of the development roller bearing 9*j,* in which the bearing 9*j*1 fits, has a step. In other words, it consists of a large diameter portion and a small diameter portion, and the rotation preventing projection 9*j*5 projects from the wall of the large diameter portion in which the flange of the bearing 9*j*4 fits. The material for the bearing 9*j,* and the bearing 9*f* which will be described later, is polyacetal, polyamide, or the like.

Although substantially encased in the developing roller 9*c,* the magnet 9*g* extends from the developing roller 9*c* at both lengthwise ends, and is fitted in a D-shaped supporting hole 9*v*3 of the developing roller bearing box 9*v* illustrated in FIG. 18, at the end 9*g*1 having the D-shaped crosssection. In FIG. 18, the D-shaped supporting hole 9*v*3, which is located in the top portion of the developing roller bearing box 9*v,* is not visible. At one end of the developing roller 9*c,* a hollow journal 9*w* formed of electrically insulative material is immovably fitted within the developing roller 9*c,* in contact with the internal peripheral surface. A cylindrical portion 9*w*1 which is integral with the journal 9*w* and has a smaller diameter than the journal 9*w* electrically insulates the magnet 9*g* from a coil spring type contact 91 which is electrically in contact with the developing roller 9*c*. The bearing 9*f* with the aforementioned flange is formed of electrically insulative synthetic resin, and fits in the bearing accommodating hole 9*v*4 which is coaxial with the aforementioned magnet supporting hole 9*v*3. A key portion 9*f*1 integrally formed with the bearing 9*f* fits in a key groove 9*v*5 of the bearing accommodating hole 9*v*4, preventing the bearing 9*f* from rotating.

The bearing accommodating hole 9*v*4 has a bottom, and on this bottom, a doughnut-shaped development bias contact 121 is disposed. As the developing roller 9*c* is assembled into the developing roller bearing box 9*v,* the metallic coil spring type contact 91 comes in contact with this doughnut-shaped development bias contact 121, and is compressed, thereby establishing an electrical connection. The doughnut-shaped development bias contact 121 has a lead which comprises: a first portion 121*a* which perpendicularly extends from the outer periphery of the doughnut-shaped portion, fitting in the recessed portion 9*v*6 of the bearing accommodating hole 9*v*4, and runs along the exterior wall of the bearing 9*f* up to the cutaway portion located at the edge of the bearing accommodating hole 9*v*4; a second portion 121*b* which runs from the cutaway portion, being bent outward at the cutaway portion; a third portion 121*c* which is bent from the second portion 121*b;* a fourth portion 121*d* which is bent from the third portion 121*c* in the outward, or radial, direction of the developing roller 9*c;* and an external contact portion 121*e* which is bent from the fourth portion 121*d* in the same direction. In order to support the development bias contact 121 having the above described shape, the developing roller bearing box 9*v* is provided with a supporting portion 9*v*8, which projects inward in the lengthwise direction of the developing roller 9*c*. The supporting portion 9*v*8 is in contact with the third and fourth portion 121*c* and 121*d,* and the external contact portion 121*e,* of the lead of the development bias contact 121. The second portion 121*b* is provided with an anchoring hole 121*f,* into which a dowel 9*v*9, projecting inward from the inward facing wall of the developing roller bearing box 9*v* in the lengthwise direction of the developing roller 9*c,* is pressed. The external contact portion 121*e* of the development bias contact 121 comes in contact with the development bias contact member 125 of the apparatus main assembly 14 as the process cartridge B is installed in the apparatus main assembly 14, so that a development bias is applied to the developing roller 9*c*. The development bias contact member 125 will be described later.

Two cylindrical projections 9*v*1 of the developing roller bearing box 9*v* are fitted into the corresponding holes 12*m* of the image developing chamber frame 12, which are provided at the lengthwise end as illustrated in FIG. 19. As a result, the developing roller gearing box 9*v* is precisely positioned on the image developing chamber frame 12. Then, an unillustrated small screw is put through each screw hole of the developing roller bearing box 9*v,* and then is screwed into the female-threaded screw hole 12*c* of the image developing chamber frame 12 to fix the developing roller bearing box 9*v* to the image developing chamber frame 12.

As is evident from the above description, in this embodiment, in order to mount the developing roller 9*c* in the image developing chamber frame 12, the developing roller unit G is assembled first, and then, the assembled developing roller unit G is attached to the image developing chamber frame 12.

The developing roller unit G is assembled following the steps described below. First, the magnet 9*g* is put through the developing roller 9*c* fitted with the flange 9*p*, and the journal 9*w* and the coil spring type contact 91 for development bias are attached to the end of the developing roller 9*c*. Thereafter, the spacer roller 9*i* and the developing roller bearing 9*j* are fitted around each lengthwise end portion of the developing roller 9*c*, the developing roller bearing 9*j* being on the outer side relative to the lengthwise direction of the developing roller 9*c*. Then, the developing roller gear 9*k* is mounted on the developing roller gear shaft portion 9*p*1 located at the end of the developing roller 9*c*. It should be noted here that the lengthwise end 9*g*1 of the magnet 9*g*, which has a D-shaped crosssection, projects from the developing roller 9*c*, on the side where the developing roller 9*k* is attached; it projects from the end of the cylindrical portion 9*w*1 of the hollow journal 9*w*.

Next, the rod antenna 9*h* for detecting the toner remainder will be described. Referring to FIGS. 14 and 19, one and of the rod antenna 19*h* is bent like that of a crank shaft, wherein the portion comparable to the arm portion of the crank shaft constitutes a contact portion 9*h*1 (toner remainder detecting contact 122), and must be electrically in contact with the toner detecting contact member 126 attached to the apparatus main assembly 14. The toner detection contact member 126 will be described later. In order to mount the rod antenna 9*h* in the image developing chamber frame 12, the rod antenna 9*h* is first inserted into the image developing chamber frame 12 through a through hole 12*b* of a side plate 12B of the image developing chamber frame 12, and the end which is put through the hole 12*b* first is placed in an unillustrated hole of the opposite side plate of the image developing chamber frame 12, so that the rod antenna 9*h* is supported by the side plate. In other words, the rod antenna 9*h* is properly positioned by the through hole 12*b* and the unillustrated hole on the opposite side. In order to prevent toner from invading the through hole 12*b*, an unillustrated sealing member (for example, a ring formed of synthetic resin, a piece of felt or sponge, or the like) is insert in the through hole 12*b*.

As the developing roller gear box 9*v* is attached to the image developing chamber frame 12, the contact portion 9*h*1 of the rod antenna 9*h*, that is, the portion comparable to the arm portion of a crank shaft, is positioned so that the rod antenna 9*h* is prevented from moving or coming out of the image developing chamer frame 12.

After the toner chamber frame 11 and the image developing chamber frame 12 are united, the side plate 12A of the image developing chamber frame 12, through which the rod antenna 9*h* is inserted, overlaps with the side plate of the toner chamber frame 11, partially covering the toner sealing cap 11*f* of the bottom portion 11*b* of the toner chamber frame 11. Referring to FIG. 16, the side plate 12A is provided with a hole 12*x*, and a shaft fitting portion 9*s*1 (FIG. 15) of the toner feeding gear 9*s* for transmitting driving force to the toner feeding member 9*b* is put through this hole 12*x*. The shaft fitting portion 9*s*1 is a part of the toner feeding gear 9*s*, and is coupled with the coupling member 11*e* (FIGS. 16 and 20) to transmit a driving force to the toner feeding member 9*b*. As described before, the coupling member 11*e* is engaged with one of the lengthwise ends of the toner feeding member 9*b* and is rotatively supported by the toner chamber frame 11.

Referring to FIG. 19, in the image developing chamber frame 12, the toner stirring member 9*e* is rotatively supported parallel to the rod antenna 9*h*. The toner stirring member 9*e* is also shaped like a crank shaft. One of the crank shaft journal equivalent portions of the toner stirring member 9*e* is fitted in a bearing hole (unillustrated) of the side plate 12B, whereas the other is fitted with the toner stirring gear 9*m* which has a shaft portion rotatively supported by the side plate 12A illustrated in FIG. 16. The crank arm equivalent portion of the toner stirring member 9*c* is fitted in the notch of the shaft portion of the toner stirring gear 7*m* so that the rotation of the toner stirring gear 9*m* is transmitted to the toner stirring member 9*e*.

Next, transmission of a driving force to the image developing unit D will be described.

Referring to FIG. 15, the shaft 9*g*1 of the magnet 9*g*, which has the D-shaped crosssection, engages with a magnet supporting hole 40*a* of the image developing means gear holder 40. As a result, the magnet 9*g* is nonrotatively supported. As the image developing means gear holder 40 is attached to the image developing chamber frame 12, the developing roller gear 9*k* meshes with a gear 9*g* of a gear train GT, and the toner stirring gear 9*m* meshes with a small gear 9*s*2. Thus, the toner feeding gear 9*s* and the toner stirring gear 9*m* are enabled to receive the driving force transmitted from the developing roller gear 9*k*.

All the gears from the gear 9*q* to the toner gear 9*s* are idler gears. The gear 9*q* which meshes with the developing roller gear 9*k*, and a small gear which is integral with the gear 9*q*, are rotatively supported on a dowel 40*b* which is integral with the image developing means gear holder 40. A large gear 9*r* which engages with the small gear 9*q*1, and a small gear 9*r*1 which is integral with the gear 9*r*, are rotatively supported on the dowel 40*c* which is integral with the image developing means gear holder 40. The small gear 9*r*1 engages with the toner feeding gear 9*s*. The toner feeding gear 9*s* is rotatively supported on a dowel 40*d* which is a part of the image developing means gear holder 40. The toner feeding gear 9*s* has the shaft fitting portion 9*s*1. The toner feeding gear 9*s* engages with a small gear 9*s*2. The small gear 9*s*2 is rotatively supported on a dowel 40*e* which is a part of the image developing means gear holder 40. The dowels 40*b*, 40*c*, 40*d*, and 40*e* have a diameter of approximately 5–6 mm, and support the corresponding gears of the gear train GT.

With the provision of the above described structure, the gears which constitute the gear train can be supported by a single component (image developing means gear holder 40). Therefore, when assembling the process cartridge B, the gear train GT can be partially preassembled onto the image developing means gear holder 40; compound components can be preassembled to simplify the main assembly process. In other words, first, the rod antenna 9*h*, and the toner stirring member 9*e* are assembled into the image developing chamber frame 12, and then, the developing roller unit G and the gear box 9*v* are assembled into the developing station driving force transmission unit DG and the image developing chamber frame 12, respectively, completing the image developing unit D.

Referring to FIG. 19, an alphanumeric reference 12*p* designates an opening of the image developing chamber frame 12, which extends in the lengthwise direction of the image developing chamber frame 12. After the toner chamber frame 11 and the image developing chamber frame 12 are united, the opening 12*p* squarely meets with the opening 11*i* of the toner chamber frame 11, enabling the toner held in the toner chamber frame 11 to be supplied to the developing roller 9*c*. The aforementioned toner stirring member 9*e* and rod antenna 9*h* are disposed along one of the lengthwise edges of the opening 12*p*, across the entire length thereof.

The materials suitable for the image developing chamber frame 12 are the same as the aforementioned materials suitable for the toner chamber frame 11.

(Structure of Electrical Contact)

Next, referring to FIGS. 8, 9, 11, 23 and 30, connection and positioning of the contacts, which establish an electrical connection between the process cartridge B and the image forming apparatus main assembly 14 as the former is installed into the latter, will be described.

Referring to FIG. 8, the process cartridge B has a plurality of electrical contacts: (1) cylindrical guide 13*a*L as an electrically conductive contact placed in contact with the photosensitive drum 7 to ground the photosensitive drum 7 through the apparatus main assembly 14 (actual ground contact is the end surface of the cylindrical guide 13*a*L; it is designated by a numerical reference 119 when referred to as an electrically conductive grounding contact); (2) electrically conductive charge bias contact 120 electrically connected to the charging roller shaft 8*a* to apply a charge bias to the charging roller 8 from the apparatus main assembly 14; (3) electrically conductive development bias contact 121 electrically connected to the developing roller 9*c* to apply a development bias to the developing roller 9*c* from the apparatus main assembly 14; (4) electrically conductive toner remainder detecting contact 122 electrically connected to the rod antenna 9*h* to detect the toner remainder. These four contacts 119–122 are exposed from the side or bottom wall of the cartridge frame. More specifically, they all are disposed so as to be exposed from the left wall or bottom wall of the cartridge frame, as seen from the direction from which the process cartridge B is installed, being separated from each other by a predetermined distance sufficient to prevent electrical leakage. The grounding contact 119 and the charge bias contact 121 belong to the cleaning unit C, and the development bias contact 121 and the toner remainder detection contact 122 belong to the image developing chamber frame 12. The toner remainder detection contact 122 doubles as a process cartridge detection contact through which the apparatus main assembly 14 detects whether or not the process cartridge B has been installed in the apparatus main assembly 14.

Referring to FIG. 11, the grounding contact 119 is a part of the flange 29, which is formed of an electrically conductive material as described before. Therefore, the photosensitive drum 7 is grounded through a grounding plate 7*f* electrically in connection with the drum portion 7*d* of the photosensitive drum 7, the drum shaft 7*a* which is integral with the flange 29 and the cylindrical guide 13*a*L and is in contact with the grounding plate 7*f*, and the grounding contact 119 which is the end surface of the cylindrical guide 13*a*L. The flange 29 in this embodiment is formed of a metallic material such as steel. The charge bias contact 120 and the development bias contact 121 are formed of an approximately 0.1–0.3 mm thick electrically conductive metallic plate (for example, a stainless steel plate and or a phosphor bronze plate), and are laid (extended) along the internal surface of the process cartridge. The charge bias contact 120 is exposed from the bottom wall of the cleaning unit C, on the side opposite to the side from which the process cartridge B is driven. The development bias contact 121 and the toner remainder detection contact 122 are exposed from the bottom wall of the image developing unit D, also on the side opposite to the side from which the process cartridge B is driven.

This embodiment will be described further in detail.

As described above, in this embodiment, the helical drum gear 7*b* is provided at one of the axial ends of the photosensitive drum 7 as illustrated in FIG. 11. The drum gear 7*b* engages with the developing roller gear 9*k* to rotate the developing roller 9*c*. As it rotates, it generates a thrust in the direction (indicated by arrow d in FIG. 11). This thrust pushes the photosensitive drum 7, which is disposed in the cleaning chamber frame 13 with a slight play in the longitudinal direction, toward the side on which the drum gear 7*b* is mounted. Further, the reactive force, which is generated as the grounding plate 7*f* fixed to the spur gear 7*n* is pressed against the drum shaft 7*a*, adds to the thrust, in the direction of the arrow d. As a result, the outward edge 7*b*1 of the drum gear 7*b* remains in contact with the surface of the inward end of the bearing 38 fixed to the cleaning chamber frame 13. Thus, the position of the photosensitive drum 7 relative to the process cartridge B in the axial direction of the photosensitive drum 7 is regulated. The grounding contact 119 is exposed from the side plate 13*k* of the cleaning chamber frame 13. The drum shaft 7*a* extends into the base drum 7*d* (aluminum drum in this embodiment) coated with a photosensitive layer 7*e*, along the axial line. The base drum 7*d* and the drum shaft 7*a* are electrically connected through the internal peripheral surface 7*d*1 of the base drum 7*d* and the grounding plate 7*f* in contact with the end surface 7*a*1 of the drum shaft 7*a*.

Figure 23:
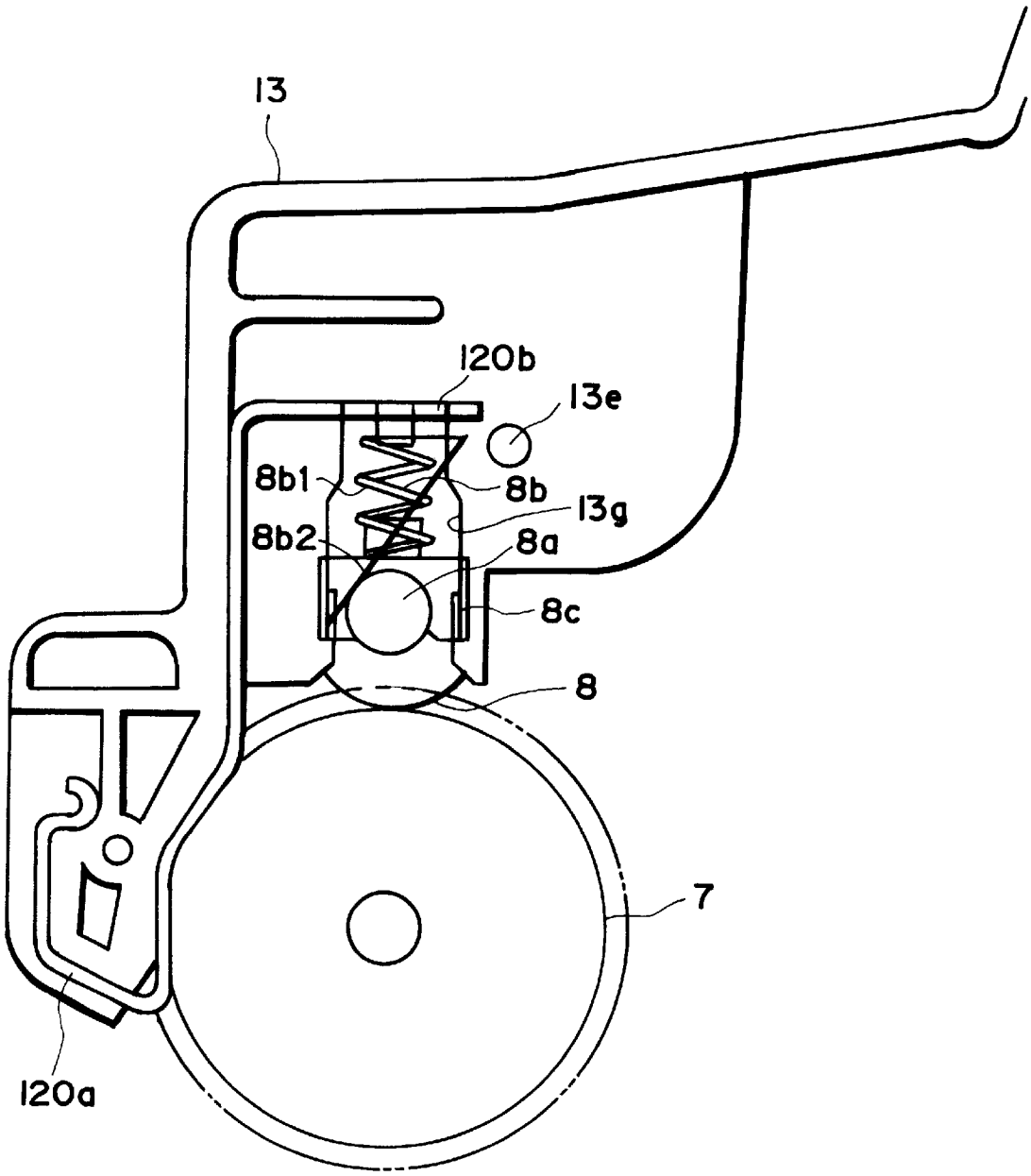
FIG. 23 is a vertical section of the structure which supports the photosensitive drum charging roller.
Figure 24:
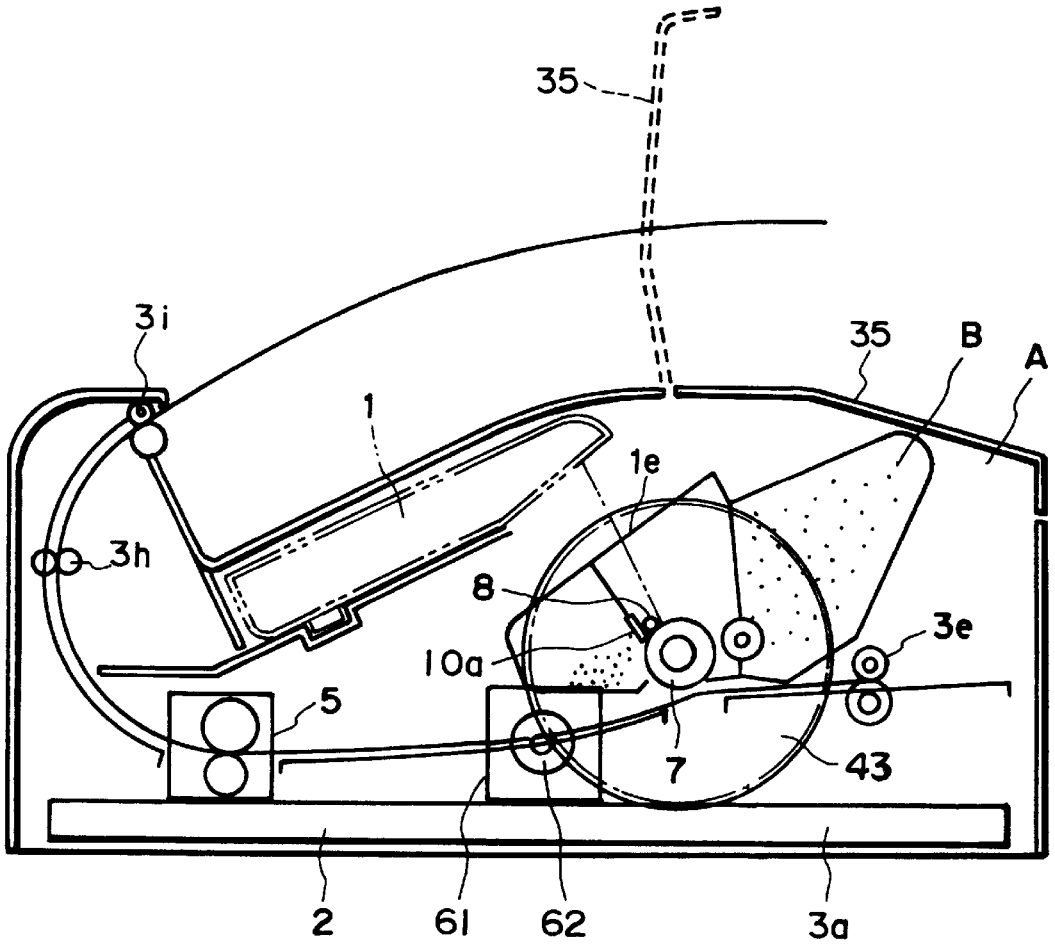
FIG. 24 is a schematic section of the driving system for the main assembly of the apparatus illustrated in FIG. 1.

The charge bias contact 120 is attached to the cleaning chamber frame 13, adjacent to where the charging roller 8 is supported (FIG. 8). Referring to FIG. 23, the charge bias contact 120 is electrically in contact with the shaft 8*a* of the charging roller 8 by way of a compound spring 8*b* which is in contact with the charge roller shaft 8*a*. This compound spring 8*b* is constituted of a compression spring portion 8*b*1 and an internal contact portion 8*b*2. The compression coil portion 8*b*1 is placed between the spring seat 120*b* and a charging roller bearing 8*c*. The internal contact portion 8*b*2 extends from the spring seat side end of the compression spring portion 8*b*1 and presses on the charge roller shaft 8*a*. The charging roller bearing 8*c* is slidably fitted in a guide groove 13*g* and the spring seat 120*b* is located at the closed end of the guiding groove 13*g*. The guide groove 13*g* extends in the direction of an imaginary line which runs through the centers of the crosssections of the charging roller 8 and photosensitive drum 7, the center line of the guiding groove 3*g* substantially coinciding with this imaginary line. Referring to FIG. 23, the charge bias contact 120 enters the cleaning chamber frame 13 at the location where it is exposed, runs along the internal wall of the cleaning chamber frame 13, bends in the direction which intersects with the direction in which the charge roller shaft 8*a* of the charging roller 8 is moved, and ends at the spring seat 120*b*.

Next, the development bias contact 121 and the toner remainder detection contact 122 will be described. Both contacts 121 and 122 are disposed on the bottom surface (surface of the image developing unit D, which faces downward when the process cartridge B is in the apparatus main assembly 14) of the image developing unit D, on the same side as the side plate 13*k* of the cleaning chamber frame 13. The aforementioned third portion 121*e* of the development contact 121, that is, the portion exposed from the image developing unit D, is disposed so as to oppose the charge bias contact 120 across the spur gear 7*n*. As described previously, the development bias contact 121 is electrically in contact with the developing roller 9*c* through the coil spring type contact 91 which is electrically in contact with the lengthwise end of the developing roller 9*c* (FIG. 18).

FIG. 38 schematically illustrates the relationship between the thrusts generated by the drum gear 7*b* and the developing roller gear 9*k* and the development bias contact 121. As stated before, the photosensitive drum 7 is shifted in the direction of the arrow d in FIG. 38 as the process cartridge B is driven. As a result, the end surface of the photosensitive drum 7 on the drum gear 7*b* side remains in contact with the end surface of the bearing 38 (FIG. 32) which is not illustrated in FIG. 38; the position of the photosensitive drum 7 in terms of the lengthwise direction thereof becomes fixed. On the other hand, the developing roller gear 9*k* which meshes with the drum gear 7*b* is thrusted in the direction of arrow e, which is opposite to the direction of arrow d. As a result, it presses the coil spring type contact 91 which is pressing the development bias contact 121. Consequently, the pressure generated by the coil spring type contact 91 in the direction of arrow f, that is, in the direction to press the developing roller 9*c* against developing roller bearing 9*j*, is reduced. Thus, it is assured that the coil spring type contact 91 and the development bias contact 121 never fail to remain in contact with each other, while the friction between the end surfaces of the developing roller 9*c* and developing roller bearing 9*j* is reduced to allow the developing roller 9*c* to rotate smoothly.

The toner remainder detection contact 122 illustrated in FIG. 8 is attached to the image developing chamber frame 12, being exposed on the upstream side of development bias contact 121 relative to the direction in which the process cartridge B is inserted (direction of arrow X in FIG. 9). As is evident from FIG. 19, the toner remainder detection contact 122 is a part of the rod antenna 9*h* which is formed of an electrically conductive material such as metallic wire and is extended in the lengthwise direction of the developing roller 9*c*. As described previously, the rod antenna 9*h* stretches across the entire length of the developing roller 9*c*, holding a predetermined distance from the developing roller 9*c*. It comes in contact with the toner detection contact member 126 of the apparatus main assembly 14 as the process cartridge B is inserted into the apparatus main assembly 14. The capacitance between the rod antenna 9*h* and the developing roller 9*c* changes according to the amount of the toner present between the two. Therefore, the change in this capacitance is detected as a potential difference by a control section (unillustrated) electrically connected to the toner detection contact member 126 of the apparatus main assembly 14 to determine the amount of the toner remainder.

The toner remainder means an amount of toner which induces a predetermined amount of capacitance when the toner is placed between the developing roller 9*c* and the rod antenna 9*h*. In other words, the control section detects that the amount of the toner in the toner container 11A has been reduced to a predetermined amount; the control section of the apparatus main assembly 14 detects through the toner remainder detection contact 122 that the capacitance has reached the first predetermined value, and therefore, determines that the amount of the toner within the toner container 11A has dropped to a predetermined amount. Upon detecting that the capacitance has reached the first value, the control section of the apparatus main assembly 14 informs the user that the process cartridge B should be replaced; for example, it flashes an indicator light or sounds a buzzer. On the contrary, when the control section detects that the capacitance shows a predetermined second value which is smaller than the predetermined first value, it determines that the process cartridge B has been installed in the apparatus main assembly 14. It does not allow the image forming operation of the apparatus main assembly 14 to be started unless it detects the completion of the process cartridge B installation in the apparatus main assembly 14.

The control section may be enabled to inform the user of the absence of the process cartridge B in the apparatus main assembly 14, by flashing an indicator light, for example.

Next, a connection between the electrical contacts of the process cartridge B and the electrical contact members of the apparatus main assembly 14 will be described.

Referring to FIG. 9, disposed on the internal surface of on the left-hand side wall of the cartridge accommodating space S in the image forming apparatus A are four contact members which come in contact with the aforementioned contacts 119–122 as the process cartridge B is inserted into the apparatus main assembly 14; a grounding contact member 123 which comes electrically in contact with the grounding contact 119; a charge bias contact member 124 which comes electrically in contact with the charge bias contact 120; a development bias contact member 125 which electrically comes in contact with the development bias contact 121; and a toner detection contact member 126 which comes electrically in contact with the toner remainder detection contact 122.

As illustrated in FIG. 9, the grounding contact member 123 is at the bottom portion of the positioning groove 16*b*. The development bias contact member 125, the toner detection contact member 126, and the charging roller contact member 124 are disposed, facing upward, on the bottom surface of the cartridge accommodating space S, below the guide portion 16*a* and adjacent to the left-hand side wall. They are enabled to move elastically in the vertical direction.

At this point, the positional relationship between each contact and the guide will be described.

Referring to FIG. 6, which illustrates the process cartridge B in a substantially horizontal position, the toner remainder detection contact 122 is at the lowest level. The development bias contact 121 is positioned higher than the toner remainder detection contact 122, and the charge bias contact 120 is positioned higher than the development bias contact 121. The rotation controlling guide 13*b*L and the cylindrical guide 13*a*L (grounding contact 119) are positioned higher than the charge bias contact 120, being approximately at the same level. In terms of the direction (indicated by the arrow X) in which the process cartridge B is inserted, positioned most upstream is the toner remainder detection contact 122, and the rotation controlling guide 13*b*L, the development bias contact 121, the cylindrical guide 13*a*L (grounding contact 119), and the charge bias contact 120, are disposed in this order toward the downstream end. With the provision of this positional arrangement, the charge bias contact 120 is positioned close to the charging roller 8; the development bias contact 121, close to the developing roller 9*c*; the toner remainder detection contact 122, close to the rod antenna 9*h*; and the grounding contact 119 is positioned close to the photosensitive drum 7. In other words, the distance between each contact and the related component can be reduced without intricately laying a long electrode in the process cartridge B and the image forming apparatus main assembly 14.

The dimensions of the actual contact area of each contact are as follows. The charge bias contact 120 measures approximately 10.0 mm in both the horizontal and vertical directions; the development bias contact 121, approximately 6.5 mm in the vertical direction and approximately 7.5 mm in the horizontal direction; the toner remainder detection contact 122, 2.0 mm in diameter and approximately 18.0 mm in the horizontal direction; and the grounding contact 119, which is circular, measures approximately 10.0 mm in external diameter. The charge bias contact 120 and the developlment bias contact 121 are rectangular. In measuring the dimension of the contact area, "vertical" means the direction parallel to the direction X in which the process cartridge B is inserted, and "horizontal" means the direction perpendicular to the direction X.

Figure 30:
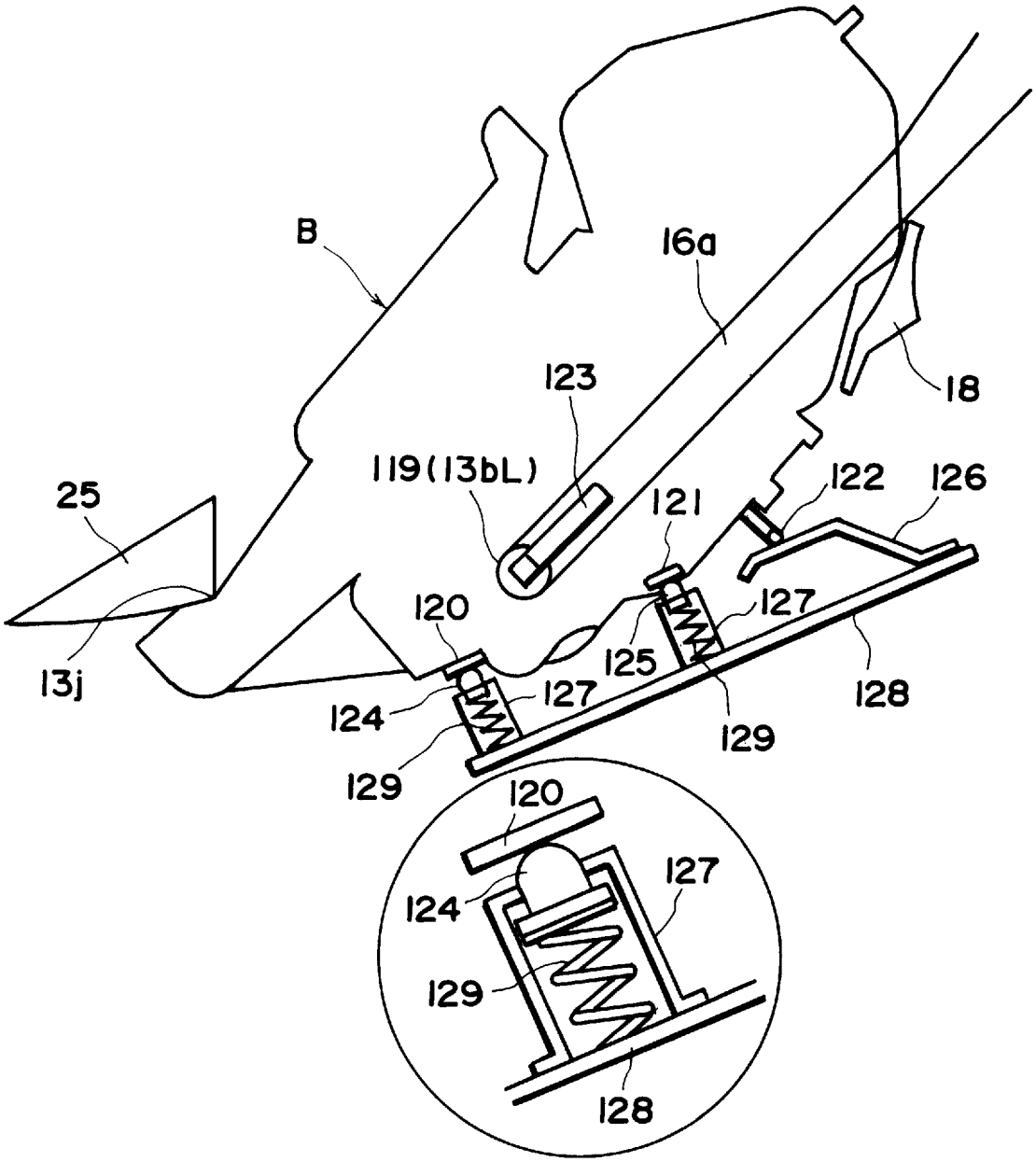
FIG. 30 is a vertical view of the process cartridge in the apparatus main assembly and the adjacencies thereof, depicting the positional relationship among the electrical contacts as seen while the process cartridge is installed into, or removed from, the apparatus main assembly.

The grounding contact member 123 is an electrically conductive plate spring. It is disposed in the positioning groove 16*b* (position of the drum shaft 7*a* is fixed) in which the grounding contact 119 of the process cartridge B, that is, the cylindrical guide 13*a*L, fits (FIGS. 9, 11, and 30). It is grounded through the chassis of the apparatus main assembly 14. The toner remainder detection contact member 126 is also an electrically conductive plate spring. It is disposed adjacent to the guide portion 16*a,* being next to the guide portion 16*a* in terms of the horizontal direction, but below in terms of the vertical direction. The other contact members 124 and 125 are also disposed adjacent to the guide portion 16*a,* being slightly farther away from the guide portion 16*a* than the toner remainder detection contact member 126 in terms of the horizontal direction, and below the guide portion 16*a* in terms of the vertical direction. The contact members 124 and 125 are provided with a compression type coil spring 129, and therefore, they project upward from their holders 127. This arrangement will be described more specifically referring to the charging roller contact member 124. Referring to the enlarged view of the charging roller contact member 124 in FIG. 30, the charging roller contact member 124 is placed in the holder 127 so that it is allowed to project upward from the holder 127 without slipping out. Then, the holder 127 is fixed to the electrical substrate 128 attached to the apparatus main assembly 14. The contact member 124 is electrically connected to the wiring pattern through an electrically conductive compression type coil spring 129.

Before the process cartridge B, inserted in the image forming apparatus A, is guided to a predetermined position by the guide portion 16*a,* the contact members 123–126 of the image forming apparatus A remain projected by the springs as far as they are allowed to project. In this state, none of the contact members 123–126 is in contact with their counterparts, that is, the contacts 119–122 of the process cartridge B. As the process cartridge B is inserted farther, the contact members 123–126 come in contact with the corresponding contacts 119–122 of the process cartridge B one by one. Then, as the cylindrical guide 13*a*L of the process cartridge B is fitted into the positioning groove 16*b* by additional inward movement of the process cartridge B, the contact members 123–126 of the apparatus main assembly 14 are pushed down by the corresponding contacts 119–122 of the process cartridge B against the elastic force of the compression type coil springs 129 in the holder 127. As a result, the contact pressures between the contact members 123–126 and the corresponding contacts 119–122 are increased.

As described above, according to this embodiment of the present invention, as the process cartridge B is guided to a predetermined position in the apparatus main assembly 14 by the guide member 16, the contacts of the process cartridge B reliably make contact with the contact members of the apparatus main assembly 14.

As the process cartridge B is installed in the predetermined position, the grounding contact member 123, which is in the form of a plate spring, comes in contact with the grounding contact 119 which is projecting from the cylindrical guide 13*a*L (FIG. 11); the grounding contact 119 is electrically connected to the grounding contact member 123, and as a result, the photosensitive drum 7 is grounded. The charge bias contact 120 and the charging roller contact member 124 becomes electrically connected to allow a high voltage (voltage composed by superposing AC voltage and a DC voltage) to be applied to the charging roller 8. The development bias contact 121 and the development bias contact member 125 make an electrical connection to each other to allow a high voltage to be applied to the developing roller 9*c*. The toner remainder detection contact 122 comes electrically in contact with the toner detection contact member 126, and information reflecting the capacitance between the developing roller 9*c* and the rod antenna 9*h* (contact 122) is transmitted to the apparatus main assembly 14 through the contact 122.

Further, the contacts 119–122 of the process cartridge B are disposed on the bottom side of the process cartridge B, and therefore, the reliability of contact between the contacts 119–122 and the corresponding contact members is not affected by the accuracy in their positional relationship in terms of the direction perpendicular to the direction of the arrow X in which the process cartridge B is inserted.

Further, all the contacts of the process cartridge B are positioned on one side of the cartridge frame. Therefore, the mechanical members and the electrical wiring members of the image forming apparatus main assembly 14 and the process cartridge B can be separately positioned on the appropriate sides of the cartridge accommodating space S, and the process cartridge B, to reduce the number of assembly steps and simplify the maintenance.

As the lid 35 is closed after the process cartridge B is inserted into the image forming apparatus main assembly 14, the coupling device on the process cartridge side connects with the coupling device on the apparatus main assembly side in synchronism with the movement of the lid 35, enabling the photosensitive drum 7 and the like to receive a driving force from the apparatus main assembly 14 to be rotated.

Further, since all electrical contacts of the process cartridge B are disposed on one side of the cartridge frame, a reliable electrical connection can be established between the image forming apparatus main assembly 14 and the process cartridge B.

Further, positioning each electrical contact in the above described manner makes it possible to reduce the distance the corresponding electrode must be routed in the cartridge frame.

(Coupling and Driving Structure)

A description will be made as to a structure of coupling means which is a drive transmission mechanism for transmitting the driving force to the process cartridge B from the main assembly 14 of the image forming apparatus.

Referring to FIG. 11, there is shown a longitudinal sectional view of a coupling portion wherein the photosensitive drum 7 is mounted to the process cartridge B.

Cartridge side coupling means is provided to one longitudinal end of the photosensitive drum 7 mounted to the process cartridge B, as shown in FIG. 11. The coupling means is in the form of a male coupling shaft 37 (circular column configuration) formed on a drum flange 36 fixed to the one end of the photosensitive drum 7. The end surface 37*a*1 of the projection 37*a* is parallel to the end surface of the male shaft 37. The male shaft 37 is engageable with a bearing 38 to function as a drum shaft. In this example, the drum flange 36, male coupling shaft 37 and the projection 37*a* are integrally formed. The drum flange 36 is integrally provided with a helical drum gear 7*b* to transmit the driving force to the developing roller 9*c* in the process cartridge B. Therefore, as shown in FIG. 11, the drum flange 36 is an integrally molded product of a plastic resin material having a drum gear (helical gear) 7*b,* the male coupling shaft 37, and the projection 37*a* to constitute a driving force transmitting part having a function of transmitting a driving force.

The projection 37*a* has a configuration of a twisted prism, and more particularly, it has a crosssection of a substantially equilateral triangle, and is gradually twisted to a small extent in the axial direction. The corner portion of the prism is rounded. The recess 39*a* for engaging with the projection 37*a* has a crosssection of a polygonal shape, and is gradually twisted to a small extent in the axial direction. The projection 37*a* and the recess 39*a* are twisted in the same direction with the same twisting pitch. The crosssection of said recess 39*a* is of a substantially triangular shape in this embodiment. The recess 39*a* is provided in a female coupling shaft 39*b* which is integral with a gear 43 in the main assembly 14 of the apparatus. The female coupling shaft 39*b* is rotatable and movable in the axial direction relative to the main assembly 14 of the apparatus. With this structure of this example, when the process cartridge B is mounted to the main assembly 14 of the apparatus, the projection 37*a* enters the recess 39*a* provided in the main assembly 14. When the recess 39*a* starts to rotate, the recess 39*a* and the projection 37*a* are brought into engagement with each other. When the rotating force of recess 39*a* is transmitted to the projection 37*a,* the edge lines 37*a*2 of the substantially equilateral triangle projection 37*a* and the inner surfaces 39*a*2 of the recess 39*a,* are uniformly contacted to each other, and therefore, the axes are aligned. To accomplish this, the diameter of the circumscribed circle R0 of the male coupling projection 37*a* is larger than that of the inscribed circle R1 of the female coupling recess 39*a,* and is smaller than that of the circumscribed circle R2 of the female coupling recess 39*a.* The twisting produces such a force that projection 37*a* is pulled toward the recess 39*a,* so that an end surface of the projection 37*a*1 is abutted to the bottom 39*a*1 of the recess 39*a.* Thus, a thrust force is produced to urge the drum gear 7*b* in the direction of an arrow d, and therefore, the photosensitive drum 7 integral with the projection 37*a* is stably positioned in the main assembly 14 of the image forming apparatus both in the axial direction and in the radial direction.

In this example, the twisting direction of the projection 37*a* is opposite from the rotational direction of the photosensitive drum 7 in the direction from the bottom trunk of the projection 37*a* toward the free end thereof, as seen from the photosensitive drum 7; the twisting direction of the recess 39*a* is opposite in the direction from the inlet of the recess 39*a* toward the inside; and the twisting direction of the drum gear 7*b* of the drum flange 36 is opposite from the twisting direction of the projection 37*a*.

The male shaft 37 and the projection 37*a* are provided on the drum flange 36 such that when the drum flange 36 is mounted to end of the photosensitive drum 7, they are coaxial with the axis of the photosensitive drum 7. Designated by 36*b* is an engaging portion which is engaged with the inner surface of the drum cylinder 7*d* when the drum flange 36 is mounted to the photosensitive drum 7. The drum flange 36 is mounted to the photosensitive drum 7 by crimping or bonding. The circumference of the drum cylinder 7*d* is coated with a photosensitive layer 7*e*.

As described hereinbefore, the process cartridge B of this embodiment is as follows:

A process cartridge detachably mountable to a main assembly of an image forming apparatus 14, wherein said main assembly includes a motor 61, a main assembly side gear 43 for receiving a driving force from said motor 61 and a hole 39*a* defined by twisted surfaces, said hole 39*a* being substantially coaxial with said gear 43; and an electrophotographic photosensitive drum 7;

process means (8, 9, 10) actable on said photosensitive drum 7; and a twisted projection 37 engageable with said twisted surfaces, said projection 37 being provided at a longitudinal end of said photosensitive drum 7, wherein when said main assembly side gear 43 rotates with said hole 39*a* and the projection 37 engaged with each other, a rotational driving force is transmitted from said gear 43 to said photosensitive drum 7 through engagement between said hole 39*a* and said projection 37.

The twisted projection 37 is provided at a longitudinal end of said photosensitive drum 7, and has a non-circular crosssection and is substantially coaxial with a rotational axis of said photosensitive drum 7, wherein said projection 37 of said photosensitive drum 7 has such a dimension and configuration that it can take a first relative rotational position with respect to a recess 39*a* of the driving rotatable member (main assembly side gear 43) in which relative rotational movement therebetween is permitted, and a second relative rotational position with respect to said recess 39*a* of said driving rotatable member in which relative rotational movement is prevented in one rotational direction, while the rotational axis of said driving rotatable member and the rotational axis of said photosensitive drum 7 are substantially aligned.

As described in the foregoing, a spur gear 7*n* is fixed to the other end of the photosensitive drum 7.

Examples of the material of the spur gear 7*n* and the drum flange 36 include polyacetal (polyacetal), polycarbonate (polycarbonate), polyamide (polyamide) and polybutylene terephthalate (polybutylenetelephthalate) or other resin material.

Around the projection 37*a* of the male coupling shaft 37 of the process cartridge B, there is provided a cylindrical projection 38*a* (cylindrical guide 13*a*R) coaxial with the male shaft 37, which projection 38*a* is integral with a bearing 38 fixed to a cleaning frame 13. The projection 37*a* of the male coupling shaft 37 is protected when, for example, the process cartridge B is mounted or demounted, and therefore, it is not damaged or deformed. Thus, possible play or vibration during driving through the coupling due to damage to the projection 37*a* can be prevented.

The bearing 38 may function as a guiding member when the process cartridge B is mounted or demounted relative to the main assembly 14 of the image forming apparatus. More particularly, when the process cartridge B is mounted to the main assembly 14 of the image forming apparatus, the projection 38*a* of the bearing 38 and the side guide portion 16*c* of the main assembly are contacted, and the projection 38*a* functions to position the process cartridge B to the mounting position (guide 13*a*R) to facilitate the mounting and demounting of the process cartridge B relative to the main assembly 14 of the apparatus. When the process cartridge B is mounted to the mounting position, the projection 38*a* is supported by a positioning groove 16*d* formed in the guide portion 16*c*.

Among the photosensitive drum 7, drum flange 36 and the male coupling shaft 37, there is a relation shown in FIG. 11. More particularly, $H>F\geqq M$, and $E>N$, where H is an outer diameter of the photosensitive drum 7; E is a circle diameter of the drum gear 7*b;* F is a diameter of the bearing of the photosensitive drum 7 (an outer diameter of the shaft portion of the male coupling shaft 37, and an inner diameter of the bearing 38); M is a circumscribed circle diameter of the male coupling projection 37*a;* and N is a diameter of the engaging portion between the photosensitive drum 7 and the drum flange 36 (the inner diameter of the drum).

By H>F, the sliding load torque at the bearing portion can be reduced more than when the drum cylinder 7*d* is formed; by F≧M, the mold structure can be simplified since no undercut portion is provided, in view of the fact that when the flange portion is molded, the mold is divided normally in a direction of arrow p in the Figure.

By E>N, the mold configuration of the gear portion is formed above the left mold as seen in the direction of mounting of the process cartridge B, and therefore, the right-hand mold can be simplified to improve the durability of the mold.

Figure 25:
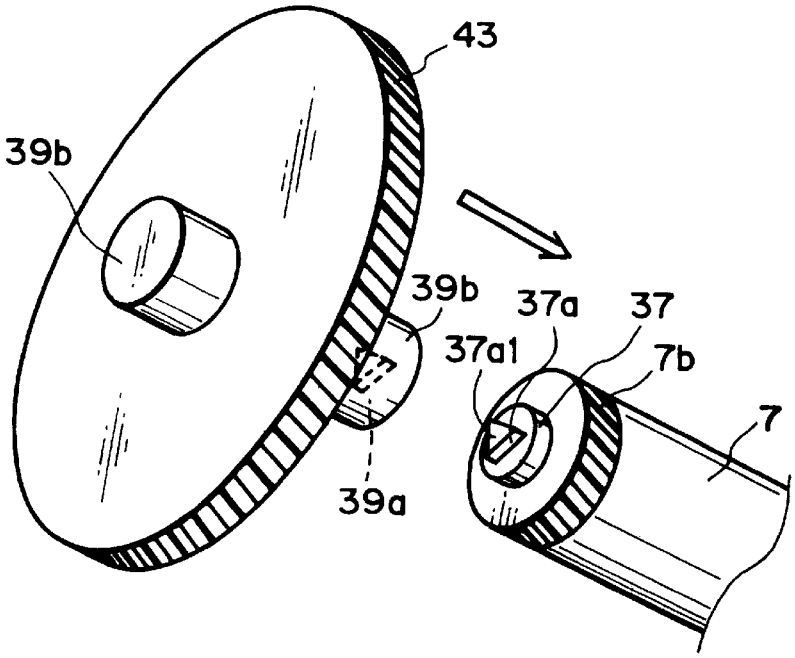
FIG. 25 is a perspective view of a coupling provided on the apparatus main assembly side, and a coupling provided on the process cartridge side.
Figure 26:
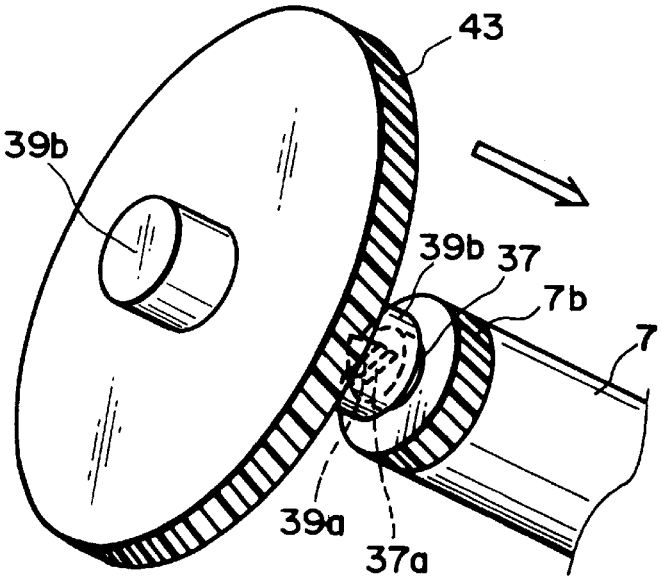
FIG. 26 is a perspective view of the coupling provided on the apparatus main assembly side, and the coupling provided on the process cartridge side.

The main assembly 14 of the image forming apparatus is provided with coupling means of the main assembly. The coupling means of the main assembly has a female coupling shaft 39*b* (circular column configuration) at a position aligned with the rotational axis of the photosensitive drum when the process cartridge B is inserted (FIGS. 11, 25). The female coupling shaft 39*b,* as shown in FIG. 11, is a driving shaft integral with a large gear 43 for transmitting the driving force to the photosensitive drum 7 from the motor 61. The female shaft 39*b* is projected from the lateral edge of the large gear 43 at the center of rotation of the large gear 43. In this example, the large gear 43 and the female coupling shaft 39*b* are integrally molded.

The large gear 43 in the main assembly 14 is a helical gear, which is in meshing engagement with a small helical gear 62 fixed to or integral with the shaft 61*a* of the motor 61; the twisting directions and the inclination angles thereof are such that when the driving force is transmitted from the small gear 62, female shaft 39*b* is moved toward the male shaft 37 by the thrust force produced. Thus, when the motor 61 is driven for the image formation, the female shaft 39*b* is moved toward the male shaft 37 by the thrust force to establish engagement between the recess 39*a* and the projection 37*a*. The recess 39*a* is provided at the end of the female shaft 39*b* in alignment with the center of rotation of the female shaft 39*b*.

In this embodiment, the driving force is directly transmitted from the small gear 62 of the motor shaft 61*a* to the large gear 43, but it may be transmitted through a speed reduction gear train, belt-pulley means, a couple of friction rollers, or a combination of a timing belt and a pulley.

Referring to FIGS. 24, and 27 to 29, a description will be made as to a structure for engaging the recess 39*a* and the projection 37*a* in interrelation with the closing operation of the openable cover 35.

Figure 29:
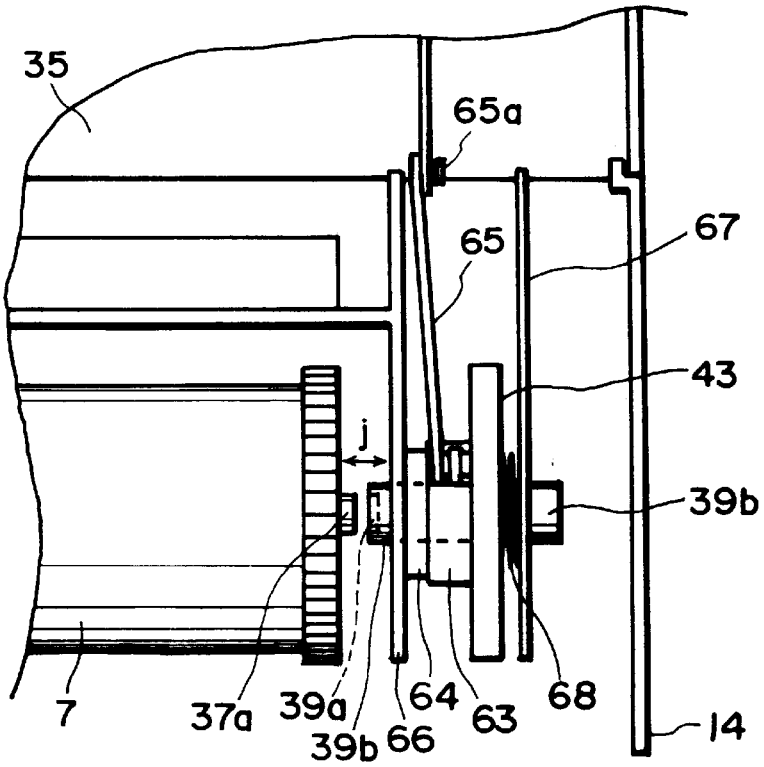
FIG. 29 is a front view of the indented coupling shaft and its adjacencies as seen while the process cartridge in the apparatus main assembly is driven.

As shown in FIG. 29, a side plate 67 is fixed between the large gear 43 and the side plate 66 in the main assembly 14, and the female coupling shaft 39*b* coaxially integral with the large gear 43 is rotatably supported by the side plates 66, 67. An outer cam 63 and an inner cam 64 are closely inserted between the large gear 43 and the side plate 66. The inner cam 64 is fixed to the side plate 66, and the outer cam 63 is rotetably engaged with the female coupling shaft 39*b*. The surfaces of the outer cam 63 and the inner cam 64 which are substantially perpendicular to the axial direction and which are faced to each other, are cam surfaces, and are screw surfaces coaxial with the female coupling shaft 39*b* and are contacted to each other. Between the large gear 43 and the side plate 67, a compression coil spring 68 is compressed and fitted around the female coupling shaft 39*b*.

Figure 27:
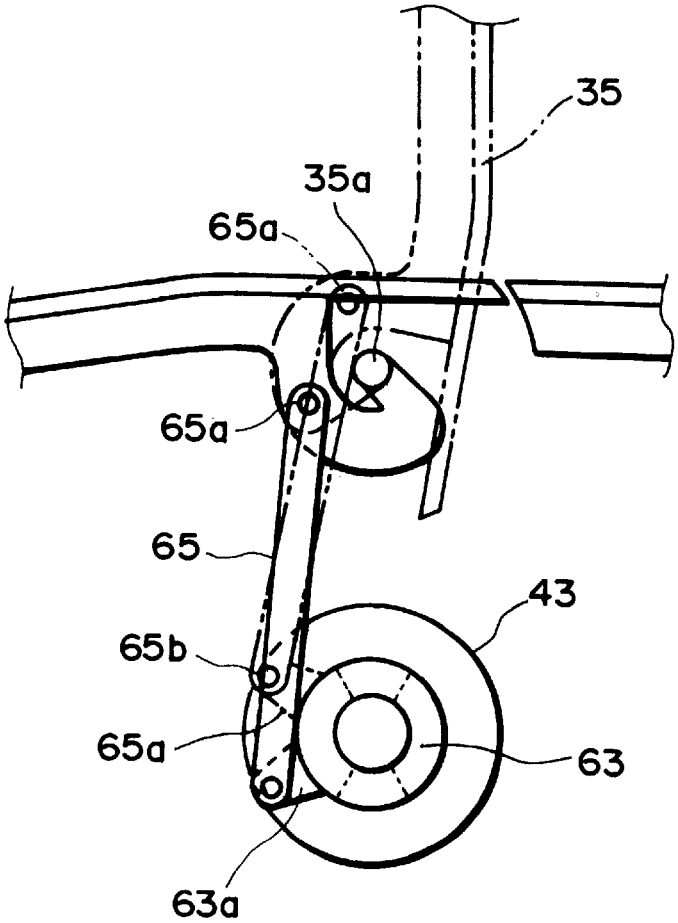
FIG. 27 is a section of the structure which links the lid of the apparatus main assembly, and the coupling portion of the apparatus main assembly.

As shown in FIG. 27, an arm 63*a* is extended from an outer periphery of the outer cam 63 in a radial direction, and an end of the arm 63*a* is coupled with an end of a link 65 by a pin 65*a* at a position opposite from the opening side when the openable cover 35 is closed. The other end of the link 65 is combined with an end of the arm 63*a* by a pin 65*b*.

Figure 28:
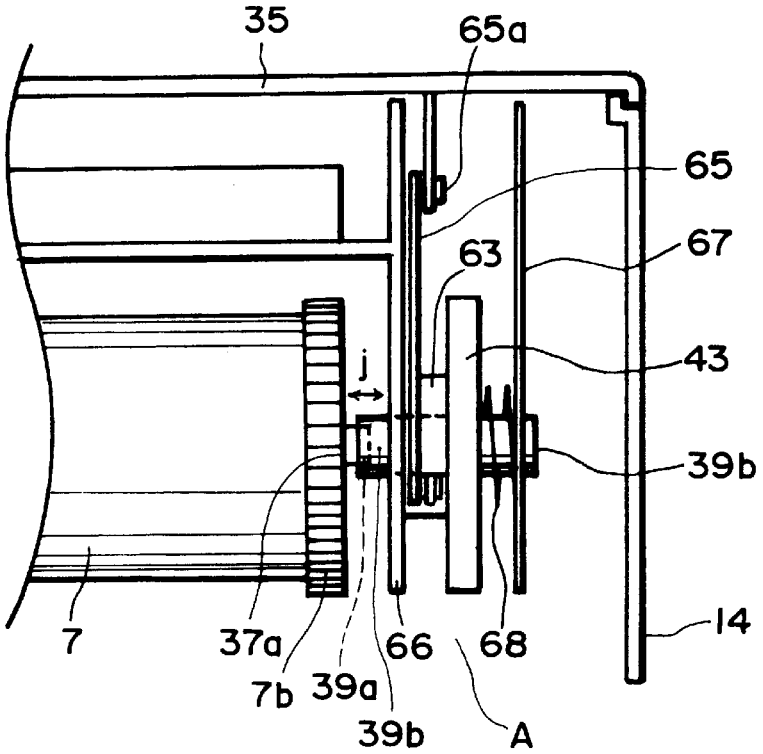
FIG. 28 is a front view of the indented coupling shaft and the adjacencies thereof as seen while the process cartridge in the apparatus main assembly is driven.

FIG. 28 is a view as seen from the right in FIG. 27, and when the openable cover 35 is closed, the link 65, outer cam 63 and the like are at the positions shown in the Figure, where the male coupling projection 37*a* and the recess 39*a* are engaged so that driving force can be transmitted from the large gear 43 to the photosensitive drum 7. When the openable cover 35 is opened, the pin 65*a* is rotated upward about the fulcrum 35*a,* so that arm 63*a* is pulled up through the link 65, and the outer cam 63 is rotated; thus, a relative sliding motion is caused between the outer cam 63 and the inner cam 64 to move the large gear 43 away from the photosensitive drum 7. At this time, the large gear 43 is pushed by the outer cam 63, and is moved against the compression coil spring 68 mounted between the side plate 67 and the large gear 39, by which the female coupling recess 39*a* is disengaged from the male coupling projection 37*a* as shown in FIG. 29 to release the coupling to bring the process cartridge B into a demountable state.

On the contrary, when the openable cover 35 is closed, the pin 65*a* connecting the link 65 with the openable cover 35, is rotated downward about the fulcrum 35*a,* and the link 65 is moved downward to push the arm 63*a* down, so that outer cam 63 is rotated in the opposite direction, by which the large gear 43 is moved to the left by the spring 68 to a position shown in FIG. 28, so that large gear 43 is set again at a position shown in FIG. 28, and the female coupling recess 39*a* is engaged with the male coupling projection 37*a* to re-establish a drive transmittable state. Thus, the demountable state and the drive transmittable state of the process cartridge B are established in response to opening and closing of the openable cover 35. When the outer cam 63 is rotated in the opposite direction by the closing of the openable cover 35 to move the large gear 43 to the left from the position of FIG. 29, the female coupling shaft 39*b* and the end surface of the male coupling shaft 37 may be abutted to each other so that the male coupling projection 37*a* and the female coupling recess 39*a* may not be engaged with each other. However, they will be brought into engagement upon starting of the image forming apparatus A, as will be described hereinafter.

Thus, in this embodiment, when the process cartridge B is mounted to or demounted from the main assembly 14 of the apparatus, the openable cover 35 is opened. In interrelation with the opening and closing of the openable cover 35, the female coupling recess 39*a* is moved in the horizontal direction (the direction of arrow j). When the process cartridge B is mounted to or demounted from the main assembly 14, the coupling (37*a,* 39*a*) of the main assembly 14 and the process cartridge B are not to be engaged. And, they should not be engaged. Thus, the mounting-and-demounting of the process cartridge B relative to the main assembly 14 can be carried out smoothly. In this example, the female coupling recess 39*a* is urged toward the process cartridge B by the large gear 43 being urged by the compression coil spring 68. When the male coupling projection 37*a* and the recess 39*a* are to be brought into engagement, they may be abutted to each other, and therefore, they are not properly engaged. When, however, the motor 61 is first rotated after the process cartridge B is mounted to the main assembly 14, the female coupling recess 39*a* is rotated, by which they are instantaneously brought into engagement.

A description will now be made as to the configurations of the protection 37*a* and the recess 39*a* constituting the engaging portion of the coupling means.

The female coupling shaft 39*b* provided in the main assembly 14 is movable in the axial direction, as described hereinbefore, but is not movable in the radial direction. The process cartridge B is movable in its longitudinal direction and the cartridge mounting direction (x direction (FIG. 9)) when it is mounted in the main assembly. In the longitudinal direction, the process cartridge B is permitted to move between the guiding members 16R, 16L provided in the cartridge mounting space S.

When the process cartridge B is mounted to the main assembly 14, a portion of a cylindrical guide 13*a*L (FIGS. 6, 7 and 9), formed on the flange 29 mounted to the other longitudinal end of the cleaning frame 13, is fitted substantially without a gap into the positioning groove 16*b* (FIG. 9) of the main assembly 14 to accomplish correct positioning, and the spur gear 7*n* fixed to the photosensitive drum 7 is brought into meshing engagement with a gear (unshown) for transmitting the driving force to the transfer roller 4. On the other hand, at one longitudinal end (driving side) of the photosensitive drum 7, a cylindrical guide 13*a*R formed on the cleaning frame 13 is supported by a positioning groove 16*d* provided in the main assembly 14.

By the cylindrical guide 13*a*R being supported in the positioning groove 16*d* of the main assembly 14, the drum shaft 7*a* and the female shaft 39*b* are aligned with a deviation of not more than 2.00 mm, so that a first aligning function in the coupling action process is accomplished.

By closing the openable cover 35, the female coupling recess 39*a* is moved horizontally to enter the projection 37*a*.

Then, at the driving side (coupling side), the positioning and the drive transmission are carried out as follows.

When the driving motor 61 of the main assembly 14 is rotated, the female coupling shaft 39*b* is moved toward the male coupling shaft 37 (the direction opposite to the direction of arrow d in FIG. 11), and when the phase alignment is reached between the male coupling projection 37*a* and the recess 39*a* (in this embodiment, the projection 37*a* and the recess 39*a* have substantially equilateral triangle configurations, the phase alignment is reach at each 120 degrees of rotation), they are brought into engagement, so that a rotating force is transmitted to the process cartridge B from the main assembly 14 (from the state shown in FIG. 29 to the state shown in FIG. 28).

The sizes of the equilateral triangles of the male coupling projection 37*a* and the recess 39*a* are different, more particularly, the crosssection of the triangular recess of the female coupling recess 39*a* is larger than the crosssection of the triangular projection of the male coupling projection 37*a,* and therefore, they are smoothly bought into engagement.

The lower limit of the inscribed circle diameter of the triangular shape of the projection is about 8.0 mm from the standpoint of the necessary rigidity, and in this embodiment, it is 8.5 mm, and the inscribed circle diameter of the triangular shape of the recess is 9.5 mm, so that the gap is 0.5 mm.

In order to establish engagement of the coupling with a small gap, it is desirable to establish a certain degree of alignment before the engagement.

In this embodiment, in order to provide the a concentricity of 1.0 mm, desirable for engagement with the gap of 0.5 mm, the projection length of the projection 38 of the cylindrical bearing is made longer than the projection length of the male coupling projection 37*a,* and the outside circumference of the female shaft 39*a* is guided by more than two projected guides 13*a*R4 provided in the projection 38*a* of the bearing, by which the concentricity before the coupling engagement between the projection 37 and the female shaft 39*a* is maintained at less than 1.0 mm, so as to stabilize the engaging action of the coupling (second aligning function).

When the image forming operation is started, the female coupling shaft 39*b* is rotated while the male coupling projection 37*a* is in the recess 39*a,* the inner surfaces of the female coupling recess 39*a* are brought into abutment with the three edge lines of the substantially equilateral triangular prism of the projection 37*a,* so that the driving force is transmitted. At this time, the male coupling shaft 37 is moved to be aligned with the female shaft 39*b* such that inner surfaces of the female coupling recess 39*a* of the regular prism are uniformly contacted to the edge lines of the projection 37*a.*

Thus, the alignment between the male coupling shaft 37 and the female shaft 39*b* are automatically established by the actuation of the motor 61. By the driving force transmitted to the photosensitive drum 7, the process cartridge B tends to rotate, by which a regulating abutment 13*j* (FIGS. 4, 5, 6, 7 and 30), formed on the upper surface of the cleaning frame 13 of the process cartridge B, is urged to the fixing member 25 (FIGS. 9, 10 and 30) fixed to the main assembly 14 of the image forming apparatus, thus correctly positioning the process cartridge B relative to the main assembly 14.

When the driving is not effected (an image forming operation is not carried out), the gap is provided in the radial direction between the male coupling projection 37*a* and the recess 39*a,* so that engagement and disengagement of the coupling are easy. When the driving is effected, the urging force is provided with stabilization, so that play or vibration there can be suppressed.

In this embodiment, the male coupling projection and recess have substantially equilateral triangle shapes, but the same effects can be provided when they are of a substantially regular polygonal configuration. A substantially regular polygonal configuration is desirable since then the positioning can be effected with high precision, but this is not limiting, and another polygonal shape is usable if the engagement is established with an axial force. The male coupling projection may be in the form of a male screw having a large lead, and the female coupling recess may be in the form of a complementary female screw. In such a case, triangle male and female screws having three leads correspond to the foregoing male coupling projection and female recess.

When the male coupling projection and the female recess are compared, the projection is more easily damaged, and has poorer mechanical strength. In view of this, this embodiment is such that a male coupling projection is provided in the exchangeable process cartridge B, and the female coupling recess is provided in the main assembly 14 of the image forming apparatus which is required to have a higher durability than the process cartridge. However, the process cartridge B may have a recess, and the main assembly may have the projection, correspondingly.

Figure 33:
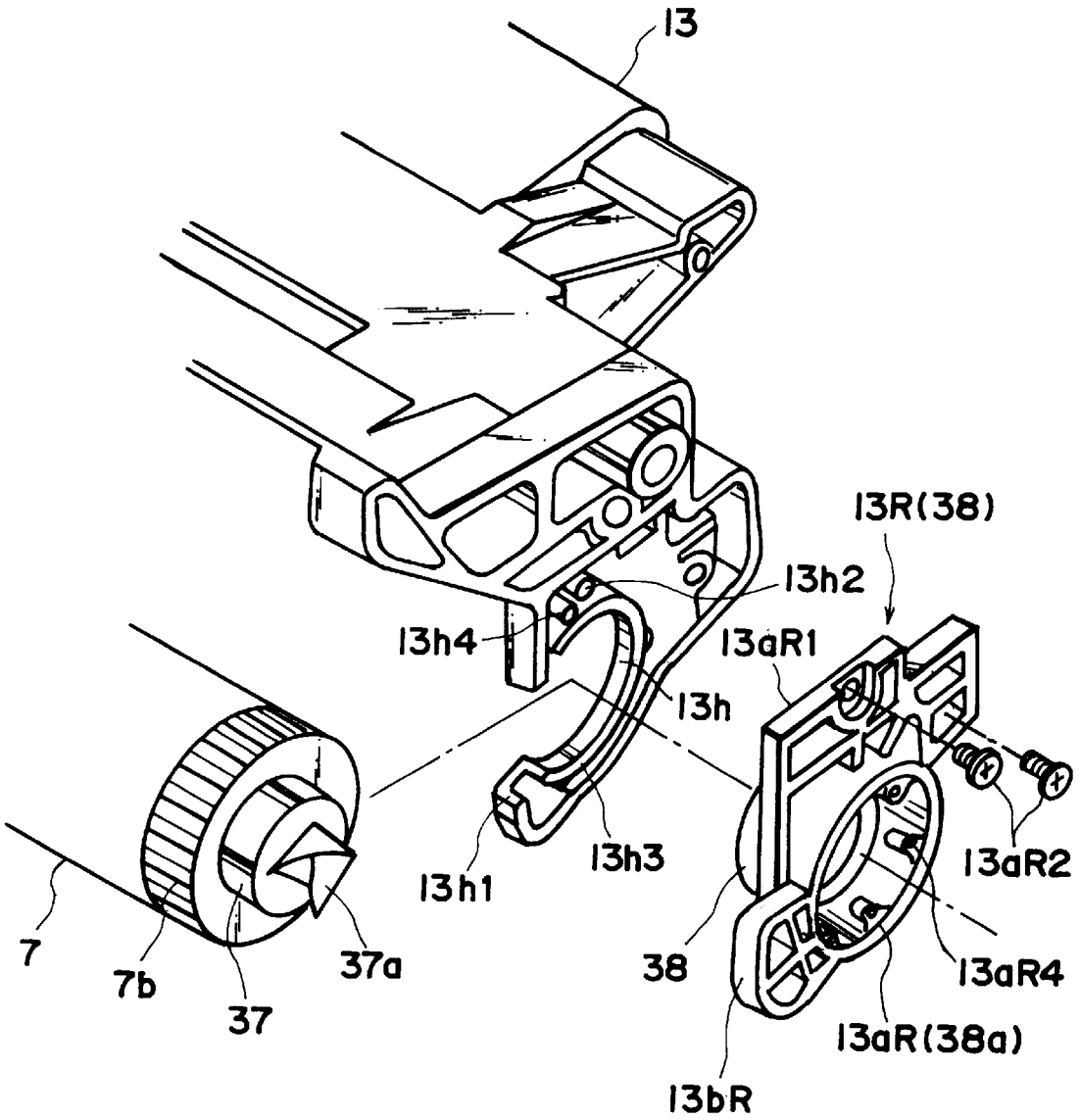
FIG. 33 is a perspective view of the longitudinal end portion of the process cartridge, depicting how the photosensitive drum is mounted in the cleaning chamber frame.
Figure 34:
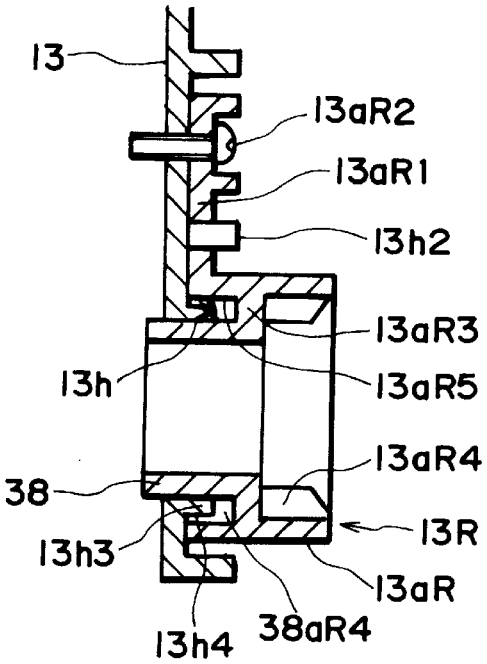
FIG. 34 is a vertical section of the drum bearing portion.
Figure 35:
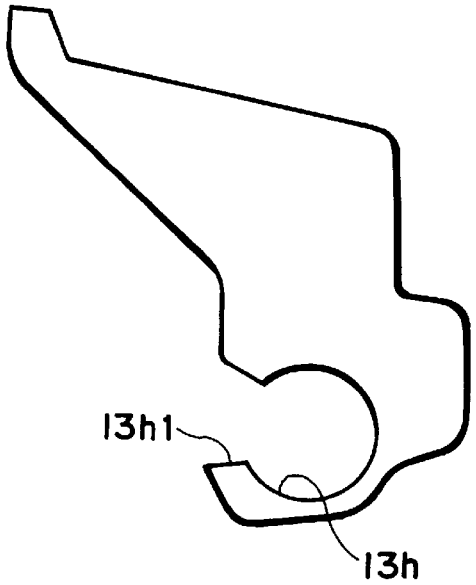
FIG. 35 is a side view of the drum bearing portion, depicting the contour thereof.

FIG. 33 is a perspective view showing in detail the mounting relation between the right-hand guiding member 13R and the cleaning frame 13; FIG. 34 is a longitudinal sectional view wherein the right-hand guiding member 13R is mounted to the cleaning frame 13; and FIG. 35 shows a part of a right side of the cleaning frame 13. FIG. 35 is a side view showing an outline of a mounting portion of a bearing 38 integrally formed with the right-hand guiding member 13R.

A description will now be made as to the mounting to the cleaning frame 13 shown in FIG. 11 illustrating the right-hand guiding member 13R (38) having the integral bearing 38, and as to the mounting of the photosensitive drum 7 to the cleaning frame 13.

A rear surface of the right-hand guiding member 13R has an integral bearing 38 concentric with the cylindrical guide 13*a*R and having a small diameter, as shown in FIGS. 33, 34. The bearing 38 is extended to a cylindrical end thereof through a disk member 13*a*R3 provided at an axially (longitudinally) middle portion of the cylindrical guide 38*a*R. Between the bearing 38 and the cylindrical guide 13*a*R, a circular groove 38*a*R4, open to the inside of the cleaning frame 13, is formed. As shown in FIGS. 33 and 35, a side surface of the cleaning frame 13 is provided with a partly circular-cylindrical shaped hole 13*h* for receiving the bearing, and the lacking circle portion 13*h*1 has faced end portions with a gap therebetween smaller than the diameter of the bearing mounting hole 13*h* and larger than the diameter of the coupling projected shaft 37. Since the coupling projected shaft 37 is engaged with the bearing 38, it is spaced from the bearing mounting hole 13*h*. A positioning pin 13*h*2 is formed integrally on the side surface of the cleaning frame 13, and is fitted closely into the flange 13*a*R1 of the guiding member 13R. By doing so, the photosensitive drum 7 in the form of an unit can be mounted to the cleaning frame 13 in a transverse direction crossing with the axial direction (longitudinal direction), and the position of the right-hand guiding member 13R is correctly determined relative to the cleaning frame when the right-hand guiding member 13R is mounted to the cleaning frame 13 in the longitudinal direction.

When the photosensitive drum 7 unit is to be mounted to the cleaning frame 13, the photosensitive drum 7 unit is moved in the direction crossing with the longitudinal direction, as shown in FIG. 33, to insert it into the bearing mounting hole 13*h* while moving the male coupling shaft 37 through the lacking circle portion 13*h*1 with the drum gear 7*b* being inside the cleaning frame 13. With this state, the drum shaft 7*a* integral with the left-hand guide 13*a*L shown in FIG. 11 is inserted through a lateral edge 13*k* of the cleaning frame 13 to be engaged with the spur gear 7*n*, and a small screw 13*d* is threaded through the flange 29 of the guide 13*a*L into the cleaning frame 13, thus fixing the guide 13*a*L to the cleaning frame to support one end portion of the photosensitive drum 7.

Then, the outer periphery of the bearing 38, integral with the right-hand guiding member 13R, is fitted into the bearing mounting hole 13*h*, and the inner circumference of the bearing 38 is engaged with the male coupling shaft 37; and then, the positioning pin 13*h*2 is fitted into the hole of the flange 13*a*R1 of the right-hand guiding member 13R. Then, a small screw 13*a*R2 is threaded through the flange 13*a*R1 into the cleaning frame 13, thus fixing the right-hand guiding member 13R to the cleaning frame 13.

In this manner, the photosensitive drum 7 is correctly and securedly fixed to the cleaning frame 13. Since the photosensitive drum 7 is mounted to the cleaning frame 13 in the direction transverse to the longitudinal direction, the longitudinal end structures are simplified, and the longitudinal dimension of the cleaning frame 13 can be reduced. Therefore, the main assembly 14 of the image forming apparatus can be downsized. The cylindrical guide 13*a*L has a large flange 29 securedly abutted to the cleaning frame 13, and the drum shaft 7*a* integral with the flange 29 is closely fitted into the cleaning frame 13. The right-hand side cylindrical guide 13*a*R is coaxial with and integral with the bearing 38 supporting the photosensitive drum 7. The bearing 38 is engaged into the bearing mounting hole 13*h* of the cleaning frame 13, and therefore, the photosensitive drum 7 can be correctly positioned perpendicularly to the feeding direction of the recording material 2.

The left side cylindrical guide 13*a*L, the large area flange 29 and the drum shaft 7*a* projected from the flange 29 are of integral metal, and therefore, the position of the drum shaft 7*a* is correct, and the durability is improved. The cylindrical guide 13*a*L is not worn even if the process cartridge B is repeatedly mounted to or demounted from the main assembly 14 of the image forming apparatus. As described hereinbefore in connection with the electrical contacts, the electrical ground of the photosensitive drum 7 is easy. The right-hand side cylindrical guide 13*a*R has a larger diameter than the bearing 38, and the bearing 38 and the cylindrical guide 13*a*R are coupled by a disk member 13*a*R3. The cylindrical guide 13*a*R is coupled with the flange 13*a*R1, and therefore, the cylindrical guide 13*a*R and the bearing 38 are reinforced and stiffened by each other. Since the right-hand cylindrical guide 13*a*R has a large diameter, it has enough durability against the repeated mounting-and-demounting of the process cartridge B relative to the image forming apparatus, although it is made of a synthetic resin material.

Figure 36:
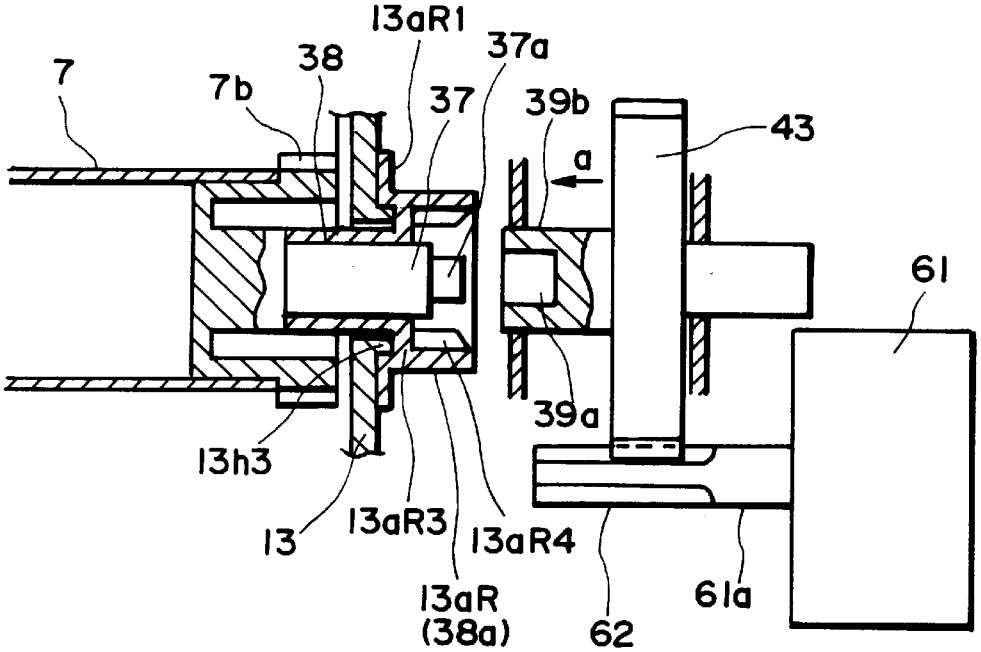
FIG. 36 is an exploded section of the drum bearing portion in one of the embodiments of the present invention.
Figure 37:
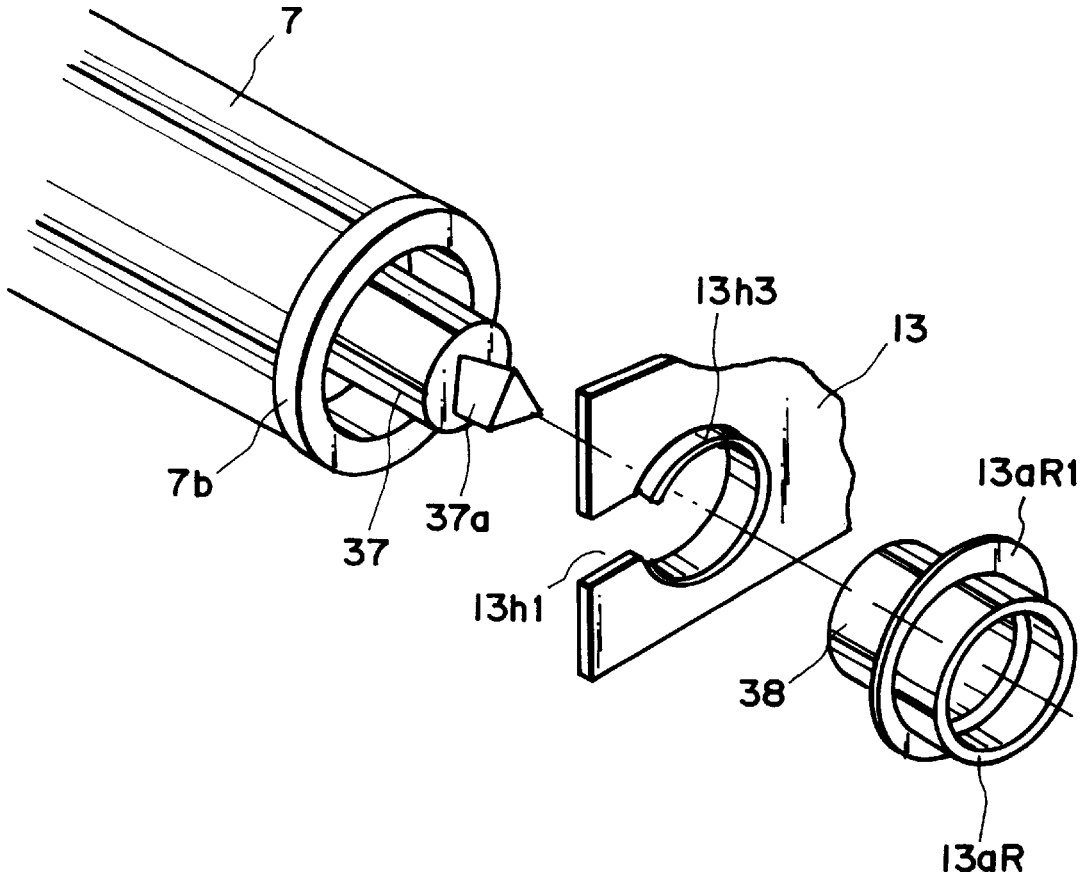
FIG. 37 is an exploded schematic view of the drum bearing portion.

FIGS. 36, 37 are developed views in the longitudinal section illustrating another mounting method of the bearing 38 integral with the right-hand guiding member 13R to the cleaning frame 13.

These are schematic views and show the bearing 38 of the photosensitive drum 7 as a major part.

As shown in FIG. 36, there is provided a rib 13*h*3 extended circumferentially at the outside edge of the bearing mounting hole 13*h*, and the outer periphery of the rib 13*h*3 is a part of a cylindrical configuration. In this example a portion of the right-hand cylindrical guide 13*a*R extended beyond the disk member 13*a*R3 to the flange 13*a*R1, is closely fitted around the outer periphery of the rib 13*h*3. The bearing mounting portion 13*h* and the outer periphery of the bearing 38 are loosely fitted. With this structure, although the bearing mounting portion 13*h* is non-continuous because of the lacking circle portion 13*h*1, opening of the lacking circle portion 13*h*1 can be prevented.

For the same purpose, a plurality of confining bosses 13*h*4 may be provided at the outer periphery of the rib 13*h*3, as shown in FIG. 34.

The confining boss 13*h*4 is manufactured by metal molding with the following accuracy, for example; IT tolerance of 9, the grade for the circumscribed circle diameter, and a concentricity of −0.01 mm or less relative to the inside circumference of the mounting hole 13*h*.

When the drum bearing 38 is mounted to the cleaning frame 13, an inner peripheral surface 13*a*R5 of the drum bearing 38 opposed to the outside circumference confines the confining boss 13*h*4 of the cleaning frame 13, while the mounting hole 13*h* of the cleaning frame 13 and the outside circumference of the bearing 38 are engaged, so that possible misalignment during assembling due to opening of the lacking circle portion 13*h*1 can be prevented.

(Structure for Connecting Cleaning Chamber Frame (Drum Chamber Frame) and Image Developing Chamber Frame)

As stated previously, the cleaning chamber frame 13 and image developing chamber frame 12 of the process cartridge B are united after the charging roller 8 and the cleaning means 10 are assembled into the cleaning chamber frame 13 and the developing means 9 is assembled into the image developing chamber frame 12.

The essential characteristics of the structure which unites the drum chamber frame 13 and the image developing chamber frame 12 will be described below with reference to FIGS. 12, 13 and 32. In the following description, "right-hand side and left-hand side" mean the right-hand side and left-hand side as seen from above, with reference to the direction in which the recording medium 2 is conveyed.

The process cartridge removably installable in the main assembly 14 of an electrophotographic image forming apparatus comprises: an electrophotographic photosensitive drum 7; a developing means 9 for developing a latent image formed on the electrophotographic photosensitive drum 7; an image developing chamber frame 12 which supports the developing means 9; a drum chamber frame 13 which supports the electrophotographic photosensitive drum 7; a toner chamber frame 11 which houses a toner storing portion; a compression type coil spring, one end of which is attached to the image developing chamber frame 12, being located above one of the lengthwise ends of the developing means, and the other end of which is in contact with the drum chamber frame 13; a first projection (right-hand side arm portion 19) projecting from the image developing chamber frame 12 in the direction perpendicular to the lengthwise direction of the developing means 9, being located above the lengthwise end of the developing means 9; a second projection (left-hand side arm portion 19); a first hole (right-hand side hole 20) of the first projection; a second hole (left-hand side hole 20) of the second projection; a first joint portion (recessed portion 21 on the right-hand side) which is located in the right-hand side lengthwise end of the drum chamber frame 13, above the electrophotographic photosensitive drum 7, and engages with the first projection (arm portion 19 on the right-hand side); a second joint portion (recessed portion 21 on the left-hand side) which is located in the left-hand side lengthwise end of the drum chamber frame 13, above the photosensitive drum 7, and is engaged with the second projection (arm portion 19 on the left-hand side); a third hole (hole 13*e* illustrated on the right-hand side in FIG. 12) of the first joint portion (recessed portion 21 on the right-hand side); a fourth hole (hole 13*e* illustrated on the left-hand side in FIG. 12) of the second joint portion (recessed portion 21 on the left-hand side); a first penetration member (joining member 22 on the right-hand side in FIG. 12) which is put through the first hole (right hole 20 and the third hole (right hole 13*e*)), with the first projection (right arm portion 19) and the first joint portion (right recessed portion 21) being engaged with each other, to connect the drum chamber frame 13 and the image developing chamber frame 12; a second penetrating member (joining member 22 on the left-hand side in FIG. 12) which is put through the second hole (left hole 20) and the fourth hole (left hole 13*e*), with the second projection (left arm portion 19) and the second joint portion (left recessed portion 21) being engaged with each other, to connect the drum chamber frame 13 and the image developing chamber frame 12.

The image developing chamber frame 12 and drum chamber frame 13 of the process cartridge B, which are structured as described above, are joined through the following steps: a first joining step for joining the first projection (right arm portion 19) of the image developing chamber frame 12 and the first joint portion (right recessed portion 21) of the drum chamber frame 13; a second joining step for joining the second projection (left arm portion 19) and the second joint portion (left recessed portion 21); a first penetrating step for putting the first penetrating member (right joining member 22) through the first hole (right hole 20) of the first projection (right arm portion 19) and the third hole (right hole 13*e*) of the first joint portion (right recessed portion 21), with the first projection (right arm portion 19) and the first joint portion (right recessed portion 21) being engaged with each other, to connect the drum chamber frame 13 and the image developing chamber frame 12; and a second penetrating step for putting the second penetrating member (left joining member 22) through the second hole (left hole 30) of the second projection (left arm portion 19) and the fourth hole (left hole 20) of the second joint portion (left recessed portion 21), with the second projection (left arm portion 19) and the second joint portion (left recessed portion 21) being engaged with each other, to connect the image developing chamber frame 12 and the drum chamber frame 13. After being joined with each other through the above described steps, the image developing chamber frame 12 and the drum chamber frame 13 together constitute the process cartridge B.

According to this embodiment, the image developing chamber frame 12 and the drum chamber frame 13 can be easily joined simply by putting the joining member 22 elements through their connective portions, and also can be easily separated simply by pulling the joining member 22 out, as is evident from the above description.

Among the above described steps, the developing means 9 comprises the developing roller 9*c* in advance, and the first joining step for joining the first projection and the first joint portion, and the second joining step for joining the second projection and the second joint portion, are carried out at the same time, wherein (1) the photosensitive drum 7 and the developing roller 9*c* are held in parallel;

(2) the developing roller 9*c* is moved along the peripheral surface of the photosensitive drum 7;

(3) the image developing chamber frame 12 is rotatively moved as the developing roller 9*c* is moved;

(4) the first and second projections (arm portions 19 on the right- and left-hand sides) enter the first and second joint portions (recesses 21 on the right- and left-hand sides) due to the rotative movement of the image developing chamber frame 12; and (5) the first and second projections (both arm portions 19) fully engage with the first and second joint portions (both recessed portions 21).

With the above steps being strictly followed, the arm portion 19 can be moved toward the recessed portion 21 by circularly moving the developing roller 9*c* along the peripheral surface of the photosensitive drum 7, with lengthwise ends of the photosensitive drum 7 having been already fitted with the spacer roller 9*i*. Thus, the point at which the arm portion 19 and the recessed portion 21 join becomes fixed. Therefore, the configuration of the arm portion 19 and the recessed portion 21 can be designed to make it easier to align the hole 20 of the arm portion 19 of the image developing chamber frame 12 and the holes 13*a* of both side walls of the recessed portion 21.

As stated previously, it is common practice to unite the image developing unit D and the cleaning unit C after the image developing unit D is formed by joining the toner chamber frame 11 and image developing chamber frame 12, and the cleaning chamber frame 13 and the charging roller 8 are assembled into the cleaning unit C.

The image developing chamber frame 12 and the drum chamber frame 13 are designed so that the holes 20 of the first and second projections, respectively, and the holes 13*e* of the first and second joint portions, respectively, become substantially aligned as the image developing chamber frame 12 and the drum chamber frame 13 are placed in contact with each other following the steps described above.

Figure 32:
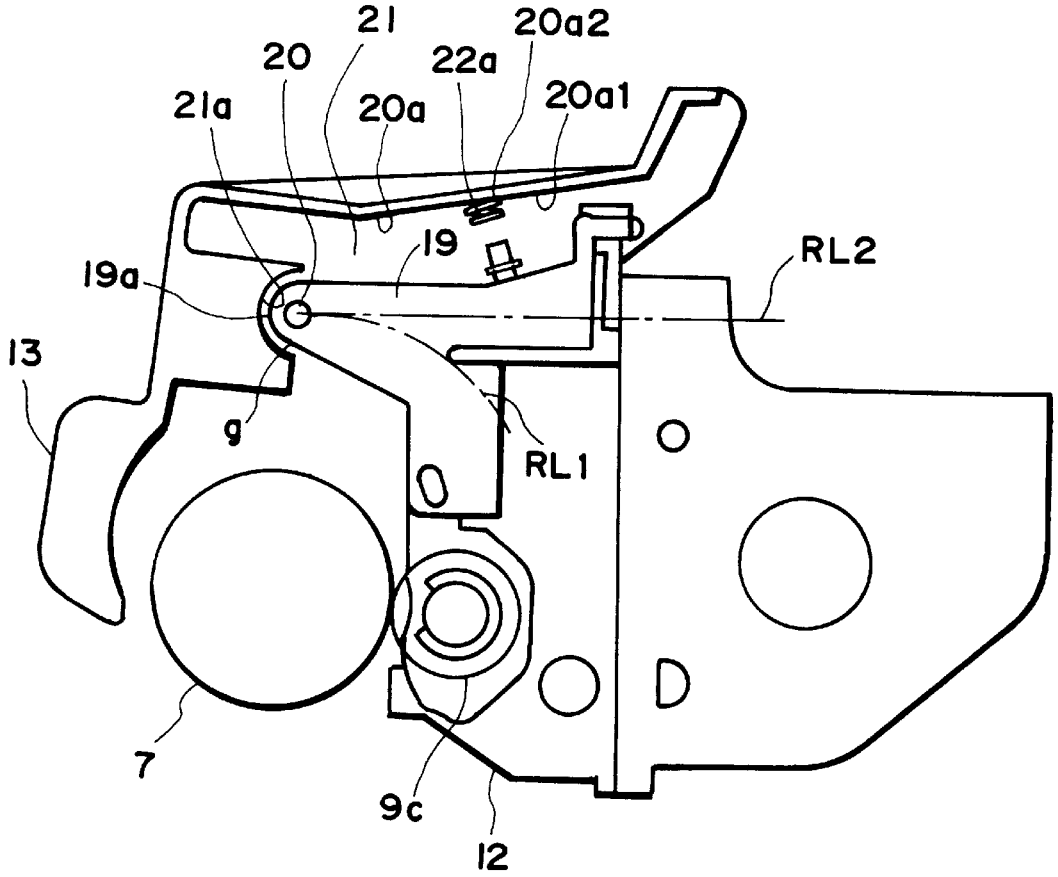
FIG. 32 is a vertical section of the joint between the drum chamber frame and the image developing chamber fame.

Referring to FIG. 32, the profile of the tip 19*a* of the arm portion 19 forms an arc whose center coincides with the center of the hole 20, and the profile of the bottom portion 21*a* of the recessed portion 21 forms an arc whose center coincides with the center of the hole 13*e*. The radius of the arc-shaped portion of the tip 19*a* of the arm portion 19 is slightly smaller than the radius of the arc-shaped bottom portion 21*a* of the recessed portion 21. This slight difference in radius between the arm portion 19 and the recessed portion 21 is such that when the bottom 21*a* of the recess is placed in contact with the tip 19*a* of the arm portion 19, the joining member 22 with a chamfered tip can be easily put through the hole 13*e* of the drum chamber frame 13 (cleaning chamber frame 13) and then inserted into the hole 20 of the arm portion 19. As the joining member 22 is inserted, an arc-shaped gap is formed between the tip 19 of the arm portion 19 and the bottom 21*a* of the recessed portion 21, and the arm portion 19 is rotatively supported by the joining member 22. The gap g in FIG. 32 is exaggerated for ease of depiction, but the actual gap g is smaller than the size of the chamfered portion of the tip of the joining member 22 or the size of the chamfered edge of the hole 20.

Also referring to FIG. 32, when the image developing chamber frame 12 and drum chamber frame 13 are joined, they are moved so that the hole 20 of the arm portion 19 forms a locus RL1 or RL2, or a locus which falls between the loci RL1 and RL2. The interior surface 20*a* of the top wall of the recessed portion 21 is angled so that the compression type coil spring 22*a* is gradually compressed as the image developing chamber frame 12 and drum chamber frame 13 are moved toward each other as described above. In other words, the image developing chamber frame 12 and the drum chamber frame 13 are shaped so that as they are moved toward each other as described above, the distance between the portion of the image developing chamber frame 12, to which the compression type spring 22*a* is attached, and the aforementioned interior surface 20*a* of the top wall of the recessed portion 21, is gradually reduced In this embodiment, the top end of the compression type coil spring 22*a* comes in contact with a portion 20*a*1 of the slanted interior surface 20*a* in the middle of the joining process, and after the image developing chamber frame 12 and the drum chamber frame 13 are completely joined, the compression type coil spring 22*a* remains in contact with a spring seat portion 20*a*2 of the slanted interior surface 20*a,* which continues from the slanted portion 20*a*1. The axial line of the compression type coil spring 22*a* and the plane of the spring seat portion 20*a*2 perpendicularly intersect.

Because the image developing chamber frame 12 and the drum chamber frame 13 are structured as described above, it is unnecessary to compress the compression type coil spring 22*a* with the use of a dedicated compression means when the image developing chamber frame 12 and the drum chamber frame 13 are united; the spring 22*a* is automatically placed in a proper position to press the developing roller 9*c* against the photosensitive drum 7. In other words, the compression type coil spring 22*a* can be attached to the spring seat 12*t* of the image developing chamber frame 12 before the image developing chamber frame 12 and the drum chamber frame 13 are united.

The locus RL1 coincides with a circle whose center coincides with the center of the crosssection of the photosensitive drum 7, and the locus RL2 is substantially a straight line whose distance from the slanted surface 20*a*1 gradually reduces from the right-hand side of the drawing toward the left-hand side.

Figure 31:
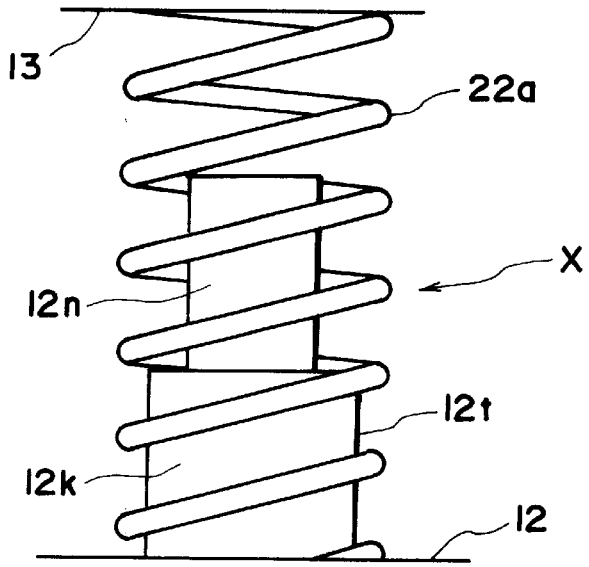
FIG. 31 is a side view of a compression type coil spring and its mount.

Referring to FIG. 31, the compression type coil spring 22*a* is held by the image developing chamber frame 12. FIG. 31 is a vertical section of the image developing chamber frame 12, at a vertical plane passed through the base of the arm portion 19, parallel to the direction X in which the process cartridge B is inserted. The image developing chamber frame 12 has the spring holding portion 12*t* which protrudes upward from the top surface of the image developing chamber frame 12. This spring holding portion 12*t* comprises at least a spring holding cylindrical base portion 12*k* around which the compression type coil spring 22*a* is press-fitted, and a guide portion 12 which is given a smaller diameter than the base portion 12*k* so that the compression type coil spring 22*a* can be loosely fitted around it. The height of the spring holding base portion 12*k* must be greater than the height at which the bottommost loop of the compression type coil spring 22*a* reaches when the compression type coil spring 22*a* is in the least compressed state, and is desirable to be the height the second loop of the spring 22*a* reaches, or greater.

Referring to FIG. 12, the recessed portion 21 is between the external wall 13*s* of the drum chamber frame 13 and a partitioning wall 13*t* located slightly inward of the external wall 13*s*.

As regards the right-hand side recessed portion 21 of the drum chamber frame 13, which is located on the same lengthwise end of the drum chamber frame 13 as the drum gear 7*b,* the inward facing surface of the external wall 13*e* and the outward facing surface of the partitioning wall 12*t,* that is, the opposing two surfaces of the recessed portion 21, are perpendicular to the lengthwise direction of the drum chamber frame 13, and the arm portion 19 of the image developing chamber frame 12, which is located on the same lengthwise end of the image developing chamber frame 12 as the development roller gear 9*k,* exactly fits between these opposing two surfaces. On the other hand, the left-hand side recessed portion 21 of the drum chamber frame 13, which is located on the same lengthwise end of the drum chamber frame 13 as the spur gear 7*n,* and the arm portion 19 of the image developing chamber frame 12, which is inserted into this left-hand side recessed portion 21, loosely fit in terms of the lengthwise direction of the process cartridge B.

Therefore, the image developing chamber frame 12 and the cleaning chamber frame 13 are accurately positioned relative to each other in terms of the lengthwise direction of the process cartridge B. More specifically, this is due to the following reasons. It is easy to manufacture a drum chamber frame 13 having a precise distance between the opposing surfaces of the recessed portion 21 located at the lengthwise end of the drum chamber frame 13, and also an image developing chamber frame 12 having an arm portion 19 with an accurate width. Further, even when the measurement of the image developing chamber frame 12 and cleaning chamber frame 13 in the lengthwise direction thereof change due to their deformation caused by a temperature increase, the distance between the opposing two surfaces of the recessed portion 21, and the width of the arm portion 19 which fits between these opposing two surfaces, scarcely change, due to their small measurements. In addition, the recessed portion 21 located on the same side as the spur gear 7*n,* and the arm portion 19 which is fitted into this recessed portion 21, are provided with a play in the lengthwise direction of the process cartridge B, and therefore, even if the measurements of the image developing chamber frame 12 and cleaning chamber frame 13 in their lengthwise direction change due to their thermal deformation, no stress occurs between the image developing chamber frame 12 and the cleaning chamber frame 13 due to their thermal deformation.

In this embodiment, the process cartridge B was described as a process cartridge which forms a monochromatic image, but the present invention is applicable, with desirable effects, to a process cartridge which comprises a plurality of developing means for forming an image composed of a plurality of colors (for example, a two toner image, three tone images, a full color image, or the like).

The electrophotographic photosensitive member does not need to be limited to the photosensitive drum 7. For example, the following types may be included. First, as for the photosensitive material, a photoconductive material such as amorphous silicon, amorphous selenium, zinc oxide, titanium oxide, an organic photoconductor, and the like, may be included. As for the configuration of the base member on which the photosensitive material is placed, it may be in the form of a drum or belt. For example, the drum type photosensitive member comprises a cylinder formed of an aluminum alloy or the like, and a photoconductor layer deposited or coated on the cylinder.

As for the image developing method, various known methods may be employed; for example, a two-component magnetic brush type developing method, a cascade type developing method, a touch-down type developing method, a cloud type developing method, and the like.

Also, in this embodiment, a so-called contact type charging method was employed, but obviously, charging means with a structure different from the one described in this embodiment may be employed; for example, one of the conventional structures, in which a tungsten wire is surrounded-by a metallic shield formed of aluminum or the like, on three sides, and positive or negative ions generated by applying a high voltage to the tungsten wire are transferred onto the surface of a photosensitive drum to uniformly charge the surface of the photosensitive drum.

The charging means may be in the form of a blade (charge blade), a pad, a block, a rod, a wire, or the like, in addition to being in the form of a roller.

As for the method for cleaning the toner remaining on the photosensitive drum, a blade, a fur brush, a magnetic brush, or the like may be employed as a structural member for the cleaning means.

Figure 40:
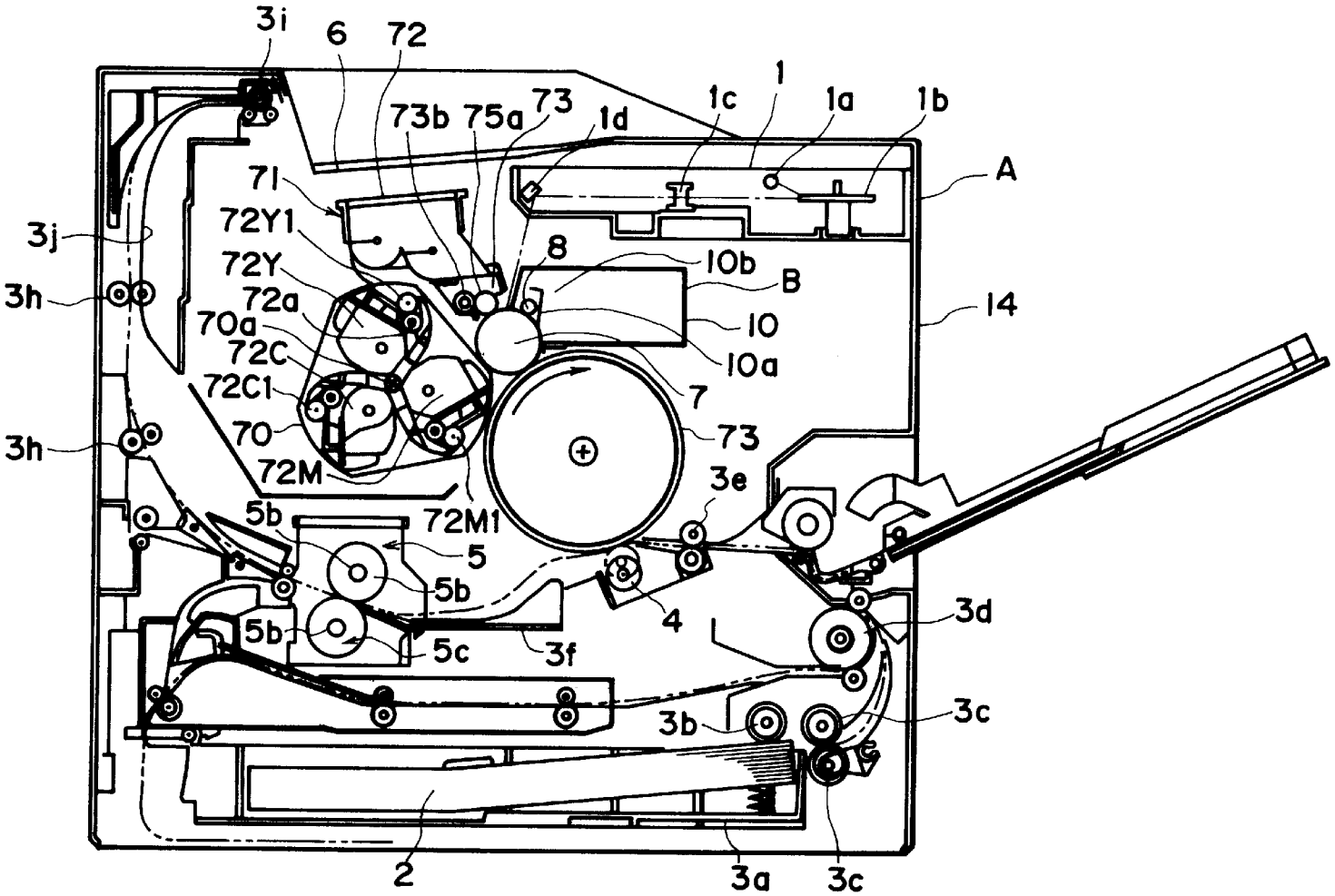
FIG. 40 is a vertical section of a typical multicolor image forming apparatus.

FIG. 40 is a vertical section of a multi-color image forming apparatus A to which the present invention is applicable. In the figure, the members and portions, which have the same functions as those illustrated in FIG. 1 are designated with the same reference symbols.

The process cartridge B comprises a photosensitive drum 7, a charging roller 8 for uniformly charging the photosensitive drum 7, and a cleaning means 10 for removing the toner which remains on the photosensitive drum 7 after an image transfer process. It is removably installable in the apparatus main assembly 14 as the monochromatic image forming apparatus in FIG. 1 is.

A development rotary member 70 is lockably rotatable about a selectively lockable shaft 70*a*. It rotatably holds the image developing devices 72Y, 72C and 72M, wherein any of the image developing rollers 72Y1, 73C1 and 72M of the corresponding image developing devices 72Y, 72C and 72M, can be lockably rotated to a position at which the image developing roller of the selected image developing device squarely opposes the photosensitive drum 7, holding a predetermined development gap from the photosensitive drum 7, and another position at which none of the image developing devices squarely opposes the photosensitive drum 7.

A black image developing apparatus 71 is provided with guides, and is removably installable into the apparatus main assembly 14, with the guides being fitted in the corresponding guide members of the apparatus main assembly 14.

Next, the general operation of the above image forming apparatus will be described. First, an optical system 1 focuses a laser beam, which corresponds to the yellow color component of a target image, on the photosensitive drum 7, uniformly charged by the charging roller 8. As a result, a latent image corresponding to the yellow color component of the target image is formed on the photosensitive drum 7. Then, the developing device rotary member 70 having been rotated in advance to lock the yellow color developing device 72Y at a predetermined position at which the image developing roller 72Y1 squarely opposes the photosensitive drum 7 adheres yellow toner to the latent image on the photosensitive drum 7, forming a toner image of yellow color. This toner image of yellow color is transferred onto a transfer drum 73 by giving an electrical charge, which has a polarity opposite to that of the yellow toner image on the photosensitive drum 7, from an unillustrated transfer charger to the transfer drum 73 which is rotating together with the photosensitive drum 7.

Next, the optical system 1 focuses a laser beam, which corresponds to the cyan color component of the target image, on the photosensitive drum 7, uniformly charged by the charging roller 8. Then, a cyan toner image formed on the photosensitive drum 7 in the same manner as the yellow toner image is transferred onto the transfer drum 73 in such a manner that the cyan toner image is superimposed on the yellow toner image in alignment with the yellow toner image. Then, a magenta color image is formed on the photosensitive drum 7 in the same manner as the preceding two color toner images, and is superimposed onto the yellow and cyan toner images on the transfer drum 73. Thereafter, the developing device rotary member 70 is lockably rotated by a predetermined angle so that none of the color developing devices 72T, 72C and 72M squarely opposes the photosensitive drum 7.

Next, the optical system 1 forms a latent image on the photosensitive drum 7 by projecting a laser beam, which corresponds to the black color component portion of the target image, onto the photosensitive drum 7. This latent image is developed into a black toner image by the black image developing apparatus 71. Then, the black toner image is transferred, in the superimposing manner, onto the yellow toner image, the cyan toner image, and the magenta toner image on the transfer drum 73. As a result, a full-color toner image is formed on the transfer drum 73.

Thereafter, while a recording medium 2, conveyed from a position outlined by a solid line, following the double-dot chain line, is passed between the transfer drum 73 and the image transferring roller 4, the full-color toner image on the transfer drum 73 is transferred onto the recording medium 2 by applying a voltage, which has a polarity opposite to that of the toner image on the transfer drum 73, to the transfer roller 4. After the image transfer, the unfixed full-color toner image on the recording medium 2 is fixed to the recording medium 2 by a fixing means 5, and the recording medium 2 is discharged into a tray 6 through a sheet reversing path 3*j*.

Figure 41:
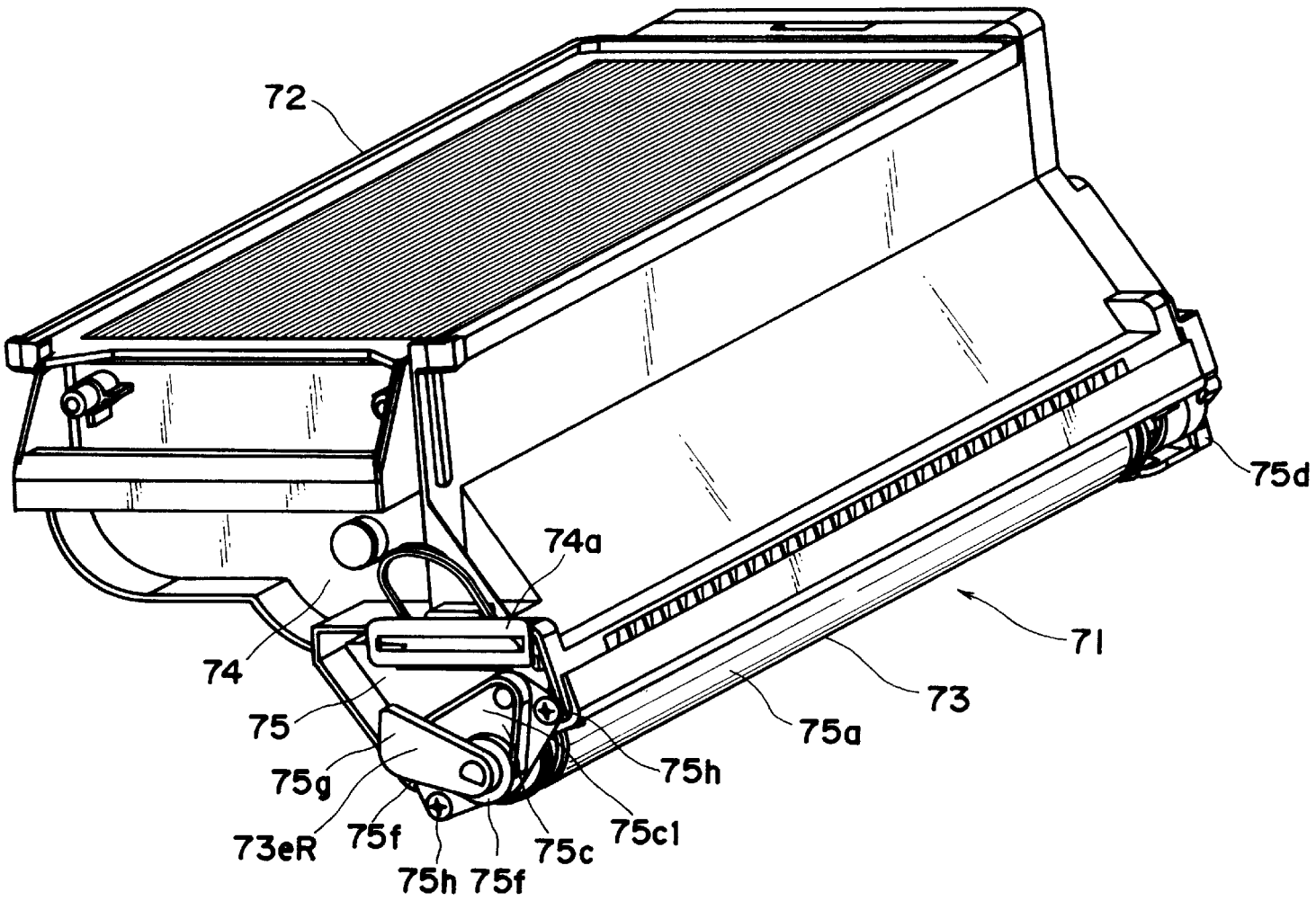
FIG. 41 is a perspective view of the black-and-white image developing section of the apparatus illustrated in FIG. 40.
Figure 42A:
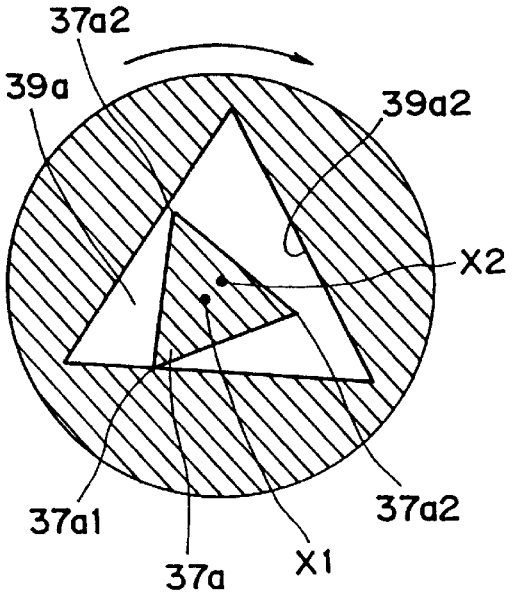
FIGS. 42(*a*) and 42(*b*) are each a crosssection of the coupling portion, depicting the centering mechanism thereof.
Figure 42B:
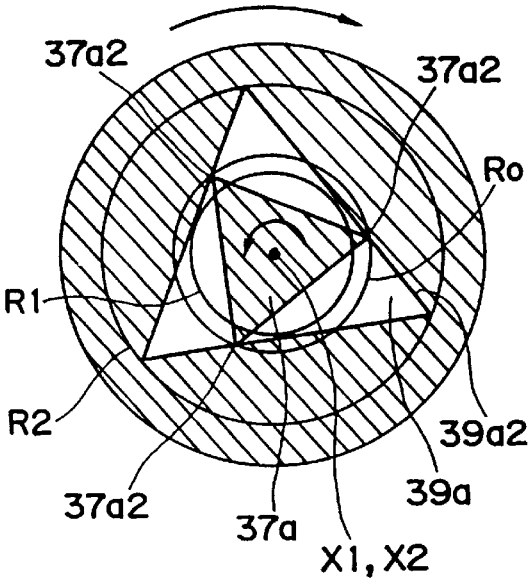

FIG. 41 is a perspective view of the black image developing apparatus 71. The black image developing apparatus is made by uniting a toner container 72 and an image developing device 73; it is made by joining a toner chamber section 74 which holds black toner, and an image developing chamber section 75 containing an image developing member. In order to keep sealed the toner within the toner chamber section 74, the opening between the toner chamber section 74 and the image developing chamber section 75 is closed with a sealing member (unillustrated) in the form of a sheet; the sealing member is adhered to cover the opening. The opening can be unsealed by pulling a grip 74*a* attached to one end of the sealing member, which is outwardly extended from the black image developing apparatus 71.

The black image developing apparatus 71 comprises a member for adhering, to a proper thickness, the toner, which has been given a proper amount of triboelectrical charge, onto the image developing roller 75*a,* from which the toner is adhered to the photosensitive drum 7. This member is disposed within the image developing chamber section 75 of the apparatus frame (a description thereof will be omitted).

The black image developing apparatus 71 in FIG. 41 comprises an image developing roller 75*a,* an image developing chamber frame section 75, image developing roller supporting members 75*c* and 75*d,* and a toner chamber frame section 74.

In this black image developing apparatus 71, the shaft portion (unillustrated) of the image developing roller 75, which is located at both lengthwise ends of the roller 75, fits in the bearing portion of an image developing roller supporting member 75*c* (or 75*d*), with the provision of a predetermined play. Therefore, the image developing roller 75*a* is rotatively supported relative to the image developing chamber frame section 75. In this embodiment, in order to prevent an increase in the frictional resistance and wear which occur as the shaft portion of the image developing roller 75*a* rubs against the bearing portion of the image developing roller supporting member 75*c* (or 75*d*), polyacetal, which has lubricative properties, was employed as the material for the image developing roller supporting members 75*c* and 75*d.*

On the other hand, the image developing roller supporting members 75*c* and 75*d* are provided with guides 75*e*R and 75*e*L, respectively, for regulating the rotation of the image developing apparatus when the image developing apparatus is inserted or extracted (75*e*L is not visible in the drawing). Referring to FIG. 41, the configurations of the rotation regulating guides 75*e*R and 75*e*L are such that they project outward approximately 8 mm from the surfaces 75*c*1 and 75*d*1 (75*d*1 is not visible in the drawing) of the image developing roller supporting members 75*c* and 75*d,* respectively. Referring to FIG. 40, when the black image developing apparatus 71 is inserted to, or removed from, its operating position in the image forming apparatus main assembly 14, the bottom surfaces 75*f* of the image developing roller supporting members 75*c* and 75*d,* respectively, slide against the top surfaces of the corresponding guides (unillustrated) of the apparatus main assembly 14, to regulate the vertical movement and attitude of the black image developing apparatus 71, and the side surfaces 75*g* of the guides 73*e*R and 74*e*L, respectively, slide against the corresponding insertion-removal guides (unillustrated) of the apparatus main assembly 14, to regulate the position of the black image developing apparatus 71 relative to its lengthwise direction, contributing to a smooth insertion or extraction of the black image developing apparatus 71.

The image developing supporting members 75*c* and 75*d* are fixed to the image developing chamber section 75 using small screws 75*h*.

Also, in this embodiment, the image developing roller supporting members 75*c* and 75*d* are members independent from the image developing chamber section 75. Therefore, the guides 73*e*R and 75*e*L which axially support the image developing roller 75*a,* and also regulate the rotation of the black image developing apparatus 71 when the black image developing apparatus 71 is inserted into, or removed from, the apparatus main assembly 14, can be made of polyacetal, polyamide, or the like, which has desirable resistance against frictional wear, whereas an inexpensive material can be employed as the material for the image developing chamber frame section 75, contributing to the recycling of the image developing chamber frame section 75. Further, the configuration of the image developing chamber frame section 75 can be simplified, which in turn affords simplification of metallic molds for resin molding. Also, as described above, the image developing roller supporting members 75*c* and 75*d* can be fixed to the image developing chamber frame 75 using a small number of small screws. In addition, since the guides or guiding portions of the image developing chamber frame 75 do not project far from the image developing chamber frame 75, handling breakage which, otherwise, occurs to them during manufacturing, can be prevented.

According to the embodiments described in the foregoing, the process cartridge can be assembled through a small number of steps, and each step is simple.

According to the foregoing embodiments, the manufacturing process includes a first engaging process of engaging a first projected portion and a first engaging portion, and a second engaging process of engaging the second projected portion and the second engaging portion, and the these processes are carried out simultaneously, so that assembling is easy and quick.

According to the foregoing embodiments, the drum frame and the developing device frame are confined rotatably about a penetrating member. When the process cartridge is recycled, the developing device frame and the drum frame are separated only by removing the penetrating member.

According to the foregoing embodiments, the contact portion of the drum frame with the compression spring, is continuous such that during assembling, the compression amount of the compression spring gradually increases, so that there is no need of compressing the spring separately assembling it.

According to the foregoing embodiments, there is provided a guide portion, so that compression coil spring is firmly fixed to the developing device frame during assembling and disassembling, so that compression coil spring can be correctly aligned.

According to the foregoing embodiments, the first projected portion of the developing device frame and the first engaging portion of the drum frame, are closely engaged in the longitudinal direction, and the second projected portion of the developing device frame and the second engaging portion of the drum frame, are loosely engaged, so that developing device frame and the drum frame are aligned in the longitudinal direction at one longitudinal end, so that correct alignment is accomplished. Even if the process cartridge is deformed by heat by temperature change, the elongation shrinkage occurs in the longitudinal direction with the first projected portion and the first engaging portion where they are correctly positioned relative to each other, are fixed, but the thermal stress is not produced since the second projected portion and the second engaging portion are loosely engaged. Thus, according to the present invention, the assembling operativity is improved.

While the invention has been described with reference to the structures disclosed herein, it is not confined to the details set forth and this application is intended to cover such modifications or changes as may come within the purposes of the improvements or the scope of the following claims.

What is claimed is:

1. An assembling method of a process cartridge detachably mountable to a main assembly of an electrophotographic image forming apparatus, comprising:

(a) providing a drum frame supporting an electrophotographic photosensitive drum and having a first engaging portion above said electrophotographic photosensitive drum adjacent one longitudinal end of said electrophotographic photosensitive drum, and a second engaging portion above said electrophotographic photosensitive drum adjacent the other longitudinal end of said electrophotographic photosensitive drum;

(b) providing a developing device frame supporting a developing member for developing a latent image formed on said electrophotographic photosensitive drum, and having a first compression spring and a second compression spring above said developing member adjacent one and the other longitudinal ends of said developing member, and a first projected portion and a second projected portion projected in a direction crossing with a longitudinal direction of said developing member adjacent the one and the other longitudinal ends of said developing member;

(c) an engaging step of engaging said first projected portion and said first engaging portion and engaging said second projected portion and said second engaging portion;

(d) a penetration step of (i) penetrating a first penetrating member through a first opening, which is formed in said first projected portion, and a third opening and a fifth opening formed in said first engaging portion, said third opening and said fifth opening being opposed to each other with said first projected portion therebetween when said first projected portion and said first engaging portion are engaged with each other, said first penetrating member entering said third opening, then said first opening and then said fifth opening, and (ii) penetrating a second penetrating member through a second opening, which is formed in said second projected portion, and a fourth opening and a sixth opening formed in said second engaging portion, while said second projected portion and said second engaging portion are engaged with each other, so as to couple said drum frame and developing device frame, said fourth opening and said sixth opening being opposed to each other with said second projected portion therebetween when said second projected portion and said second engaging portion are engaged with each other, and said second penetrating member entering said fourth opening, then said second opening and then said sixth opening.

2. A method according to claim 1, wherein said developing member is in the form of a developing roller, and the engaging of said first projected portion and said first engaging portion and the engaging of said second projected portion and said second engaging portion are substantially simultaneously carried out.

3. A method according to claim 1 or 2, wherein prior to combination between said drum frame and said developing device frame, a toner frame including a toner accommodating portion for accommodating toner to be used for development of the latent image by said developing member, is coupled to said developing device frame.

4. A process cartridge detachably mountable to a main assembly of an electrophotographic image forming apparatus, comprising:

an electrophotographic photosensitive drum;

a developing member for developing a latent image formed on said electrophotographic photosensitive drum;

a developing device frame for supporting said developing member;

a drum frame for supporting said electrophotographic photosensitive drum;

a toner frame having a toner accommodating portion for accommodating toner to be used for development of the latent image by said developing member;

a compression spring having an end mounted to a portion of said developing device frame above said developing member adjacent one and the other longitudinal ends of said developing member, and having the other end contacted to said drum frame;

a first projected portion and a second projected portion projected, in a direction crossing with a longitudinal direction of said developing member from a portion of said developing device frame adjacent each of the one and the other longitudinal ends of said developing member;

a first opening formed in said first projected portion;

a second opening formed in said second projected portion;

a first engaging portion, provided on said drum frame above said electrophotographic photosensitive drum adjacent one longitudinal end of said drum frame, for engaging with said first projected portion;

a second engaging portion, provided on said drum frame above said electrophotographic photosensitive drum adjacent the other longitudinal end of said drum frame, for engaging with said second projected portion;

a third opening formed in said first engaging portion;

a fourth opening formed in said second engaging portion;

a first penetrating member penetrating through said first opening and said third opening while said first projected portion and said first engaging portion are engaged with each other, to couple said drum frame and said developing device frame;

a second penetrating member penetrating through said second opening and said fourth opening while said second projected portion and said second engaging portion are engaged with each other, to couple said drum frame and said developing device frame.

5. A process cartridge according to claim 4, wherein when said first projected portion and said first engaging portion, and said second projected portion and said second engaging portion, are engaged, respectively, said first projected portion and said first engaging portion, and said second projected portion and said second engaging portion, respectively, are substantially aligned in a direction crossing with the longitudinal direction, and said first opening and said third opening, and said second opening and fourth opening, respectively are aligned to such an extent that said first and second penetrating members can be penetrated.

6. A process cartridge according to claim 4, wherein when said developing device frame and said drum frame are assembled, said compression spring urges, about the penetrating member, said developing device frame and said drum frame in a direction of press-contacting said photosensitive drum and a developing roller of said developing member to each other, and wherein a contact portion of said drum frame with said compression spring is continuous to increase the compression amount of the compression spring.

7. A process cartridge according to claim 4, wherein said compression spring is a coil spring, said developing device frame has a spring holding portion integral with and projected from said developing device frame, and said spring holding portion has, at a base side, a cylindrical fixed portion onto which an inside of said compression coil spring is fitted, and a guide portion having a smaller diameter than the base portion and inserted halfway therethrough.

8. A process cartridge according to claim 4, wherein said first projected portion and said first engaging portion are closely engaged in the longitudinal direction, and said second projected portion and said second engaging portion are loosely engaged in the longitudinal direction.

9. A process cartridge according to claim 5, wherein the first and second openings of said first and second projections are cylindrical and have arcuate projections coaxial with the cylindrical shape, and the third and fourth openings of said first and second engaging portions are cylindrical and have arcuate recesses coaxial with the cylindrical shape, and a radius of said recesses is larger than a radius of said projections by a difference from a radius of each of said openings.

10. A process cartridge according to any one of claims 4 to 9, wherein said process cartridge further includes as a unit a charging member, a cleaning member, said developing member and said electrophotographic photosensitive drum.

11. A process cartridge according to any one of claims 4 to 9, wherein said process cartridge further includes as a unit at least a charging member or a cleaning member.

12. A process cartridge according to claim 4, wherein said first engaging portion is provided with a fifth opening opposed to said third opening, and said second engaging portion is provided with a sixth opening opposed to said fourth opening, wherein said first penetrating member penetrates through said first, third, and fifth openings, and said second penetrating member penetrates through said second, fourth and sixth opening.

13. An electrophotographic image forming apparatus for forming an image on a recording material, to which a process cartridge is detachably mountable, said apparatus comprising:

a. mounting means for mounting said process cartridge, said process cartridge comprising:

an electrophotographic photosensitive drum;

mounting means for detachably mounting the process cartridge, said process cartridge including:

a developing member for developing a latent image formed on said electrophotgraphic photosensitive drum;

a developing device frame for supporting said developing member;

a drum frame for supporting said electrophotographic photosensitive drum;

a toner frame having a toner accommodating portion for accommodating toner to be used for development of the latent image by said developing member;

a compression spring having an end mounted to a portion of said developing device frame above said developing member adjacent one and the other longitudinal ends of said developing member, and having the other end contacted to said drum frame;

a first projected portion and a second projected portion projected, in a direction crossing with a longitudinal direction of said developing member, from a portion of said developing device frame adjacent each of the one and the other longitudinal ends of said developing member;

a first opening formed in said first projected portion;

a second opening formed in said second projected portion;

a first engaging portion, provided on said drum frame above said electrophotographic photosensitive drum adjacent one longitudinal end of said drum frame, for engaging with said first projected portion;

a second engaging portion, provided on said drum frame above said electrophotographic photosensitive drum adjacent the other longitudinal end of said drum frame, for engaging with said second projected portion;

a third opening formed in said first engaging portion;

a fourth opening formed in said second engaging portion;

a first penetrating member penetrating through said first opening and said third opening while said first projected portion and said engaging portion are engaged with each other, to couple said drum frame and developing device frame; and a second penetrating member penetrating through said second opening and said fourth opening while said second projected portion and said second engaging portion are engaged with each other, to couple said drum and developing device frame; and b. a feeding member for feeding said recording material.

14. A process cartridge according to claim 13, wherein said first engaging portion is provided with a fifth opening opposed to said third opening, and said second engaging portion is provided with a sixth opening opposed to said fourth opening, wherein said first penetrating member penetrates through said first, third and fifth openings, and said second penetrating member penetrates through said second, fourth and sixth openings.

15. A method of assembling a process cartridge detachably mountable to a main assembly of an electrophotographic image forming apparatus, comprising:

(a) providing a drum frame supporting an electrophotographic photosensitive drum and having a first engaging portion above said electrophotographic photosensitive drum adjacent one longitudinal end of said electrophotographic photosensitive drum, and a second engaging portion above said electrophotographic photosensitive drum adjacent the other longitudinal end of said electrophotographic photosensitive drum;

(b) providing a developing device frame supporting a developing roller for developing a latent image formed on said electrophotographic photosensitive drum, and having a first coil spring and a second coil spring above said developing roller adjacent one and the other longitudinal ends of said developing roller, and a first projected portion and a second projected portion projected in a direction crossing with a longitudinal direction of said developing roller adjacent the one and the other longitudinal ends of said developing roller;

(c) a coupling step of coupling a toner frame including a toner accommodating portion for accommodating toner to be used for development of the latent image by said developing roller to said developing device frame;

(d) an engaging step of engaging said first projected portion and said first engaging portion, and substantially simultaneously engaging said second projected portion and said second engaging portion;

(e) a penetration step of (i) penetrating a first penetrating member through a first opening, which is formed in said first projected portion, and a third opening and a fifth opening formed in said first engaging portion, said third opening and said fifth opening being opposed to each other with said first projected portion therebetween when said first projected portion and said first engaging portion are engaged with each other, said first penetrating member entering said third opening, then said first opening and then said fifth opening, and (ii) penetrating a second penetrating member through a second opening, which is formed in said second projected portion, and a fourth opening and a sixth opening formed in said second engaging portion, while said second projected portion and said second engaging portion are engaged with each other, so as to couple said drum frame and developing device frame, said fourth opening and said sixth opening being opposed to each other with said second projected portion therebetween when said second projected portion and said second engaging portion are engaged with each other, and said second penetrating member entering said fourth opening, then said second opening and then said sixth opening.

16. A process cartridge detachably mountable to a main assembly of an electrophotographic image forming apparatus, comprising:

an electrophotographic photosensitive drum;

a developing roller for developing a latent image formed on said electrophotographic photosensitive drum;

a developing device frame for supporting said developing roller;

a drum frame for supporting said electrophotographic photosensitive drum;

a toner frame having a toner accommodating portion for accommodating toner to be used for development of the latent image by said developing roller;

a coupling unit for coupling the toner frame including a toner accommodating portion for accommodating toner to be used for development of the latent image by said developing roller to said developing device frame;

a feeding unit for feeding a recording material to said electrophotographic image forming apparatus;

a coil spring having an end mounted to a portion of said developing device frame above said developing roller adjacent one and the other longitudinal ends of said developing roller, and having the other end contacted to said drum frame, said developing device frame having a spring holding portion integral with and projected from said developing device frame, said spring holding portion having at a base side a cylindrical fixed portion onto which an inside of the coil spring is fitted and a guide portion having a smaller diameter than the base portion and inserted halfway therethrough;

a first projected portion and a second projected portion projected, in a direction crossing with a longitudinal direction of said developing roller from a portion of said developing device frame adjacent each of the one and the other longitudinal ends of said developing roller;

first opening formed in said first projected portion;

a second opening formed in said second projected portion, the first and second openings of said first and second projections being cylindrical and having arcuate projections coaxial with the cylindrical shape;

a first engaging portion, provided on said drum frame above said electrophotographic photosensitive drum adjacent one longitudinal end of said drum frame, for engaging with said first projected portion, said first projected portion and said first engaging portion being closely engaged in the longitudinal direction,;

a second engaging portion, provided on said drum frame above said electrophotographic photosensitive drum adjacent the other longitudinal end of said drum frame, for engaging with said second projected portion, said second projected portion and said second engaging portion being loosely engaged in the longitudinal direction, a third opening formed in said first engaging portion;

a fourth opening formed in said second engaging portion, the third and fourth openings of said first and second engaging portions being cylindrical and having arcuate recesses coaxial with the cylindrical shape, and a radius of said recesses being larger than a radius of said projections by a difference from a radius of each of said openings, a first penetrating member penetrating through said first opening and said third opening while said first projected portion and said first engaging portion are engaged with each other, to couple said drum frame and said developing device frame;

a second penetrating member penetrating through said second opening and said fourth opening while said second projected portion and said second engaging portion are engaged with each other, to couple said drum frame and said developing device frame; and a charging member, a cleaning member, said developing roller and said electrophotographic photosensitive drum being a unit, wherein when said first projected portion and said first engaging portion, and said second projected portion and said second engaging portion, are engaged, respectively, said first projected portion and said first engaging portion, and said second projected portion and said second engaging portion, respectively, are substantially aligned in a direction crossing with the longitudinal direction, and said first opening and said third opening, and said second opening and fourth opening, respectively, are aligned to such an extent that said first and second penetrating members can be penetrated, and wherein when said developing device frame and said drum frame are assembled, said coil spring urges, about the penetrating member, said developing device frame and said drum frame in a direction of press-contacting said photosensitive drum and the developing roller to each other, and wherein a contact portion of said drum frame with said coil spring is continuous to increase the compression amount of the coil spring.

* * * * *

UNITED STATES PATENT AND TRADEMARK OFFICE

CERTIFICATE OF CORRECTION

PATENT NO. : 6,016,413

DATED : January 18, 2000

INVENTOR(S) : KATSUNORI YOKOYAMA, ET AL.

It is certified that error appears in the above-identified patent and that said Letters Patent is hereby corrected as shown below:

[56] REFERENCES CITED; FOREIGN PATENT DOCUMENTS:
"0000" should read --9/1989--.

[57] ABSTRACT:
Line 3, "an" should read --a--.

COLUMN 1:
Line 21, "integral" should read --integrally--.
Line 47, "244472/19890" should read --1-244472/1989--.

COLUMN 3:
Line 54, "crosssection" should read --cross section--.

COLUMN 4:
Line 62, "fame." should read --frame.--.

COLUMN 5:
Line 19, "crosssection" should read --cross section--.
Line 49, "crosssection" should read --cross section--.
Line 66, "crosssection" should read --cross section--.

COLUMN 6:
Line 14, "a" should be deleted.

UNITED STATES PATENT AND TRADEMARK OFFICE

CERTIFICATE OF CORRECTION

PATENT NO. : 6,016,413

DATED : January 18, 2000

INVENTOR(S) : KATSUNORI YOKOYAMA, ET AL

It is certified that error appears in the above-identified patent and that said Letters Patent is hereby corrected as shown below:

COLUMN 8:

Line 9, "extend" should read --extended--.

Line 49, "mains" should read --main--.

COLUMN 9:

Line 45, "nowhere but" should read --only--.

COLUMN 10:

Line 37, "and" should read --end--.

COLUMN 11:

Line 38, "crosssection" should read --cross section--.

Line 39, "crosssection" should read --cross section--.

Line 42, "crosssections" should read --cross sections--.

COLUMN 15:

Line 41, "fit" should read --fits--.

COLUMN 16:

Line 59, "melt" should read --melted--.

UNITED STATES PATENT AND TRADEMARK OFFICE

CERTIFICATE OF CORRECTION

PATENT NO. : 6,016,413

DATED : January 18, 2000

INVENTOR(S) : KATSUNORI YOKOYAMA, ET AL.

It is certified that error appears in the above-identified patent and that said Letters Patent is hereby corrected as shown below:

COLUMN 17:

Line 37, "the entire length of theirs." should read --their entire lengths--.

Line 47, "crosssection" should read --cross section--.

COLUMN 18:

Line 34, "rubber" should read --rubber member--.

Line 35, "double-side" should read --double-sided--.

COLUMN 19:

Line 12, "91" should read --91--.

Line 37, "crosssection" should read --cross section--.

Line 67, "crosssection." should read --cross section.--.

COLUMN 20:

Line 8, "91" should read --91--.

Line 21, "91" should read --91--.

COLUMN 21:

Line 9, "91" should read --91--.

Line 19, "crosssection," should read --cross section,--.

Line 43, "insert" should read --inserted--.

COLUMN 22:

Line 17, "crosssection," should read --cross section,--.

UNITED STATES PATENT AND TRADEMARK OFFICE

CERTIFICATE OF CORRECTION

PATENT NO. : 6,016,413

DATED : January 18, 2000

INVENTOR(S) : KATSUNORI YOKOYAMA, ET AL.

It is certified that error appears in the above-identified patent and that said Letters Patent is hereby corrected as shown below:

COLUMN 24:

Line 44, "crosssections" should read --cross sections--.
Line 66, "91" should read --91--.

COLUMN 25:

Line 14, "91" should read --91--.
Line 16, "91" should read --91--.
Line 20, "91" should read --91--.

COLUMN 27:

Line 4, "developlment" should read --development--.

COLUMN 28:

Line 5, "becomes" should read --become--.
Line 6, "AC" should read --an AC--.

COLUMN 29:

Line 10, "crosssection" should read --cross section--.
Line 14, "crosssection" should read --cross section--.
Line 17, "crosssection" should read --cross section--.
Line 58, "end" should read --the end.--.

UNITED STATES PATENT AND TRADEMARK OFFICE

CERTIFICATE OF CORRECTION

PATENT NO. : 6,016,413

DATED : January 18, 2000

INVENTOR(S) : KATSUNORI YOKOYAMA, ET AL.

It is certified that error appears in the above-identified patent and that said Letters Patent is hereby corrected as shown below:

COLUMN 30:

Line 18, "cross-" should read --cross--.

Line 37, "(polybutylenetelephthalate)" should read --(polybutylene terephthalate)--.

COLUMN 33:

Line 42, "reach" should read --reached--.

Line 49, "crosssection" should read --cross section--.

Line 50, "crosssection" should read --cross section--.

COLUMN 35:

Line 14, "As" should read --¶As--.

COLUMN 39:

Line 66, "reduces" should read --decreases--.

UNITED STATES PATENT AND TRADEMARK OFFICE

CERTIFICATE OF CORRECTION

PATENT NO. : 6,016,413

DATED : January 18, 2000

INVENTOR(S) : KATSUNORI YOKOYAMA, ET AL.

It is certified that error appears in the above-identified patent and that said Letters Patent is hereby corrected as shown below:

COLUMN 45:

Line 21, "portion" (second occurrence) should read --portion,--.

COLUMN 49:

Line 52, "first opening" should read --a first opening--.

COLUMN 50:

Line 6, "direction,;" should read --direction;--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*